US006158844A

United States Patent [19]

Murakami et al.

[11] Patent Number: 6,158,844

[45] Date of Patent: Dec. 12, 2000

[54] INK-JET RECORDING SYSTEM USING ELECTROSTATIC FORCE TO EXPEL INK

[75] Inventors: Teruo Murakami, Yokohama; Yasuo Hosaka, Tokyo-to; Hitoshi Nagato, Kunitachi; Shuzo Hirahara, Yokohama; Hideyuki Nakao, Kawasaki; Koichi Ishii, Kawasaki; Yuko Nomura, Kawasaki, all of Japan

[73] Assignee: Kabushiki Kaisha Toshiba, Kawasaki, Japan

[21] Appl. No.: 08/929,110

[22] Filed: Sep. 15, 1997

[30] Foreign Application Priority Data

| | | | |
|---|---|---|---|
| Sep. 13, 1996 | [JP] | Japan | 8-243592 |
| Sep. 13, 1996 | [JP] | Japan | 8-243878 |
| Feb. 19, 1997 | [JP] | Japan | 9-034704 |
| Feb. 19, 1997 | [JP] | Japan | 9-034946 |
| Mar. 6, 1997 | [JP] | Japan | 9-051451 |

[51] Int. Cl.[7] ..... B41J 2/06

[52] U.S. Cl. ..... 347/55

[58] Field of Search ..... 347/55, 154, 103, 347/123, 111, 159, 127, 128, 17, 120, 151; 399/273, 290, 293, 294, 295

[56] References Cited

U.S. PATENT DOCUMENTS 4,504,844 3/1985 Ebi et al. .

*Primary Examiner*—John E. Barlow, Jr.
*Assistant Examiner*—Raquel Yvette Gordon
*Attorney, Agent, or Firm*—Oblon, Spivak, McClelland, Maier & Neustadt, P.C.

[57] ABSTRACT

An ink jet recording device for applying an electric force to an ink to cause an ink particle to fly onto a recording medium for recording, comprises: a control substrate arranged so as to face the recording medium, said control substrate comprising an insulating supporting substrate, and first and second control electrodes arranged on both sides of the insulating supporting substrate, said control substrate having at least one through hole which passes through said first and second control electrodes and said insulating supporting substrate; ink supply source for supplying an ink into said through hole of said control substrate; and signal voltage supply source for applying a signal voltage between said first and second control electrodes, in accordance with a picture signal for causing an ink particle to fly out of said through hole toward said recording medium.

45 Claims, 76 Drawing Sheets

INK-JET RECORDING SYSTEM USING ELECTROSTATIC FORCE TO EXPEL INK

BACKGROUND OF THE INVENTION

The present invention relates generally to an ink jet recording system. More specifically, the invention relates to an ink-jet recording system for recording characters and pictures by causing the flight of at least a coloring material of a liquid ink, which contains the coloring material dispersed in a solvent, as an ink droplet onto a recording medium by electrostatic force.

A recording device for recording a picture by forming recording dots on a recording medium by spraying the recording medium with a liquid ink as micro-droplets called ink droplets has been put to practical use as an ink jet printer. This type of ink jet printer has the advantage of making fewer noises than a mechanical recording device, such as a wire dot printer, or the like. In comparison with an electrophotographic recording device such as Carlson process, there is also an advantage in that it is not required to carry out treatments such as development and fixing. For that reason, the ink jet printer has been noticed as plain paper recording technique.

To date, various ink jet printers have been proposed. Typical systems of ink jet printers include: (a) an electric thermal conversion system for causing the flight of an ink droplet by steam pressure produced by the heat of a heating element (see, e.g., Japanese Patent Publication Nos. 56-9429 and 61-59911), and (b) a piezoelectric system for causing the flight of an ink droplet by mechanical pressure pulses produced by a piezoelectric element (see Japanese Patent Publication No. 53-12138).

As a recording head used for an ink jet printer (which will be hereinafter referred to as an "ink jet head"), a serial scanning head loaded on a carriage for carrying out the recording while moving in a direction (which will be hereinafter referred to as a "main scanning direction") perpendicular to a recording-paper carrying direction (which will be hereinafter referred to as a "feed direction") has been put to practical use. Since this serial scanning head can not carry out the recording unless it is moved by a predetermined distance in the main scanning direction, it is difficult to increase the recording speed. Therefore, a line scanning printer, wherein the recording speed is increased by means of a long recording head having a length which is set to be substantially the same as the width of a recording paper, has been proposed. However, it is not easy to put such a line scanning printer to practical use for the following reasons.

In the ink jet recording system, a large number of separate small nozzles corresponding to resolution are provided, and ink is essentially concentrated easily due to evaporation and volatilization of the solvent, so that the nozzles clog easily. In addition, in the system for using the steam pressure to form an ink jet, an insoluble matter formed by thermally or chemically reacting with the ink is adhered to the nozzle, so that the nozzles clog easily. Moreover, in the system for using the pressure caused by a piezoelectric element, the nozzles clog more easily due to the complicated structure, such as ink passages. In the line scanning head which uses a larger number of nozzles than serial scanning head using tens through one hundred and tens of nozzles, i.e., which uses thousands of nozzles, the nozzles clog with higher probability, so that there is no reliability from a practical standpoint.

Moreover, in the system for using the steam pressure, it is difficult to produce particles, each of which has a particle diameter of not greater than 20 $\mu$m corresponding to each of recording dots having a diameter of about 50 $\mu$m, so that it is difficult to manufacture a head having a high resolution. In addition, in the case of the system for using the pressure caused by a piezoelectric element, the structure of the recording head is complicated, so that it is difficult to manufacture a head having a high resolution for an issue of working technique. For these reasons, in conventional ink jet devices of any systems, there is a problem in that it is difficult to improve the resolution.

In order to eliminate the problems described above, there has been provided an ink jet recording device, wherein voltage is applied to an array of electrodes, which is formed by arranging a plurality of separate electrodes formed on a substrate using a thin film, to cause the flight of an ink or a coloring material component thereof as an ink droplet from an ink liquid surface using electrostatic force.

Specifically, there have been proposed a system for causing the flight of an ink droplet using electrostatic force (see Japanese Patent Laid-Open Nos. 49-62024 and 56-4467), a system for causing the flight of an ink droplet by increasing the concentration of a coloring material using an ink containing a charged coloring component (see Japanese Patent Laid-Open No. 502218) and so forth. In these systems, a recording head has a slit-like nozzle structure which is not required to provide nozzles for each of separate dots, or a nozzleless structure which is not required to provide partitions of ink passages for each of separate dots. Therefore, these systems are effective in the prevention and restoration of clogging which is an obstacle to the realization of a line scanning recording head. In addition, the latter system for increasing the concentration of a coloring material is suitable for the increase of resolution since it is possible to stably produce an ink droplet of a very small particle to cause the flight thereof.

On the other hand, in the electrostatic attraction ink jet system, it is possible to cause the flight of very fine particles of ink from a common slit-like nozzle without the need of separate nozzles corresponding to respective picture dots, and it is free from the clogging of the nozzle. Utilizing this advantage, there has been provided a multi-ink jet head of an electrostatic attraction system, wherein a large number of electrodes are provided in a slit-like nozzle to form a multihead. Referring to the schematic view of FIG. 1, the electrostatic attraction ink jet system will be described below.

As shown in FIG. 1, a slit 2 is formed in two insulating layers 1, and an oil based conductive ink is carried from an outside ink supply tank 4 to the tip portion 3 of the slit 2 by capillary phenomenon. In the slit 2, a plurality of electrodes 5 are provided. When a bias voltage 6 and a signal voltage 7 corresponding to a picture signal are applied to the respective electrodes 5, ink particles 8 fly from the respective electrodes 5 in response to the picture signal, so that a picture is formed on a recording paper.

In this electrostatic attraction ink jet system, fine ink particles being smaller than the slit width can fly, so that it is possible to prevent the tip of the slit from clogging, and it is also possible to form ink particles of a high resolution.

However, since the ink can freely move on the substrate of the recording head in a main scanning direction, there is a problem in that the ink-droplet emitting position is unstable.

In addition, since the flight of an ink droplet onto a recording paper are caused by a voltage having the same polarity as the charged polarity of a coloring material, the coloring material component is repulsed to escape from the position of the electrode on the recording head, so that there is a problem in that the coloring material component can not be stably supplied to the ink-droplet emitting position. Therefore, it is difficult to stably cause the flight of a sufficient amount of ink droplets from a predetermined emitting point, so that there is a problem in that it is not possible to suitably record characters and pictures on a recording material.

SUMMARY OF THE INVENTION

It is therefore an object of the present invention to eliminate the aforementioned problems and to provide an ink jet recording device, wherein the electric field for causing the flight of an ion particle is not under the influence of the shape of an electrode and so forth, and which can stably cause the flight of the ion particle.

It is another object of the present invention to provide an ink jet recording device, which can record in a high resolution without causing the interference between the electrostatic fields of the adjacent electrodes and the interference between the ink surface pressures thereof, and which has a high degree of freedom of an ink which can be used.

It is further object of the present invention to provide an ink jet recording device, which can stably supply a coloring material component of an ink to the tips of separate electrodes serving as ink-droplet discharging positions, so as to stably cause the discharge and flight of an ink droplet without causing clogging.

It is still further object of the present invention to an ink jet recording device, wherein an ink guide having a projecting portion corresponding to a discharging hole can be housed in an ink chamber, so that it is possible to prevent a nozzle from being clogged and it is possible to protect an ink head without damaging the projecting portion even if the wiping is carried out and even if the paper jam is caused.

In order to accomplish the aforementioned and other objects, according to one aspect of the present invention, there is provided an ink jet recording device for applying an electric force to an ink to cause an ink particle to fly onto a recording medium for recording, the ink jet recording device comprising: a control substrate arranged so as to face the recording medium, the control substrate comprising an insulating supporting substrate, and first and second control electrodes arranged on both sides of the insulating supporting substrate, the control substrate having at least one through hole which passes through the first and second control electrodes and the insulating supporting substrate; ink supply means for supplying an ink into the through hole of the control substrate; and signal voltage applying means for applying a signal voltage between the first and second control electrodes, in accordance with a picture signal for causing an ink particle to fly out of the through hole toward the recording medium.

According to another aspect of the present invention, there is provided an ink jet recording device for applying an electrostatic force to an ink containing a coloring material component in a solvent, to cause an ink droplet containing at least the coloring material component to fly toward a recording medium to record on the recording medium, the ink jet recording device comprising: a plurality of separate electrodes for applying an electrostatic force; and ink supply means for supplying the ink to the separate electrodes, each of the plurality of separate electrodes comprising: an insulating substrate which has a through hole extending in an ink-drop flying direction; a control electrode, which has a through hole having a slightly greater diameter than that of the through hole of the insulating substrate and which is formed on at least one surface of the insulating substrate; and a projecting ink guide, which is arranged substantially at the center of the through holes of the insulating substrate and the control electrode and which has a tip portion serving as an ink-droplet flying position, the tip portion projecting from an upper surface of the control electrode or the insulating substrate toward the recording medium.

According to another aspect of the present invention, there is provided an ink jet recording device comprises: a control substrate having a plurality of ink discharging holes aligned with each other; separate control electrodes arranged so as to surround the ink discharging holes, respectively; an ink guide comprising a flat base portion facing the control electrodes, and a plurality of projecting portions, each of which projects in an ink flying direction from the base portion at a position facing a corresponding one of the ink discharging holes for allowing the ink to fly out of a tip of the projecting portion; an ink chamber formed between one side of the control substrate, on which the control electrodes are provided, and the other side thereof; and an ink guide moving mechanism, provided on the base portion of the ink guide on the side that is formed with the projecting portions, for moving the base portion of the ink guide so as to approach the control substrate and so as to be apart from the control substrate.

According to another aspect of the present invention, there is provided an ink jet recording device for applying an electrostatic force to an ink containing a coloring material component in a solvent, to cause an ink droplet containing at least the coloring material component to fly toward a recording medium to record on the recording medium, the ink jet recording device comprising: a plurality of separate electrodes for applying an electrostatic force; and ink supply means for supplying the ink to the separate electrodes, each of the plurality of separate electrodes comprising: an insulating substrate which has a through hole extending in an ink-drop flying direction; a control electrode, which has a through hole continuously extending from the through hole of the insulating substrate and which has a conductive body surrounding the through hole of the insulating substrate; and a projecting ink guide, which is arranged substantially at the center of the through hole of the insulating substrate and which has a tip portion serving as an ink-droplet flying position, the tip portion projecting from surfaces of the insulating substrate and the control electrode toward the recording medium, at least the tip portion having conductivity.

According to another aspect of the present invention, there is provided an ink jet recording device for applying an electrostatic force to an ink containing a coloring material component in a solvent, to cause an ink droplet containing at least the coloring material component to fly toward a recording medium to record on the recording medium, the ink jet recording device comprising: a separate electrode for applying an electrostatic force; a lid having an ink supply hole which is formed in the separate electrode for causing an ink droplet to fly in an ink-droplet flying direction; and ink supply means for supplying the ink to the separate electrode and the ink supply hole, the separate electrode having a projecting portion which has a slit-like groove formed at the center thereof for guiding an ink, and the separate electrode being arranged substantially at the center of the ink supply hole and projecting from the surface of the ink supply hole toward the recording medium.

According to another aspect of the present invention, there is provided an ink jet recording device for applying an electrostatic force to an ink containing a coloring material component in a solvent, to cause an ink droplet containing at least the coloring material component to fly toward a recording medium to record on the recording medium, the ink jet recording device comprising: an insulating substrate having a plurality of ink discharging holes; a first control electrode, which is arranged around one of two adjacent ink discharging holes of the plurality of ink discharging holes and which is provided on the insulating substrate on the side of the recording medium; and a second control electrode, which is arranged around the other of the two adjacent ink discharging holes of the plurality of ink discharging holes and which is provided on the insulating substrate on the opposite side of the recording medium.

According to further aspect of the present invention, there is provided an ink jet recording device for applying an electrostatic force to an ink containing a coloring material component in a solvent, to cause an ink droplet containing at least the coloring material component to fly toward a recording medium to record on the recording medium, the ink jet recording device comprising: an ink guide, which has a slit for sucking the ink by capillarity, and a flat surface facing the recording medium on both sides of the slit.

According to still further aspect of the present invention, there is provided an ink jet recording device for applying an electrostatic force to an ink containing a coloring material component in a solvent, to cause an ink droplet containing at least the coloring material component to fly toward a recording medium to record on the recording medium, the ink jet recording device comprising: a plurality of separate electrodes for applying the electrostatic force; a protecting member for protecting the separate electrodes; and ink supply means for supplying the ink to the separate electrodes, each of the plurality of separate electrodes comprising a control electrode substrate and a projecting guide, wherein the control electrode substrate comprises an insulating substrate having a through hole extending in the ink-drop flying direction, and a control electrode formed in at least one surface of the insulating substrate so as to correspond to the through hole, the protecting member being arranged on the control electrode substrate on the side of the recording medium, and wherein the tip portion serving as an ink-droplet flying position of the projecting ink guide projects from a surface of the control electrode substrate toward the recording medium substantially at the center of the through hole, and the projecting ink guide is arranged on the side of the control electrode substrate apart from the recording medium of the protecting member.

As described above, according to the present invention, first and second control electrodes may be provided on both surfaces of an insulating supporting substrate. A control substrate having at least one through hole passing through the first and second control electrodes and the insulating supporting substrate may be arranged so as to face a recording medium. Ink is supplied to the through hole of the control substrate. A signal voltage corresponding to a picture signal is applied between the first and second control electrodes to cause an ink particle to fly out of the through hole of the control substrate toward the recording medium. An electric field for causing the flight of the ink particle is determined by the signal voltage applied between the first and second control electrodes and the thickness of the insulating supporting substrate serving as an insulating layer between the first and second control electrodes, so that it is possible to stably cause the ink particle under no influence of the shapes of the electrodes.

The separate electrode for exerting electrostatic force on the coloring material component may comprise: a control electrode substrate, which comprises an insulating substrate having a through hole and a control electrode corresponding to the through hole, and a projecting ink guide arranged substantially at the center of the through hole, so that an ink is carried from the surface of the projecting guide to an ink-droplet flying position, and the ink-droplet flying to a recording medium by applying a predetermined voltage to the control electrode. Thus, it is possible to prevent the nozzle from clogging, and the ink-droplet flying position and the thickness of the thin ink layer formed at the ink-droplet flying position 110 can be stably maintained in a recessed groove. Therefore, the flight of ink can be stabilized under no influence of the pressure of the ink and atmosphere and no influence of the adjacent dots, so that it is possible to record a picture having a stable concentration.

The projecting portion is movable and arranged in the ink chamber when the recording is not carried out. Therefore, for example, the wiping can be carried out to prevent the clogging, and the capping and the aspirator can be used without paying attention to the tip of the projecting portion. Even if the coloring material is adhered to the projecting portion after the device is used for a long time, it is possible to simply clean the projecting portion by immersing it in the ink chamber. Since the projecting portion can be immersed in the ink chamber, the projecting portion is always wet if the projecting portion is protruded when the recording is carried out, so that it is possible to stably start the recording. Moreover, if the projecting portion is immersed in the ink chamber immediately when the paper jam is detected, it is possible to prevent the projecting portion from being damaged.

As mentioned above, according to the ink jet recording device of the present invention, the separate electrodes for exerting electrostatic force necessary to discharge the ink may be distributed to both surface of the control substrate. Therefore, it is possible to increase the density of the arranged ink discharging nozzles, and it is possible to decrease the area of leads for applying the signal voltage to the control electrode in half, so that it is possible to increase the density of the recording heads.

With these constructions, flat surfaces may be provided at least at the ink-droplet flying position of the tip of the ink guide, so that it is possible to improve the rubbing resistance. Thus, it is possible to prevent the head from being deformed even if the tip of the head is rubbed by the wiping for preventing the clogging. In addition, a capping and an aspirator can be used without paying a great attention to the tip of the projecting portion. In addition, even of the coloring material is adhered to the projecting portion, it is possible to simply restore a clear projecting head by cleaning the projecting portion when the recording is started, so that it is possible to stably start the recording. Moreover, if the paper jam is detected, it is possible to prevent the projecting portion from being damaged since the projecting portion has no portion tapered to a point.

DESCRIPTION OF THE PREFERRED EMBODIMENTS

Referring now to the accompanying drawings, the preferred embodiments of the present invention will be described below.

FIRST PREFERRED EMBODIMENT (First Example)

Figure 1:
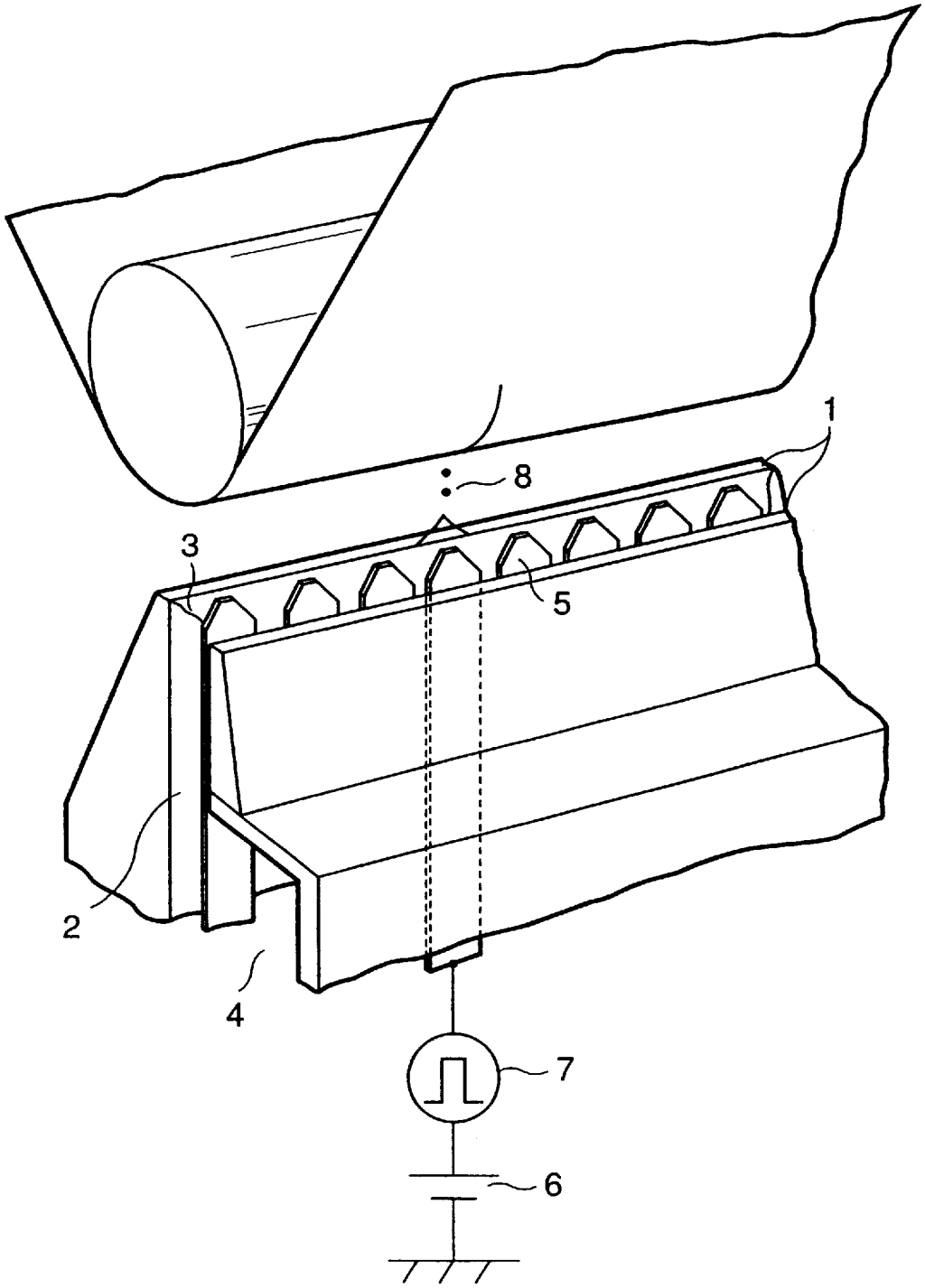
FIG.1 PRIOR ART
FIG. 1 is a schematic view of a conventional multihead type ink jet recording device of an electrostatic attraction system.
Figure 2:
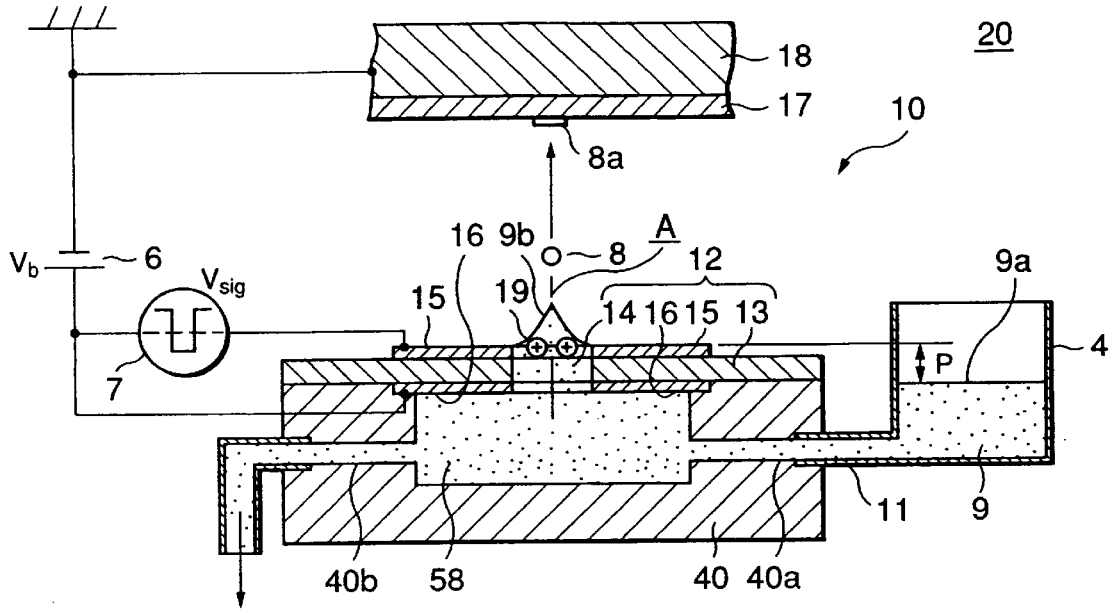
FIG. 2 is a schematic cross section of a principal part of a first example of the first preferred embodiment of an ink jet recording device according to the present invention.

FIG. 2 is a cross section schematically illustrating an ink jet head serving as a principal part of the first example in the first preferred embodiment of an ink jet recording device according to the present invention, which shows the construction corresponding to a recording picture dot.

In this example, an ink jet recording device 10 comprises an ink supply tank 4 containing a liquid ink 9, an ink carrying passage 11 for carrying the ink 9 from the ink supply tank 4 to an ink jet head 20, and a control electrode substrate 12 arranged between the ink carrying passage 11 and a recording medium 17. The resistivity of the liquid ink 9 is about 105~109Ωm.

The control electrode substrate 12 comprises: an insulating substrate 13 having a plurality of through holes 14, which are arranged at regular intervals in a direction perpendicular to the plane of the drawing so as to correspond to a plurality of recording picture dots; a first control electrode 15 formed on the insulating substrate 13 on the side of the recording medium 17; and a second control electrode 16 formed on the insulating substrate 13 on the side of the ink carrying passage 40*a* formed through a head block 40.

The first and second control electrodes 15 and 16 are formed with a plurality of through holes which are in communication with the through holes 14 of the insulating substrate 13. Furthermore, all the through holes formed in the insulating substrate 13 and the first and second control electrodes 15 and 16 will be hereinafter generically referred to as the through holes 14.

The ink jet head 20 may be a single head having a single ink emitting point, or a multihead having a plurality of ink emitting points. In the case of the multihead, the first control electrode 15 comprises separate electrodes corresponding to a plurality of recording picture dots, and the second control electrode 16 is a common electrode for the plurality of recording picture dots.

Specifically, the control electrode substrate 12 is, e.g., a coppered substrate which comprises copper foils having a thickness of 18 μm bonded to both sides of a polyimide film having a thickness of 100 μm. This coppered substrate is formed with the through holes 14 of 100 μmϕ corresponding to the respective recording picture dots. The polyimide film serves as the insulating substrate 13, and the copper foils serving as the first and second control electrodes 15 and 16 are formed on both sides.

A bias voltage source 6 is connected between the second control electrode 16 and a grounded metal platen 18, and a signal voltage source 7 is connected to the first and second control electrodes 15 and 16. The ink 9 in the ink supply tank 4 is supplied to the through holes 14 of the control electrode substrate 12 via the ink carrying passage 11 by hydrostatic pressure P, which is determined by a difference of elevation between an ink surface 9*a* in the ink supply tank 4 and the first control electrode 15, to form an ink surface 9*b* in the respective through holes 14.

The recording medium 17 is, e.g., a plain paper. The recording medium 17 is arranged on the metal platen 18 also serving as a counter electrode so that the distance between the recording medium 17 and the first control electrode 15 is about 500 μm. Furthermore, the metal platen 18 is grounded.

The bias voltage source 6 applies a voltage sufficient for the flight of an ink particle, e.g., a bias voltage Vb of 2 kV, to the second control electrode 16 when an electric charge is induced on the ink surface 9*b* in the through hole 14. Between the first control electrode 15 and the second control electrode 16, the signal voltage source 7 applies a signal voltage Vsig, which varies in the form of steps between +100 V (OFF state) and −100 V (ON state) in response to a picture signal.

Figure 3:
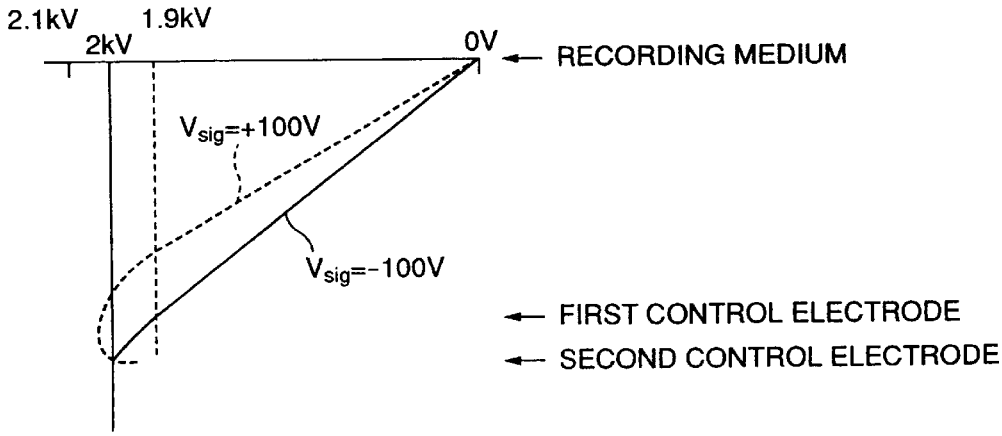
FIG. 3 is a graph showing the distribution of potential on a line passing through the central axis of a through hole in the first example.

FIG. 3 shows the distribution of potential on line A passing through the central axis of the through hole 14 when the signal voltage Vsig is applied between the first control electrode 15 and the second control electrode 16.

In a case where Vsig=+100 V (OFF state), the electric field between the first control electrode 15 and the second control electrode 16 is opposite to the field between the metal platen 18 and the first control electrode 15, so that a negative charge is induced on the ink surface 9*b* in the through hole 14. As a result, the ink surface 9*b* is repelled between the metal platen 18 and the first control electrode 15, so that no ink particle flies.

On the other hand, in a case where Vsig=+100 V (ON state), a positive charge 9 is induced on the ink surface 9*b* in the through hole 14, so that the ink surface 9*b* is attracted toward the recording medium 17 on the metal platen 18 by the electric field between the metal platen 18 and the first control electrode 15. When the electric field force acting on the positive charge 19 induced on the ink surface 9*b* is greater than the surface tension of the ink surface 9*b*, the ink particle 8 emits out of the ink surface 9*b*. The flying ink particle 8 is accelerated by the bias voltage Vb applied between the metal platen 18 and the first and second control electrodes 15 and 16, to reach the recording medium 17 to form a recording picture dot 8*a* thereon.

As mentioned above, in the first example, the liquid ink 9 is carried to the separate through holes 14, which are formed in the control electrode substrate 12 having the first and second control electrodes 15 and 16 so as to correspond to the respective picture dots, to form the ink particles 8 to cause the ink particles 8 to fly onto the recording medium 17. Thus, it is possible to provide an ink jet head of an electrostatic attraction system which does not cause electrostatic interference between nozzles.

(Second Example)

Figure 4:
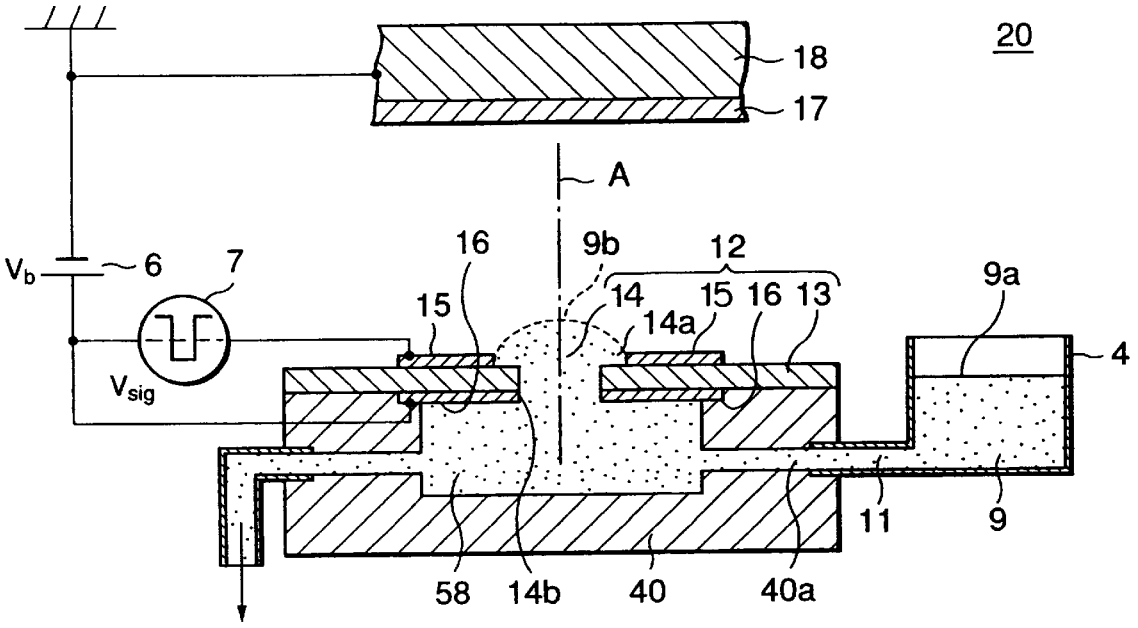
FIG. 4 is a schematic cross section of a principal part of the second example of an ink jet recording device according to the present invention.

FIG. 4 shows a principal part of the second example in the first preferred embodiment of an ink jet recording device according to the present invention.

In the second example, out of through holes 14, the diameter of a through hole 14*a* of a first control electrode 15 on the side of a recording medium 17 is greater than the diameter of a through hole 14*b* of a second control electrode 16 on the side of an ink chamber 58 to which an ink carrying passage 11 passes through. Specifically, the diameter of the through hole 14*a* of the first control electrode 15 is 200 μm, the thickness of a polyimide film serving as an insulating substrate 13 is 25 μm, and the diameter of the through hole 14*b* of the second control electrode 16 is 100 μm.

Thus, since the electric field on an ink surface 9*b* in the through hole 14*a* of the first control electrode 15 is increased by a signal voltage Vsig applied between the control electrodes 15 and 16, it is possible to cause the flight of an ink particle by a lower signal voltage.

Figure 5:
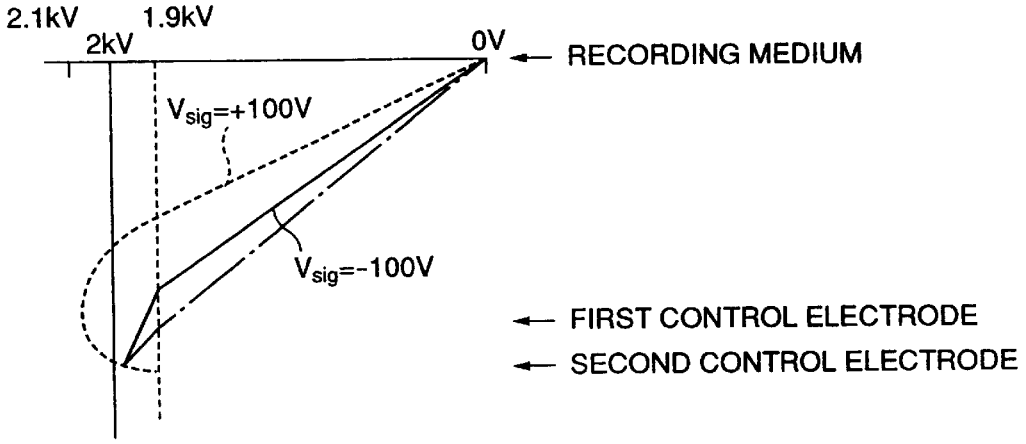
FIG. 5 is a graph showing the distribution of potential on a line passing through the central axis of a through hole in the second example.

FIG. 5 shows a potential distribution on line A passing through the central axis of the through holes 14, 14*a* and 14*b* when the signal voltage Vsig is applied in this preferred embodiment.

In a case where Vsig=−100 V (ON state) shown by the solid line in FIG. 5, a positive charge is induced on the ink surface 9*b* in the through hole 14*a* of the first control electrode 15, so that the ink surface 9*b* is attracted toward the recording medium 17 arranged on the metal platen 18 by the electric field between the metal platen 18 and the first control electrode 15. Then, an ink particle emitting out of the ink surface 9*b* is accelerated by a bias voltage Vb applied between the metal platen 18 and the first and second control electrodes 15 and 16, to reach the recording medium 17.

In this case, in comparison with the distribution of potential (shown by a dashed line) when the diameters of the through holes of the first and second control electrodes 15 and 16 are equal to each other similar to the first preferred embodiment, the potential difference between the control electrodes 15 and 16 is increased. Therefore, it is possible to cause the formation and flight of an ink particle by a low driving voltage.

In addition, in a case where Vsig=+100 V (OFF state) shown by the dotted line in FIG. 5, it is possible to obtain a cutoff state. In a case where Vsig=+100 V (OFF state), the electric field between the first control electrode 15 and the second control electrode 16 is opposite to the electric field between the metal platen 18 and the first control electrode 15, so that a negative charge is induced on the ink surface in the through hole 14. Therefore, the ink surface is repelled by the electric field between the metal platen 18 and the first control electrode 15, so that no ink particle emits.

Thus, in this preferred embodiment, out of the through holes 14 of the control electrode substrate 12, the diameter of the through hole 14*a* of the first control electrode 15 is set to be greater than the diameter of the through hole 14*b* of the second control electrode 16, so that the driving voltage can be decreased. As a result, it is possible to use an IC, which has a small packaging area and which can be operated by a low voltage, so that it is possible to decrease the size and price of a head.

(Third Example)

Figure 6:
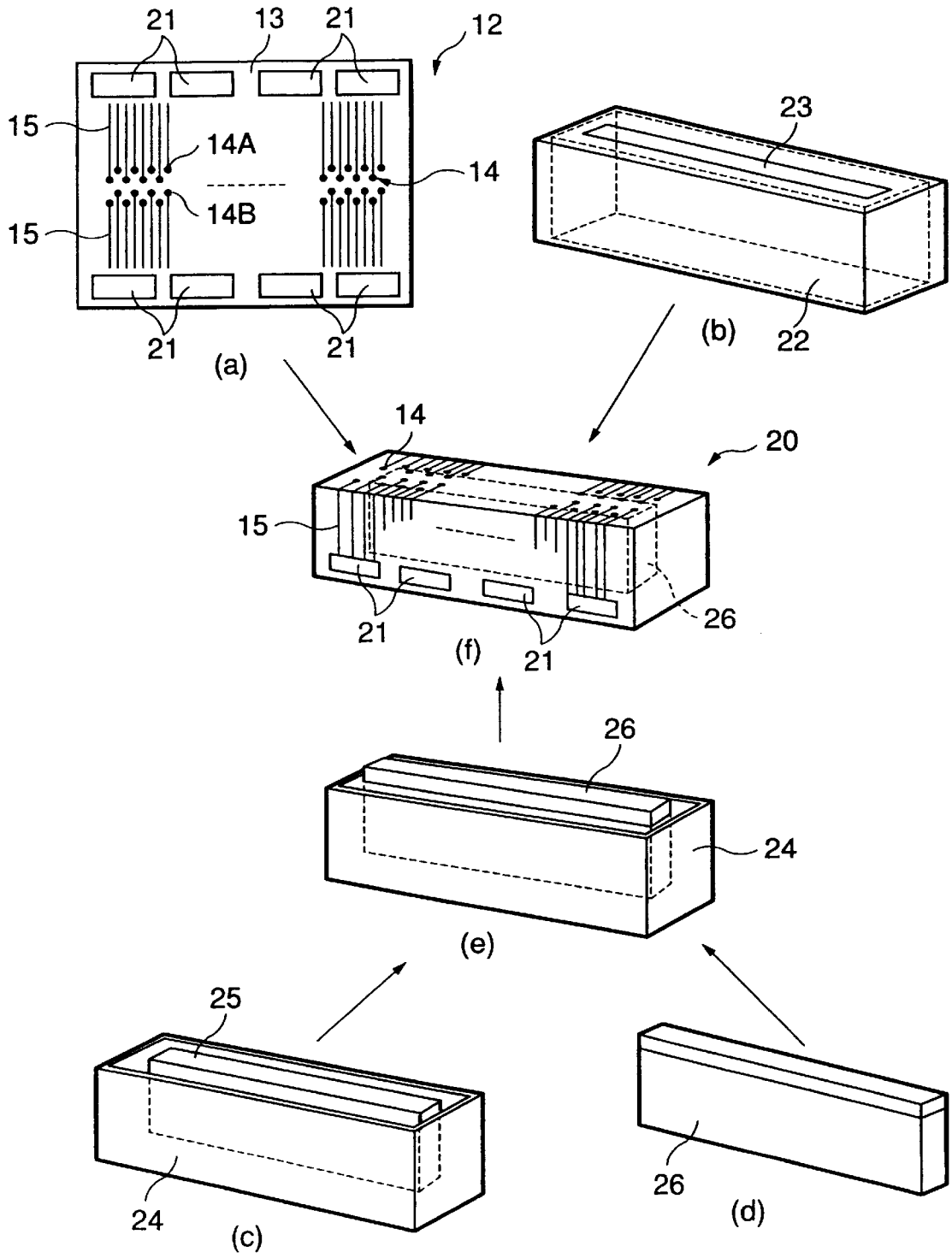
FIG. 6 is a schematic exploded perspective view of the third example of a multihead type ink jet recording device according to the present invention.

A multi-ink jet head having a plurality of ink-particle emitting points used for the third example in the first preferred embodiment of an ink jet recording device, according to the present invention, will be described in detail below. FIG. 6 is an exploded perspective view illustrating a multi-ink jet head.

A control electrode substrate 12 shown in FIG. 6(*a*) is basically the same as those in the first and second examples of the first preferred embodiment.

The first control electrode 15 comprises separate electrodes corresponding to the plurality of recording picture dots, and the second control electrode 16 is a common electrode for the plurality of recording picture dots. In this case, copper foils having a thickness of 18 μm are provided on both sides of a polyimide film having a thickness of 25 μm, and then, the side corresponding to the first control electrode 15 is divided into a plurality of portions corresponding to the respective recording picture dots by etching. Then, the through holes 14 of 100 μmφ forming the respective control electrodes are formed by etching.

The through holes 14 are arranged so that two rows of staggered through holes 14A extend in a main scanning direction at a position shifted from the center in a feed direction to one side, and two rows of staggered through holes 14B extend in the main scanning direction at a position shifted from the center in the feed direction to the other side. The first control electrodes 15 extend on both sides in the feed direction so as to correspond to the two sets of staggered through holes 14A and 14B.

If the distance between the adjacent through holes in one row is 500 μm, the distance between the staggered through holes 14A and 14B is 250 μm. Therefore, if the respective positions of the staggered through holes 14A and 14B are shifted by a half pitch, i.e., 125 μm, the distance between the adjacent through holes 14 in the main scanning direction is 125 μm, so that the resolution is 8/mm.

Driving IC 21 connected to the other ends of the first control electrodes 15 extending on both sides in the feed direction are arranged on the control electrode substrate 12.

The control electrode substrate 12 shown in FIG. 6 is bonded and secured to two opposite surfaces of a box-like control-substrate supporting body 22 shown in FIG. 6(*b*), respectively. In one of two surfaces of the control-substrate supporting body 22 other than the surfaces bonded to the control electrode substrates 12, a slit 23 is formed.

On the other hand, as shown in FIG. 6(*e*), a plate-like porous body 26 impregnated with the ink 9 shown in FIG. 6(*d*) is inserted into a slit 25 of an ink container 24 shown in FIG. 6(*c*) so as to form an integral construction. Then, as shown in FIG. 6(*f*), this integral construction is arranged in the control-substrate supporting body 22 to assemble a multi-ink jet head 20 so that the upper surface of the porous body 26 is arranged in the slit 23 of the control-substrate supporting body 22. In addition, the driving IC 21 is provided with a buffer memory, so that signal voltages are applied to the control electrodes arranged on the control electrode substrate 12 at predetermined timings for each of rows to control the flight of the ink particle.

Furthermore, the ink container 24 received in the porous body 26 may be disposable. In addition, the structure mounting thereon the driving IC of the multi-ink jet head 20 may be separated from the ink supply system thereof so that they can be separately changed.

Thus, in the case of the multi-ink jet head 20 in this preferred embodiment, if the second control electrode 16 arranged on the control electrode substrate 12 is a common electrode, the driving IC 21 may control only the first control electrode 15, so that the circuit can be simplified. In addition, it is possible to separately control the electric field in the through hole 14 due to the shield effect by the second control electrode 16 serving as the common electrode.

(Fourth Example)

An ink supply mechanism for supplying an ink to an ink jet head, according to the present invention, will be described below.

If an ink is supplied from the side of a first control electrode 15, the decomposition of an ionic material or the maldistribution of the charge dispersing element in the ink is caused by the electric field between the respective electrodes voltage, so that it is not possible to stably cause the flight of the ink particles for a long term.

Therefore, in this example, the electric field from a first control electrode 15 serving as a separate electrode, to which a signal voltage is applied, is shielded by a second control electrode 16 serving as a common electrode, and an ink is supplied so as to contact the second control electrode 16, so that the decomposition and biasing phenomenon are prevented and the ink particle stably files for a long term.

Figure 7:
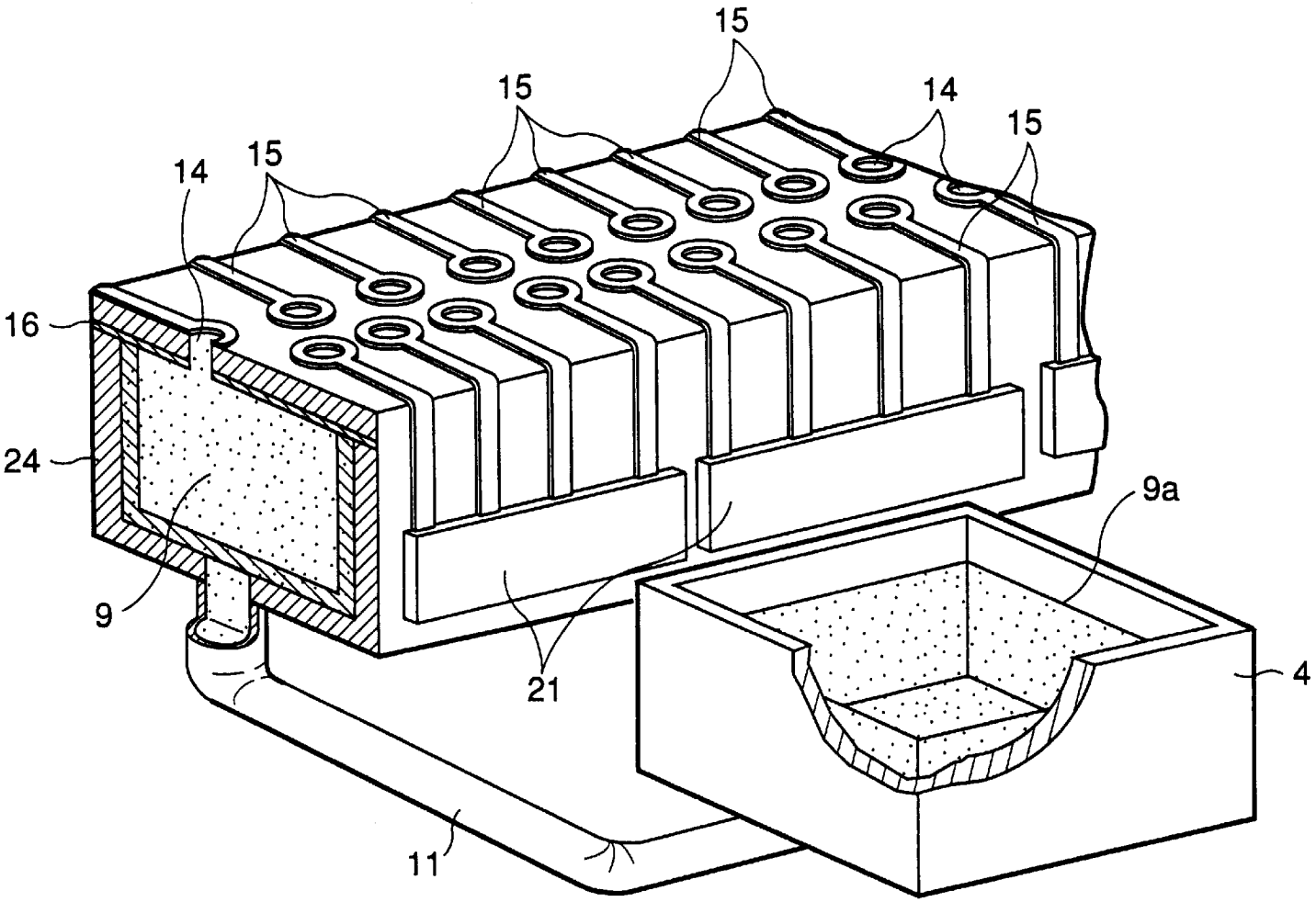
FIG. 7 is a schematic view of an ink carrying system in the fourth example of an ink jet recording device according to the present invention.

Specifically, as shown in FIG. 7, the first control electrode 15 serving as a separate electrode on the control electrode substrate 12 is provided on the side of a recording medium (not shown), and an ink 9 is supplied from the side of the second control electrode 16 serving as a common electrode via a through hole 14. Thus, all the ink 9 has the same potential, so that no potential difference occurs in the ink 9. Therefore, it is possible to prevent the ionic material from depositing and the charge dispersing element from being maldistributed, so that it is possible to stably cause the flight of the ion particles while maintaining the ink composition for a long term.

(Fifth Example)

An ink supply mechanism for always holding a stable ink supply pressure to remove the interference of ink pressures between through holes 14, according to the present invention, will be described below.

Figure 8:
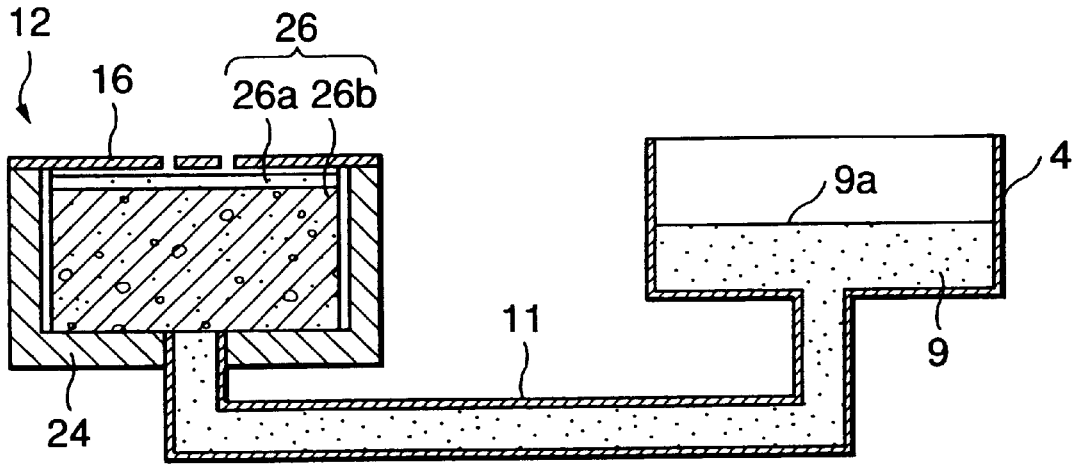
FIG. 8 is a schematic view of an ink carrying system in the fifth example of an ink jet recording device according to the present invention.

As shown in FIG. 8, a porous body 26 having layers 26*a* and 26*b* is provided on a control electrode substrate 12 on the side of a second control electrode 16 serving as a common electrode. The ink pressure in the through hole 14 can be finely controlled by the capillary phenomenon to stabilize the flight of ink. The ink surface 9*a* of the ink supply tank 4 is preferably held at a lower level than a second control electrode 16, so that a negative hydrostatic pressure is held.

(Sixth Example) In the sixth example of the first preferred embodiment to modify the fifth example, the average diameter of capillaries of porous body 26 is greater than the diameter of a through hole 14 so that the hydrostatic pressure can be finely adjusted.

Figure 9:
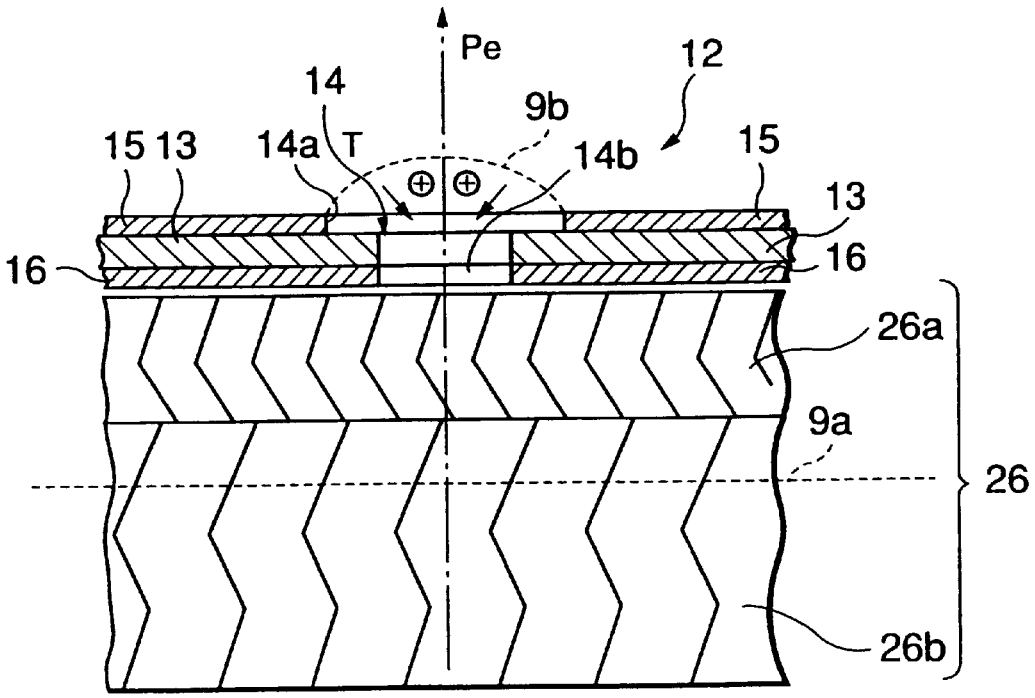
FIG. 9 is a schematic cross section of a control substrate in the sixth example of an ink jet recording device according to the present invention.

Referring to FIG. 9, the sixth example of the first preferred embodiment will be described. If the pressure of ink can be finely adjusted, an ink surface 9*b* can stably raised from the through hole 14 of a control electrode substrate 12 (particularly from a through hole 14*a* of a first control electrode 15). Since electrostatic focusing occurs at the tip of the ink surface thus raised, the flight of an ink particle can be easily caused.

On the other hand, on the reverse surface of a second control electrode 16 having a through hole 14*b* of 100 $\mu$mϕ, a porous body 26 having an average diameter of 300 mϕ gr eater than that of the through hole 14*b* is provided. The weight of ink in the porous body 26 serves as a load, so that a negative pressure is applied to the ink 9 by the difference between the load and the suction force in the capillary in the through hole 14*b*. Thus, the pressure of ink can be freely set by the diameter and length of the porous body of the porous body 26.

The surface of the raised ink, by which the ink emitting conditions are determined, is arranged at a position 9*b* at which an electrostatic ink attraction by a bias voltage of 2kV between the first and second control electrodes 15 and 16 and a recording medium 17, a capillary ink attraction acting on the through holes of the control electrodes 15 and 16, and a negative pressure due to a load of the porous body 26 are balanced. Thus, if the ink surface 9*a* is always raised by tens $\mu$m from the through hole 14*a*, the electrostatic focusing is produced at the tip of the raised ink, so that it is possible to stably cause the flight of an ink particle.

In addition, the electrostatic pressure applied to the respective through holes 14 when the ink particles emit, is blocked by the wall of the porous body 26 arranged on the reverse surface of the second control electrode 16, so that it is possible to prevent the pressure interference between the through holes 14.

(Seventh Example)

Figure 10:
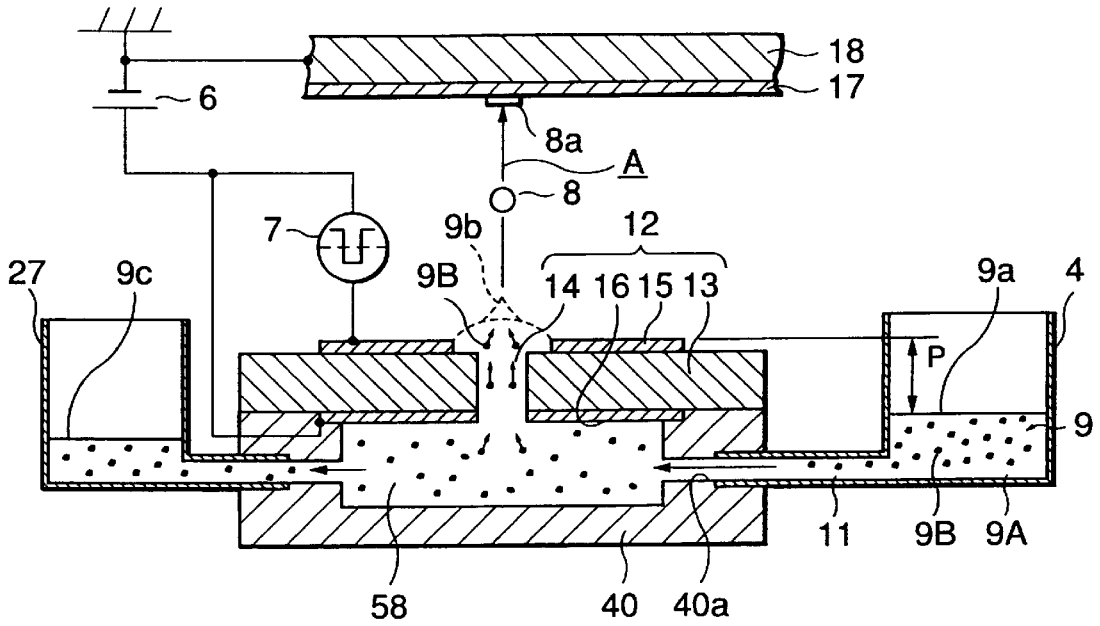
FIG. 10 is a schematic cross section of a principal part of the seventh example of an ink jet recording device according to the present invention.

In the seventh example shown in FIG. 10, a liquid ink containing a charged coloring material dispersed in a solvent is used. In this example, a liquid ink 9 contained in an ink supply tank 4 consists of: an insulating solvent 9A, which has a resistibility of not less than 108Ωcm; and a charged coloring material 9B which is obtained by mixing a positive charge control agent and a pigment with a binder and which is dispersed in the solvent 9A. The charged coloring material 9B has a low concentration of about 1–5% in order to easily carry the ink 9. The liquid ink 9 is supplied from an ink supply tank 4 through a ink carrying passage 11 to a ink chamber 58 formed in a head block 40, and exhausted from the ink chamber 58 to an ink recovery tank 27 after recording. To the first and second control electrodes 15 and 16, a bias voltage of 2 kv is applied from the bias voltage source 6.

In this seventh example, the principle of the flight of the ink particle 8 will be described by using FIG. 11.

Figure 11:
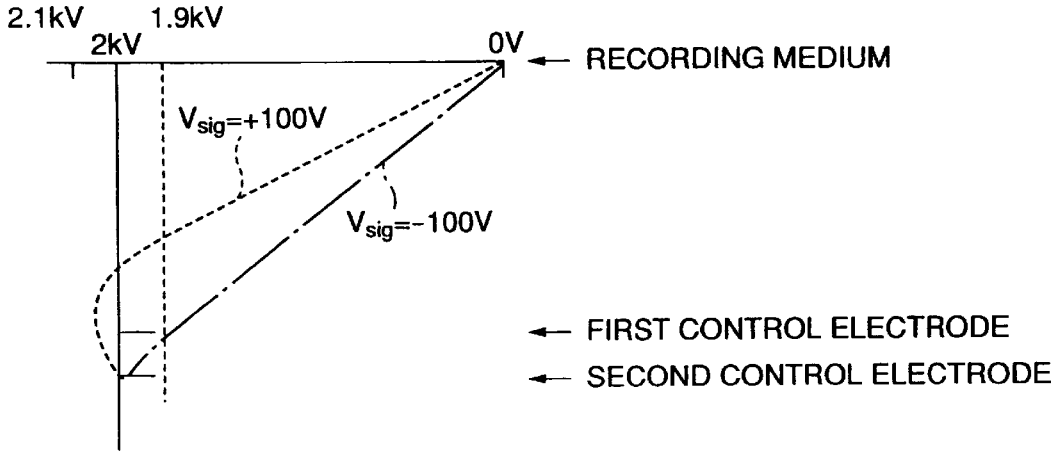
FIG. 11 is a graph showing the distribution of potential on a line passing through the central axis of a through hole in the seventh example.

FIG. 11 shows the distribution of potential on line A passing through the central axis of the through hole 14 when a signal voltage Vsig is applied.

In the case where Vsig=+100 V (OFF state), the electric field between the first control electrode 15 and the second control electrode 16 is opposite to the field between the metal platen 18 and the first control electrode 15, so that a negative charge is induced on the ink surface in the through hole 14. As a result, the ink surface 9*b* is repelled between the metal platen 18 and the first control electrode 15, so that the ink particle does not fly out.

On the other hand, in a case where Vsig=−100 V (ON state), at an initial stage that the charged coloring material 9B moves to the ink surface 9*b* in the through hole of the first control electrode 15, the ink surface 9*b* is attracted toward the recording medium 17 by the electric field caused by the bias voltage to be raised. The electrostatic focusing occurs at the tip of the raised ink surface 9*b* to form a cone as shown in FIG. 10, and the ink particle 8 is emitted out of the tip of the cone. The flied ink particle 8 is accelerated by the bias voltage applied between the metal platen 18 and the first and second control electrodes 15 and 16, to reach the recording medium 17 to form a recording picture dot 8a thereon.

At this time, since the concentration of the charged coloring material is increased to about 30%, a fine recording picture dot can be formed on the recording medium by the flight of a coloring material component of a high concentration forming the ink particle 8, so that it is possible to easily record at a high resolution.

Furthermore, the ink carrying passage 11 for carrying the ink 9 from the ink supply tank 4 to the lower portion of the control electrode substrate 12 is provided with the ink recovery tank 27 for recovering an ink 9C containing a coloring material of a low concentration, on the opposite side to the ink supply tank 4. The ink recovered in the ink recovery tank 27 is returned to the ink supply tank 4 to be used for recording again after the charged coloring material is added thereto.

Furthermore, in the seventh example, while the polarity of the charged coloring material 9B is positive, it may be negative by selecting the charge control material. In this case, all the polarities of the voltages applied to the respective control electrodes 15 and 16 should be reversed.

(Eighth Example)

Figure 12:
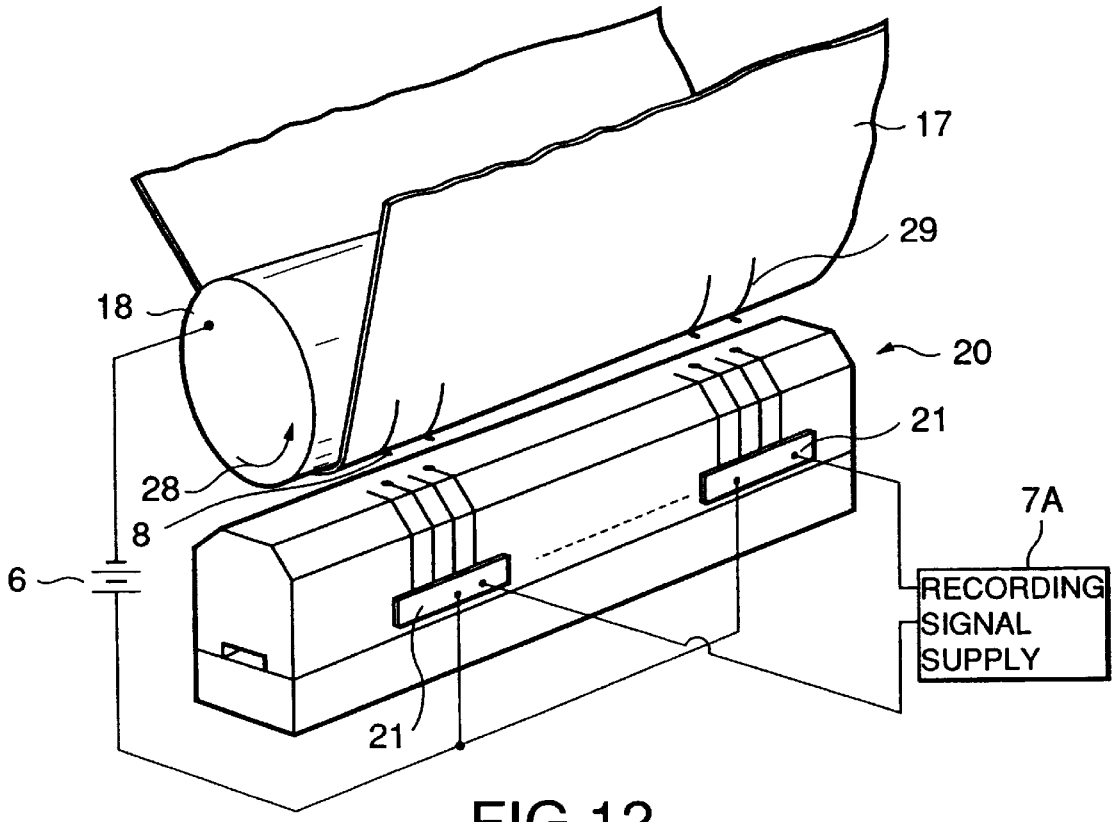
FIG. 12 is a schematic perspective view of the eighth example of an ink jet recording device according to the present invention.

Referring to FIGS. 10 and 12, the whole construction of the eighth Example of an ink jet recording device, according to the present invention, will be described below.

In the eighth example, since the entire configuration is the same as that of the seventh example shown in FIG. 10, there is omitted the duplicated description.

FIG. 12 shows the arrangement of the ink jet head 20, the recording medium 17 and the metal platen 18. The recording medium 17 arranged on the metal platen 18 relatively moving in a direction of arrow 28 moves in synchronism with a synchronizing signal inputted to the driving IC 21. In response to this synchronizing signal, a signal voltage is sequentially applied to the first control electrode 15 from a recording signal supply section 7A as the signal voltage source in the driving IC 21, so that the ink particle 8 flies out to form a picture 29 on the recording medium 17.

(Ninth Example)

Figure 13:
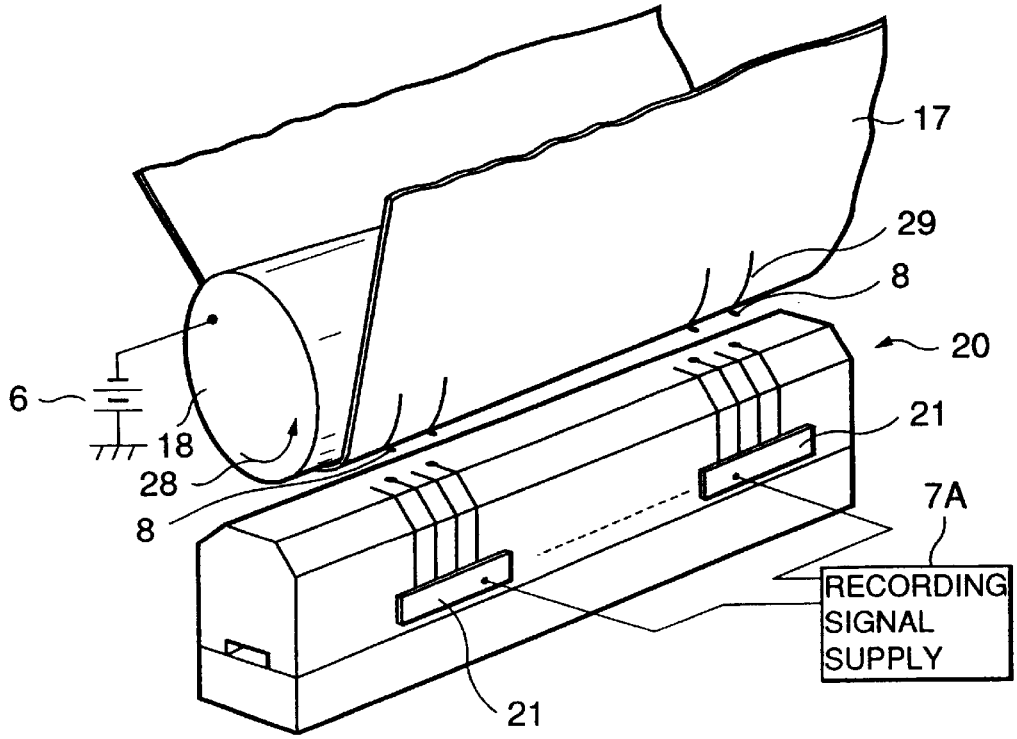
FIG. 13 is a schematic perspective view of the ninth example of an ink jet recording device according to the present invention.

In the ninth example of the first preferred embodiment, a bias voltage is only applied to a metal platen 18, and the bias voltage is not applied to first and second control electrodes 15 and 16. Thus, a high-voltage circuit is removed from a driving circuit system, and the maximum allowable voltage of a driving IC can be decreased, so that the price of the driving circuit system and the size of a head can be decreased. Referring to FIG. 13, the ninth example of the first preferred embodiment will be described below.

FIG. 13 shows an ink jet recording device according to the ninth example including the recording medium 17, metal platen 18 and an ink jet head 20. The ink jet head 20 is basically the same as that shown in FIG. 10 except for the driving circuit system. The ink jet head 20 is arranged so as to be apart from a recording medium 17 arranged on a metal platen 18 by about 500 $\mu$m. A bias voltage of −2 kV for accelerating an ink particle is applied to the metal platen 18 from a bias voltage source 6, and the second control electrode 16 of the ink jet head 20 is set to have the earth potential.

On the other hand, similar to the above-described examples, a signal voltage varying between +100 V and −100 V is applied to the first control electrode 15 from the recording signal supply section 7A as the signal voltage source 7 contained in the driving IC 21. When the signal voltage is +100 V, a negative charge is induced on the ink surface in the through hole 14 of the control substrate 12, so that no ink particle is flied. When the signal voltage applied to the first control electrode 15 is −100 V, a positive charge is induced on the ink surface in the through hole 14, so that the electrostatic attraction is caused by a bias voltage of −2 kV applied to the metal platen 18 by the bias voltage source 6. When the attraction is greater than the surface tension of the ink surface, an ink particle having a charge of a high concentration is formed to be flied.

(Tenth Example)

In the tenth example of the first preferred embodiment, a charge is applied to a recording medium 17 by a charger to obtain a surface potential corresponding to a bias voltage. Thus, it is possible to stably record a uniform picture without causing the fluctuation of potential due to contact failure between the recording medium 17 and a metal platen 18, and it is possible to ensure the user's safety when the recording medium 17 is mounted.

Figure 14:
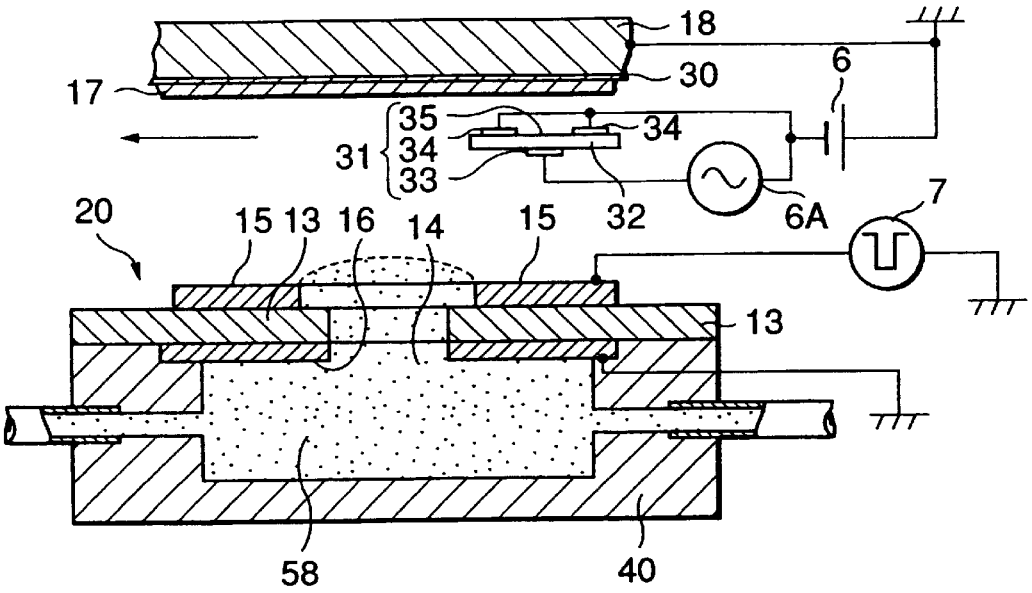
FIG. 14 is a schematic cross section of a principal part of the tenth example of an ink jet recording device according to the present invention.

FIG. 14 is a sectional view schematically illustrating the tenth example of the first embodiment of an ink jet recording device according to the present invention. The recording medium 17 is mounted on the metal platen 18 covered with an insulating layer 30 of tens $\mu$m. The surface of the recording medium 17 is charged by means of a solid state charger 31, to be a potential of about −2 kV, which is required to fly an ink particle. Furthermore, a charger (not shown) using a corona wire, which has been used for a copying machine, may be substituted for the solid state charger 31.

The solid state charger 31 comprises an induction electrode 33 provided on a ceramic substrate (not shown), an ion electrode 34 having a slit 35, and a glass insulating layer 32 having a thickness of about 30 $\mu$m provided between the electrodes 33 and 34. When an alternating voltage of 2 kVpp is applied from an alternating voltage source 6A between the induction electrode 33 and the ion electrode 34, positive and negative ions are produced from the slit 35 of the ion electrode 34, so that a surface potential equal to a bias voltage applied from a bias voltage source for charge can be applied to the recording medium 17.

By a signal voltage applied to the first control electrode 15 of an ink jet head 20 from a signal voltage source 7, positive charges are induced in a through hole 14, or positively charged coloring materials are collected. When the electrostatic force acting upon the charge in the through hole 14 by the electric field caused by the surface charge on the recording medium 17 is greater than the surface tension of the liquid ink, an ink particle is formed and flied onto the recording medium 17 to record.

Figure 15:
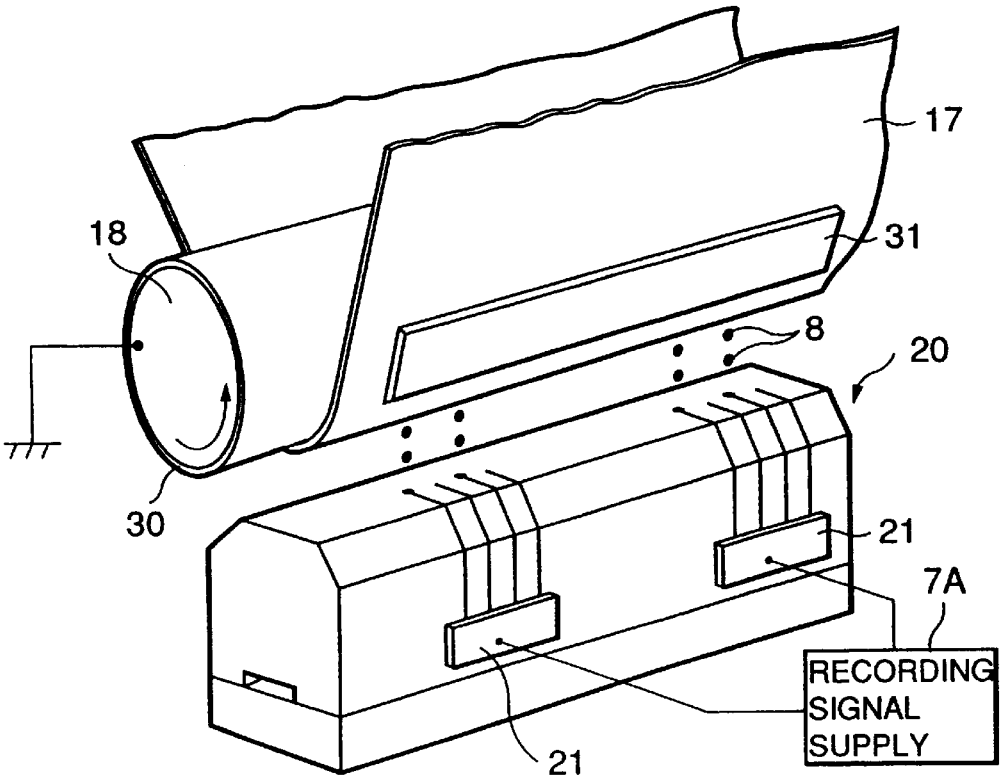
FIG. 15 is a schematic perspective view of the tenth example of an ink jet recording device according to the present invention.

Referring to FIG. 15, the construction of this device will be described. In FIG. 15, the metal platen 18 held at the earth potential is covered with a thin insulating layer 30, and the recording medium 17, such as a plain paper, is mounted thereon. After the recording medium 17 is charged so as to have a surface potential of −2 kV by means of the solid state charger 31, when a signal voltage is applied thereto by means of the driving IC 21 of the ink jet head 20, an ink particle 8 having a positive charge is formed from the ink surface of the through hole of the first control electrode 15. This ink particle 8 is emitted toward the recording medium 17 by a bias voltage caused by the surface potential of the recording medium 17, so that a picture is formed on the recording medium 17.

Thus, in this preferred embodiment, it is possible to uniformly cause the formation and flight of an ink particle by charging the recording medium 17 by means of the solid state charger 31 to apply a uniform bias voltage to the recording medium 17. In addition, only a low signal voltage may be applied to the control electrode 15, so that the driving IC 21 may be an IC having a low maximum allowable voltage, and it is possible to decrease the size of the driving circuit system to decrease the size of the ink jet head.

Moreover, since it is not required to apply a high bias voltage to the metal platen 18, there is an advantage in that it is possible to ensure the safety when the recording medium 17 is mounted by the user of the printer.

Furthermore, while the solid state charger 31 has been used as the charger in this example, another charger may be used. Alternatively, in place of the charger, a conductive charge roller or a conductive charge brush may be arranged so as to contact the recording medium 17, so that the recording medium can be charged by applying a bias voltage to the recording medium via the roller or brush.

(Eleventh Example)

Figure 16A:
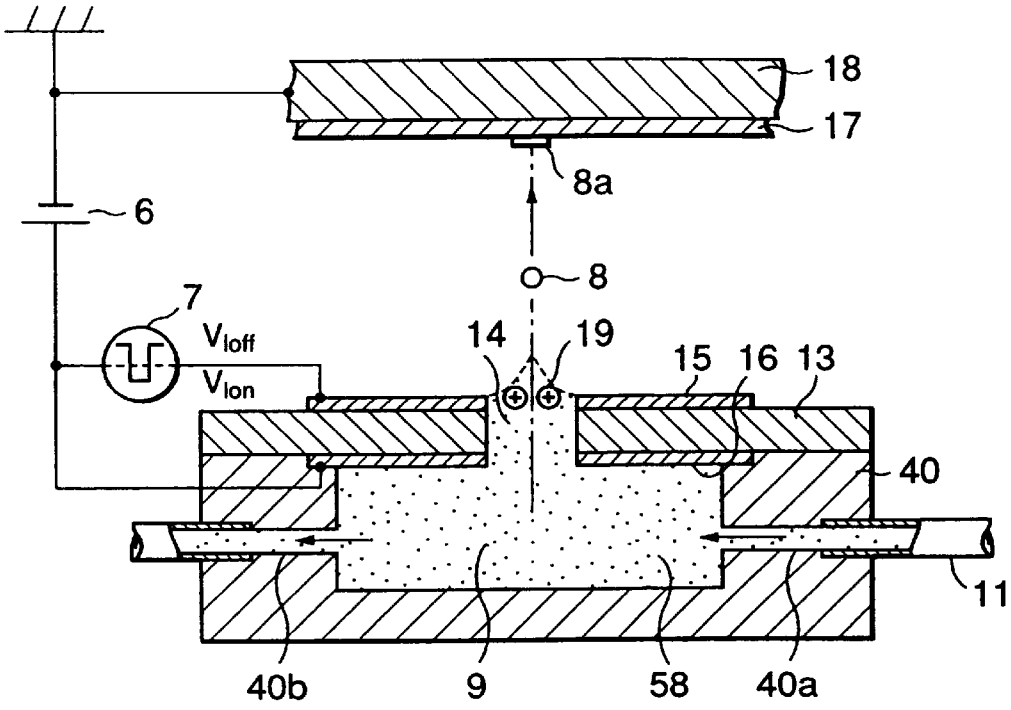
FIGS. 16A and 16B are schematic cross sections of a principal part of the eleventh example of an ink jet recording device according to the present invention.
Figure 16B:
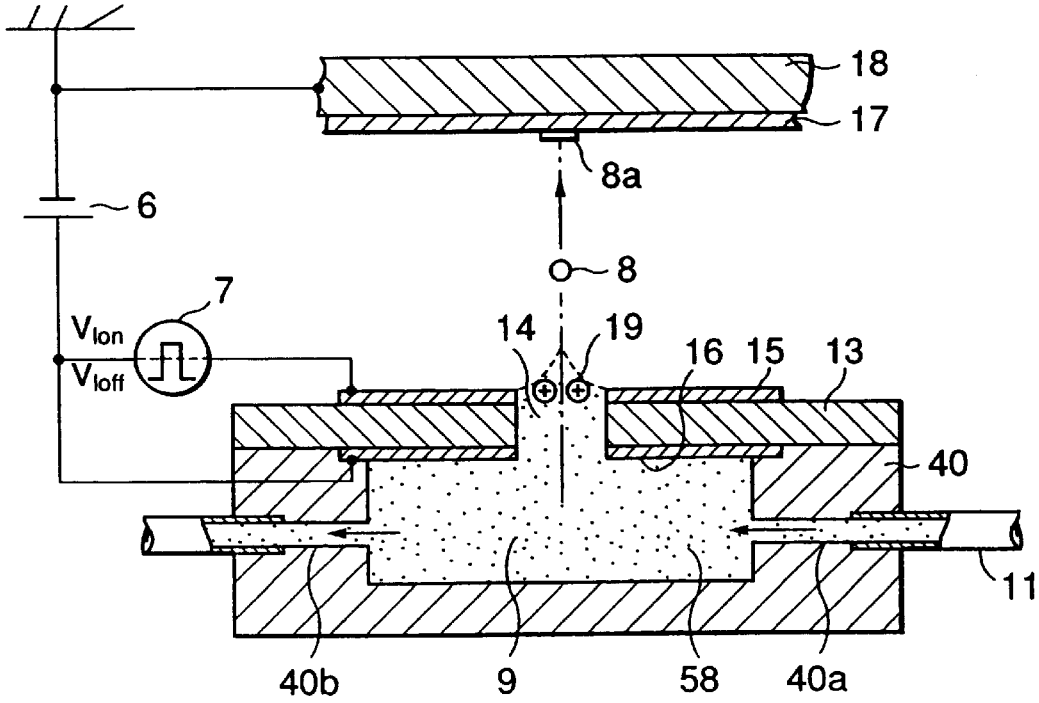
Figure 17:
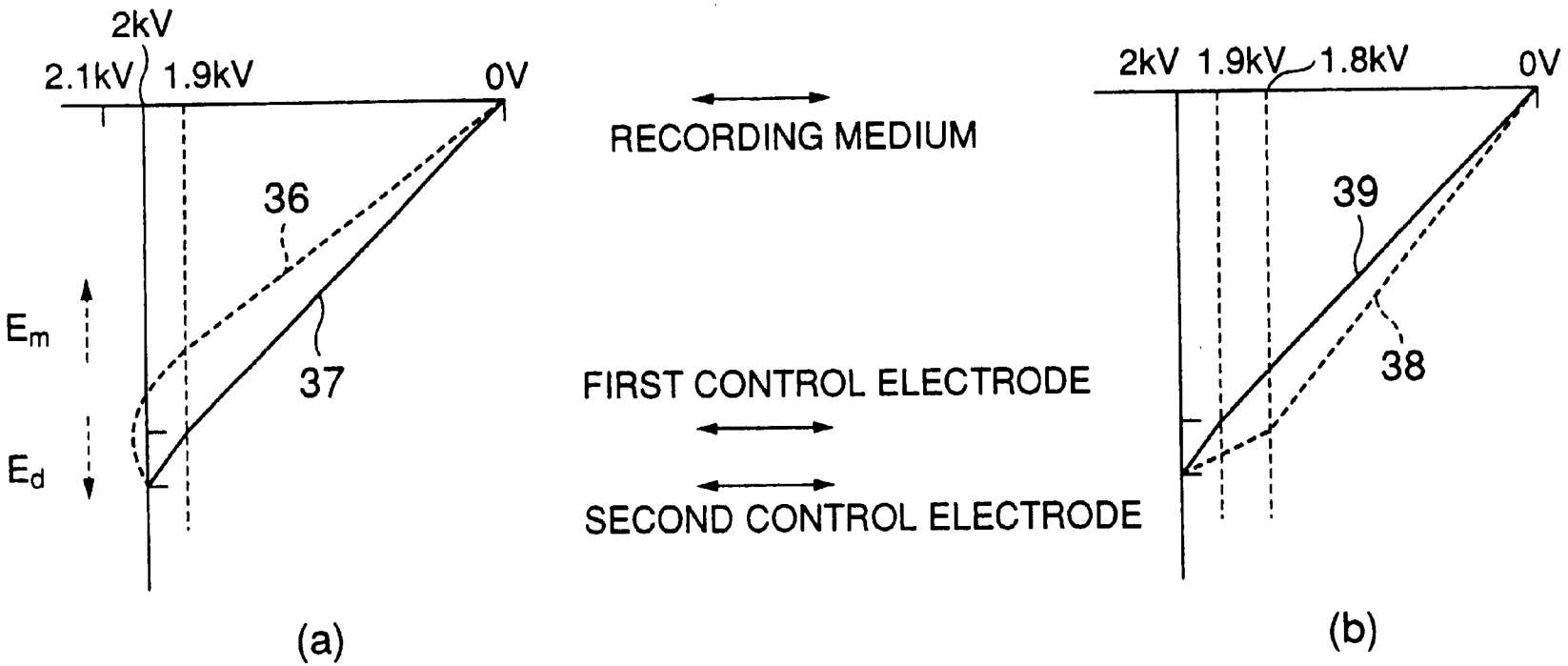
FIG. 17 (*a*) and (*b*) are graphs, each showing the distribution of potential on a line passing through the central axis of a through hole in the eleventh example.

Referring to FIGS. 16A, 16B and 17, methods for applying a signal voltage between first and second control electrodes 15 and 16 will be described below. The signal-voltage applying methods are classified into two types of methods: a method for controlling the movement of a charge or charged coloring material of an ink in a through hole 14, and a method for always ensuring a necessary charge on the surface of an ink to control the electric field to control the flight of the ink.

In the former method shown in FIG. 16A, the amount of charges induced on the ink surface in the through hole 14 of a control electrode substrate 12 or the amount of the collected charged coloring materials is controlled similar to the above eighth example.

In this case, assuming that a potential of the recording medium 17 is Vm, a signal voltage applied between the first and second control electrodes 15 and 16 for turning OFF of the flight of an ink particle is V1off, a signal voltage for turning ON of the flight of the ink particle is V1on, and a bias voltage applied to the second control electrode 16 is V2, there are the following relationships.

When the flight of the ion particle is OFF:

$$Vm<V2<V1off \quad (1)$$

When the flight of the ion particle is ON:

$$Vm<V1on<V2 \quad (2)$$

As shown in FIG. 17(*a*), on a potential distribution curve 36 when the voltage applied between the first and second control electrodes 15 and 16 is V1off, the direction of an electric field Ed between the first and second control electrodes 15 and 16 is opposite to the direction of an electric field Em between the recording medium 17 and the first control electrode 15, so that a negative charge is induced on the ink surface in the through hole 14, or the charged coloring material goes away from the ink surface. As a result, the electrostatic force acts upon the ink surface in the opposite direction to the recording medium 17, so that the formation and flight of the ink particle are not caused.

Then, when the voltage applied between the first and second control electrodes 15 and 16 is V1on, as shown in the potential distribution curve 37, the electric field Ed between the first and second control electrodes 15 and 16 is the same as the direction of an electric field Em, so that a positive charge 19 is induced on the ink surface of the through hole 14, or a positively charged coloring material is moved. When the electrostatic force caused by the electric field Em acting upon the amount of charge is greater than the ink surface tension, the ink particle is flied.

According to this method for controlling the induced charge of the ink surface (or the amount of the collected charged coloring materials), it is possible to control the induced charge in a narrow range of electric fields between the first and second control electrodes 15 and 16, so that it is possible to control the formation and flight of an ink particle by a low signal voltage.

On the other hand, in the latter method shown in FIG. 16B, the amount of charges necessary for the flight is always held on the ink surface of the through hole 14, and the electric field acting upon the ink surface is controlled by the signal voltage applied to the first control electrode, so that the formation and flight of an ion particle are controlled.

In this case, assuming that a potential of the recording medium 17 is Vm, a signal voltage applied between the first and second control electrodes 15 and 16 for turning OFF of the flight of an ink particle is V1off, a signal voltage for turning ON of the flight of the ink particle is V1on, and a bias voltage applied to the second control electrode 16 is V2, there are the following relationships.

When the flight of the ion particle is OFF:

$$Vm<Voff<V2 \quad (3)$$

When the flight of the ion particle is ON:

$$Vm<V2<Von \quad (4)$$

The electric field Ed produced by a bias voltage applied between the recording medium 17 and the first control electrode 15 is set so that the electrostatic force acting upon the induced charge of the ink surface in the through hole 14 or the collected charged coloring materials is less than the surface tension of the ink. When the signal voltage V1on is applied between the first and second control electrodes 15 and 16 to increase the electric field therebetween, the electrostatic force acting upon the induced charge of the ink surface or the collected charged coloring materials is greater than the surface tension of the ink, so that the ink particle is formed and flied.

FIG. 17(*b*) shows the potential distribution on the central axis of the through hole 14 when a signal voltage is applied between the first and second control electrodes 15 and 16. The signal voltage applied between the first and second control voltages 15 and 16 is in the range of from 0 V to +200 V. When the signal voltage V1off is 0 V, a positive charge 19, by which the electrostatic force toward the recording medium 17 is applied to the ink surface, is induced on the electric field in the through hole 14 as shown by the potential distribution curve 38, by the leakage electric field between the recording medium 17 and the first control electrode 15. However, since the electric field acting upon the ink surface is small, the formation and flight of the ink particle are not caused.

On the other hand, when a signal voltage V1on of +200 V is applied between the first and second control electrodes 15 and 16, the electric field between the recording medium 17 and the control electrode 15 is increased as shown by the potential distribution curve 39. As a result, this electric field acts upon the charge induced on the ink surface. Thus, in the case of a signal voltage wherein the electrostatic force is increased by the ink surface tension due to the electric field, an ink particle is formed and flied. In this case, since the electric field between the recording medium 17 and the first control electrode 15 is controlled by the signal voltage applied between the first and second control electrodes 15 and 16, it is required to apply a high signal voltage.

Furthermore, although the formulae (1) to (4) show the case that the bias voltage of the recording medium 17 is negative and the polarity of the charge induced on the ink surface is positive, all the signs of inequality are reversed in a case where the induced charge has the opposite polarity.

THE SECOND PREFERRED EMBODIMENT

There will be described an ink jet recording system according to a second preferred embodiment of the present invention.

(First Example)

An ink jet recording system according to this first example of the second embodiment is the best mode of the present invention of a type having an ink guide.

As shown in FIGS. 18A–18D and 19, the ink jet recording system comprises a control electrode substrate 12, head block 40, and an ink guide 50. The control electrode substrate 12 includes an insulating substrate 13 having a plurality of through holes 14, and a plurality of control electrodes 15. The insulating substrate 13 is fixed to the head block to form an ink chamber 58 containing a liquid ink 9.

The ink guide 50 is made of an insulating resin and comprise an elongated base portion 55 extending in the length of a row of separate electrodes, and projecting portions 56 projecting at the same pitch as that of the through holes 14. The upper end of each of the projecting portions 56 is formed with inclined surfaces 53 which are inclined downwards in longitudinal directions. An ink guide groove 54 extending from the tip portion of the center of the projecting portion 56 to the base portion thereof is formed for promoting the suction of the ink.

Figure 18A:
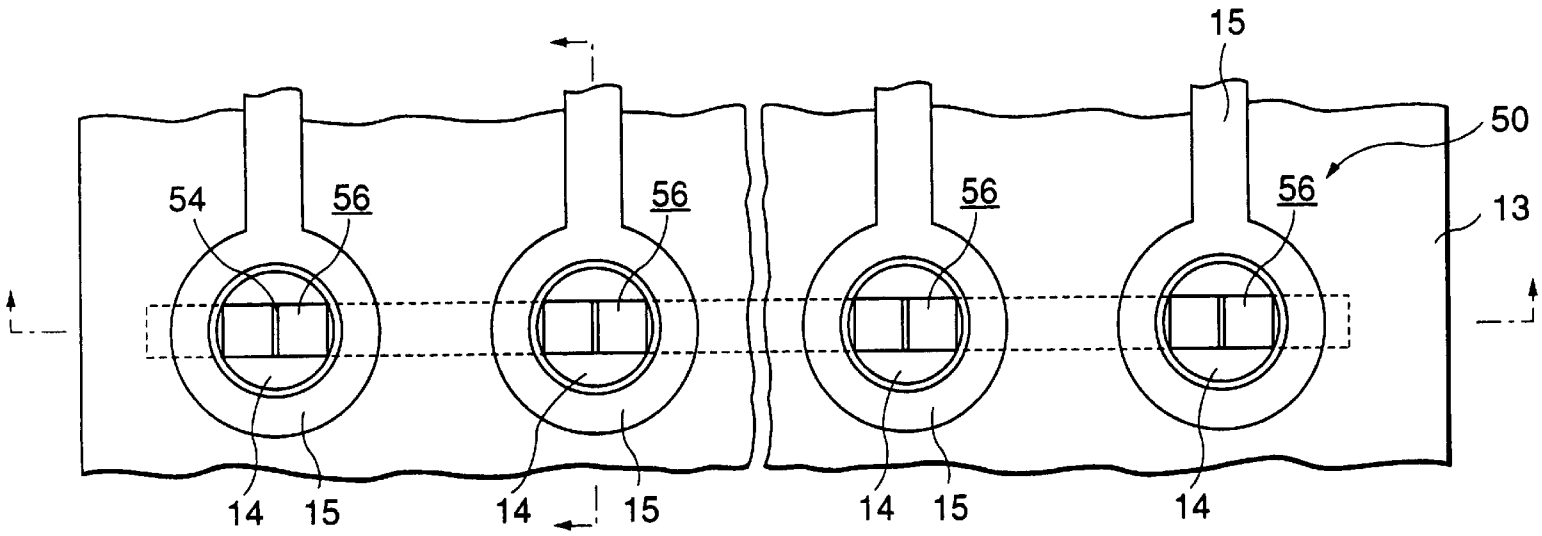
FIGS. 18A–18D are plan view, sectional views and perspective view showing an ink jet recording system according to the second embodiment as the best mode of the present invention.
Figure 18B:
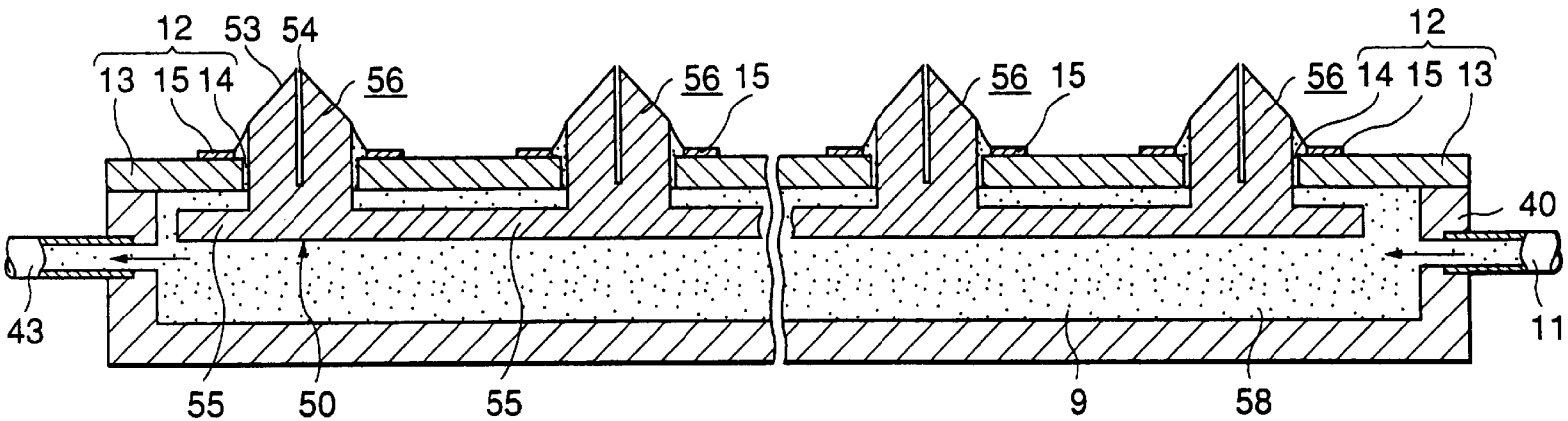
Figure 18C:
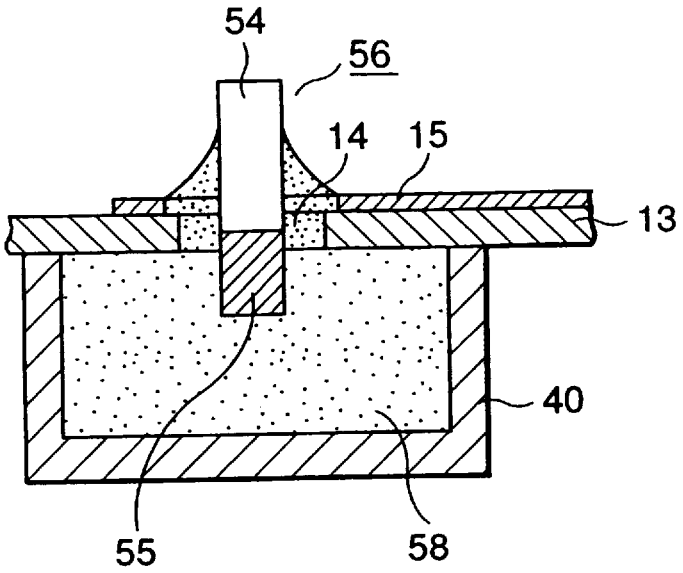

As shown in FIGS. 18B and 18C, the head block 40 is fixed to the lower surface of the insulating substrate 13, and an ink chamber 58 is formed by the trough body and the insulating substrate 13. An ink is supplied from an ink supply mechanism (not shown) to the ink chamber 58, and the ink always circulates by an ink circulating mechanism (not shown) during the recording and the standby of recording.

As described above, the ink guides 50 are made of an insulating resin and formed so that the projecting portions 56 are connected to each other by the base portion 55 at the same pitch as that of the through holes 14 formed in the control electrode substrate 12.

Figure 18D:
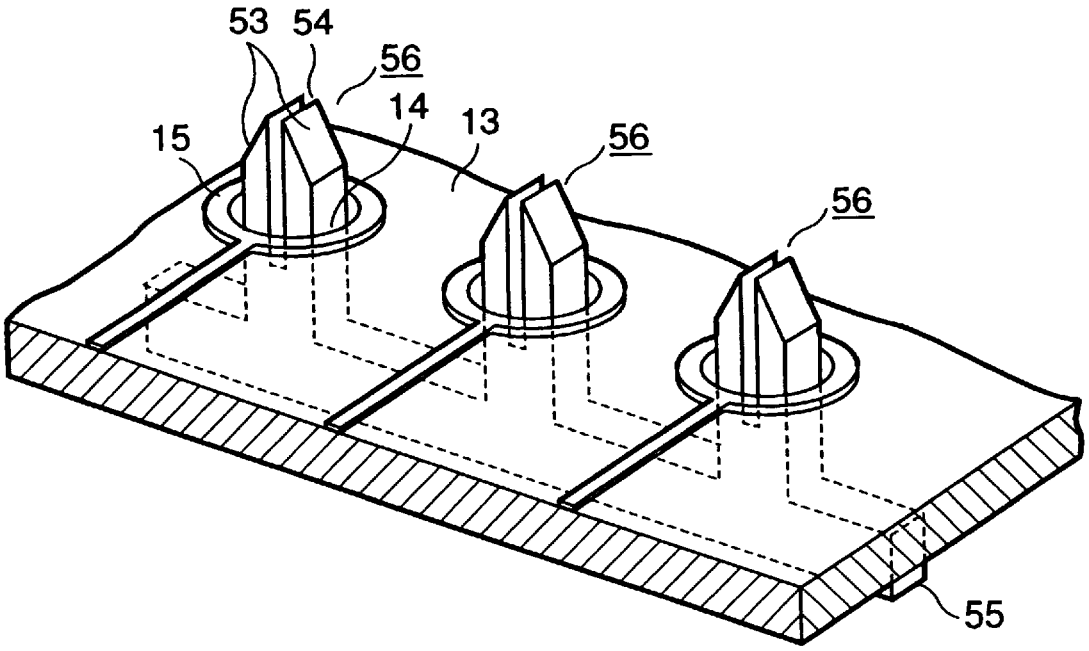
Figure 19:
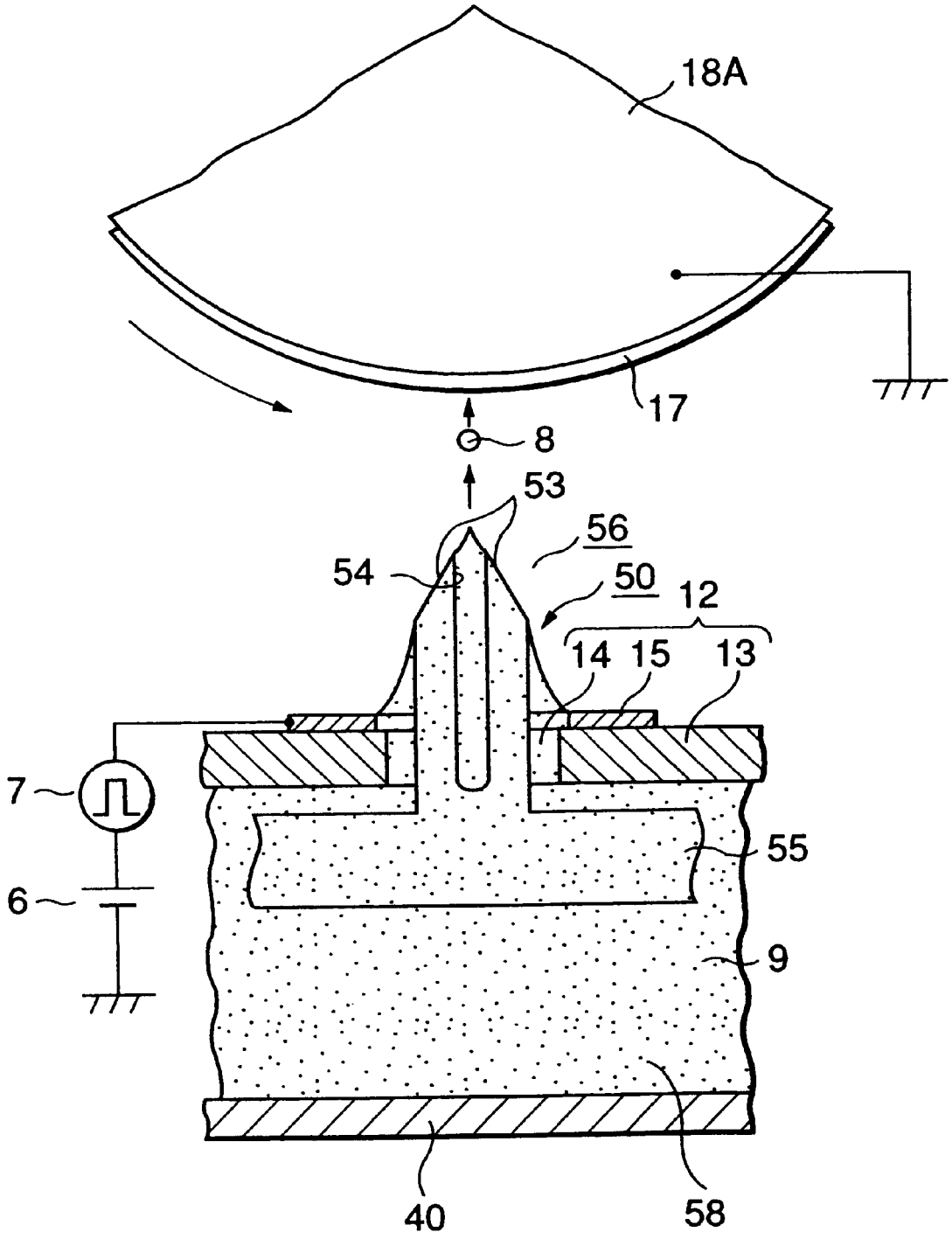
FIG. 19 is a sectional view showing the ink jet recording system according to the second embodiment.

In FIGS. 18D and 19, an ink 9 containing a coloring material component dispersed in a solvent is supplied to an ink chamber 58. On the ink chamber 58, an insulating substrate 13 is mounted. The insulating substrate 13 has the through hole 14. Around the through hole 14, a control electrode 15 for separately applying voltage is formed. To the control electrode 15, a recording signal voltage Va is supplied from a recording signal voltage source 7, and a bias voltage Vb is supplied from a bias voltage source 6.

In the head with this construction, when the recording voltage Va is superimposed on the bias voltage Vb and is applied to the control electrode 5, the ink rising to the tip of the projecting portion 56 by surface tension and capillary force emits out as an ink droplet 8 by the electric field between the control electrode 15 and the grounded counter electrode 18A as the platen, so that a picture dot is formed on a recording paper 17 contacting the counter electrode 18A.

Since the recording paper 17 is moved with respect to the ink guide 50 as shown by the arrow in FIG. 19, pictures are sequentially formed by selectively applying recording signals Va corresponding to picture signals. Since the ink emitting point is stabilized by providing the ink guide 50 with the projecting portion 56, it is possible to record a clear and stable picture. Moreover, since a plurality of separate electrodes can be formed on a flat plate, it is possible to easily provide a head of a high-resolution by arranging a plurality of rows of separate electrodes so that the separate electrodes of the respective rows are staggered.

(Second Example)

Referring to the drawings, this second example of the present invention will be described below.

Figure 20:
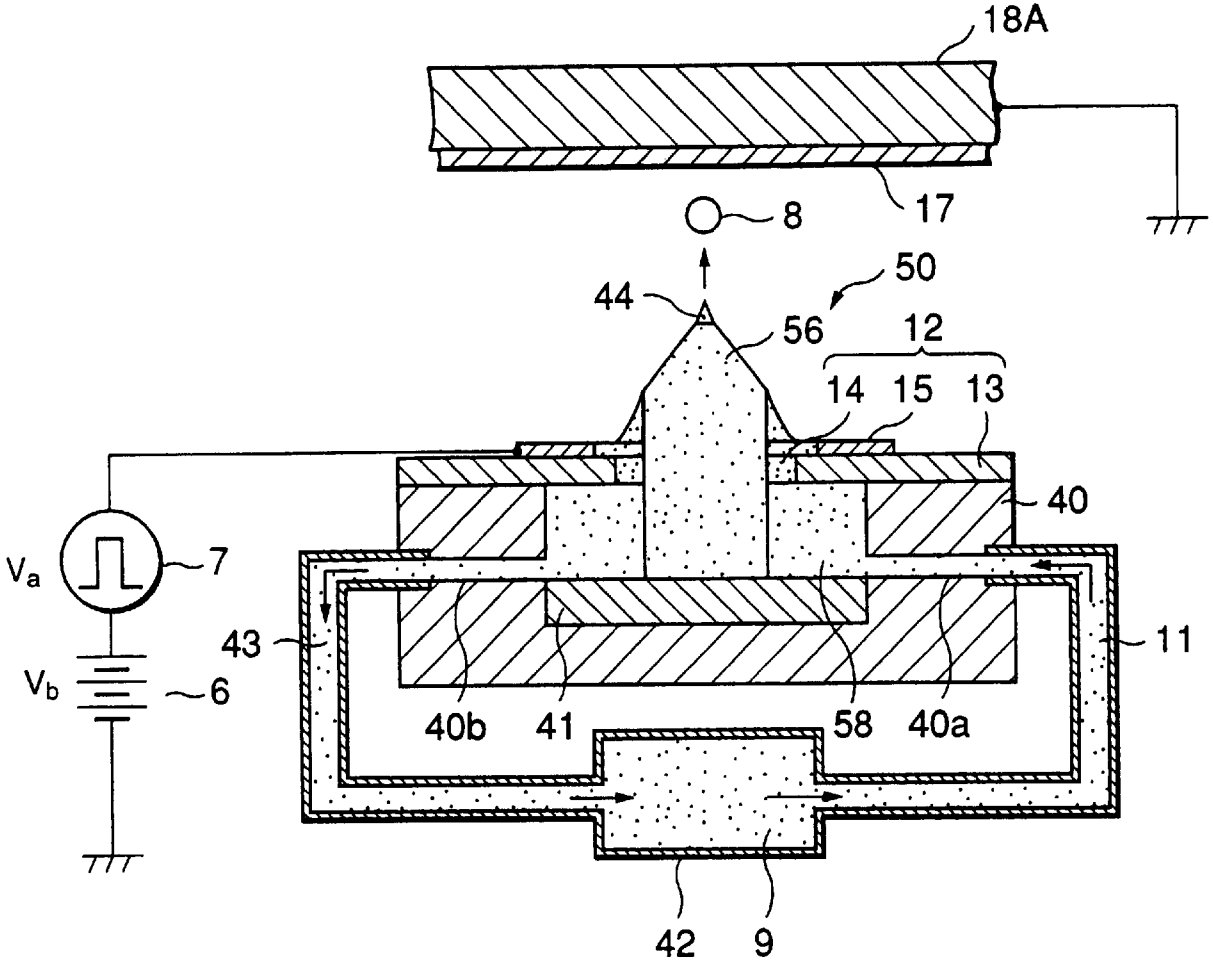
FIG. 20 is a schematic sectional view of an ink jet head portion and a principal part of the second example of the second embodiment of an ink jet recording system according to the present invention.

FIG. 20 shows the second example of the second preferred embodiment of an ink jet recording device, according to the present invention, which shows a cross section of separate electrodes corresponding to recording dots. In FIG. 20, an ink 9 consists of a positively charged coloring material component, a charge control agent, and a binder, which are dispersed and suspended in an insulating solvent having a resistibility of not less than 108 Ωcm. The ink 9 is supplied from a circulating mechanism (not shown) containing a pump and an ink passage toward a flat head substrate 41 and a control electrode substrate 12 via an ink supply passage 11 formed in a head block 40, and recovered by the ink circulating mechanism 42 via an ink recovery passage 43 in the head block 40.

The control electrode substrate 12 comprises an insulating substrate 13 having a through hole 14, and a control electrode 15 formed around the through hole 14 on the side of a recording medium. On the other hand, an ink guide 50 is arranged on the flat head substrate 41 substantially at the center of the through hole 14.

Figure 27:
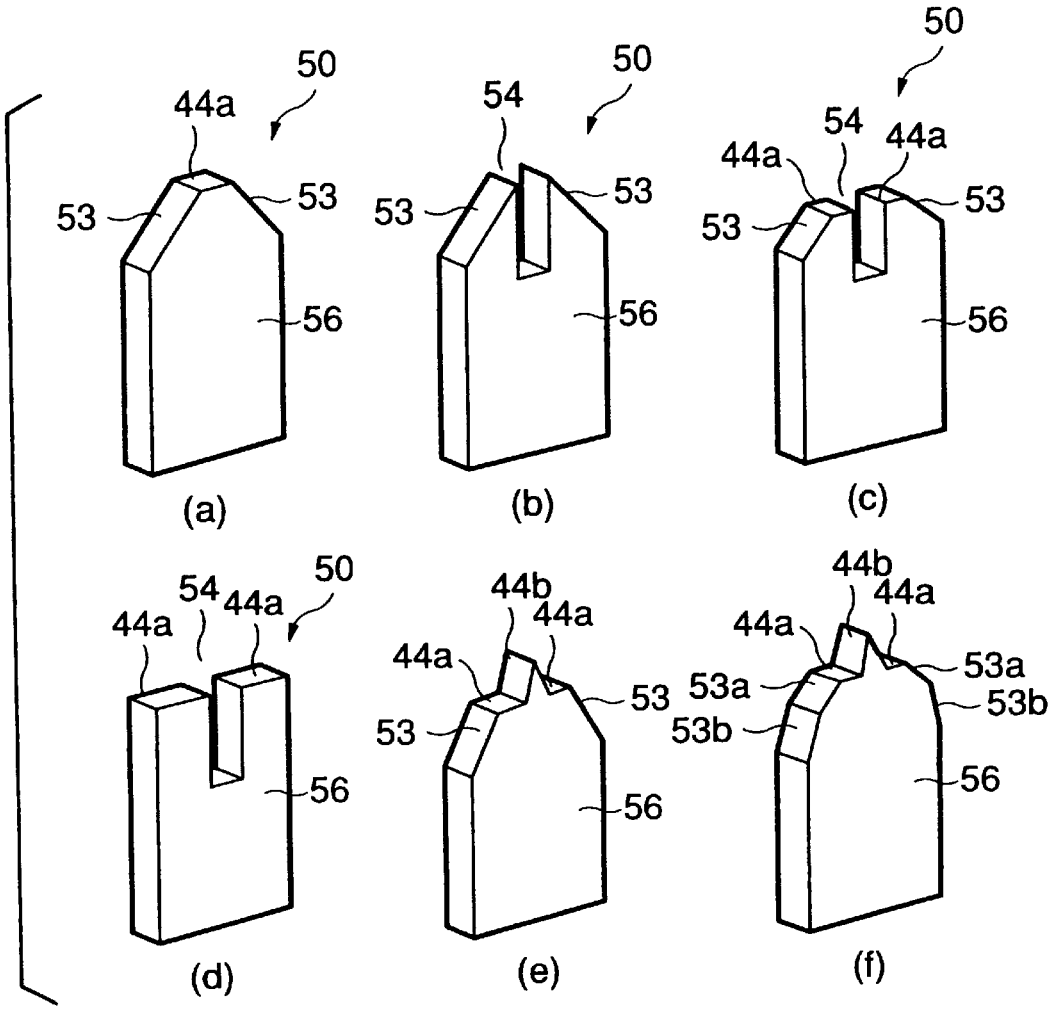
FIGS. 27 (*a*)–(*f*) are perspective views of various modifications of ink guides arranged on a flat head substrate in the second preferred embodiments, respectively.

FIG. 27(*a*) is a perspective view illustrating the shape of the ink guide 50 in this example. Each of the ink guides 50 is of an insulating member of a plastic resin or the like. The ink guides 50 are held on the flat head substrate 41 at regular intervals and at regular pitches in a predetermined manner. Each of the ink guide 50 has a triangular or trapezoidal tip portion having a constant thickness, and the tip portion serves as an ink-droplet emitting position 44. Moreover, each of the ink guides 50 projects from the corresponding through hole in an ink-droplet emitting direction, i.e., in a substantially vertical direction, by a predetermined height.

A recording paper serving as a recording medium 17 is arranged so as to face the tip of the ink guide 50. On the reverse surface of the recording medium 17 on the opposite side to the flat head substrate 41, a counter electrode 18A serving as a platen for guiding the recording medium 17 is arranged.

Figure 21:
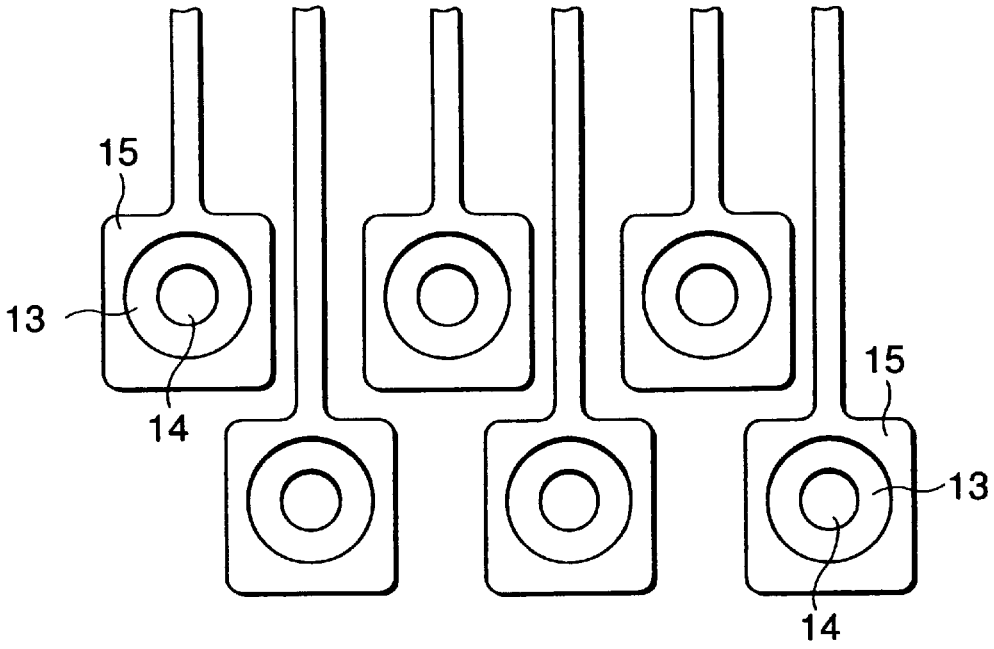
FIG. 21 is a plan view illustrating the shape of a control electrode in the second example of the second preferred embodiment.

Referring to FIG. 21, the construction of the control electrode substrate 12 will be described below.

FIG. 21 is a view of the control electrode substrate 12 viewed from the recording medium 17. As shown in FIG. 21, two rows of a plurality of separate electrodes are arranged so as to extend in main scanning directions. A through hole 14 is formed so as to pass through the center of each of the separate electrodes, and each of separate control electrodes 15 is formed around the corresponding through hole 14. Moreover, in this example, the inner diameter of the control electrode 15 is greater than the diameter of the through hole 14.

In this second example preferred embodiment, the insulating substrate 13 is made of a polyimide having a thickness of about 25 μm, and the control electrode 15 is made of a copper foil having a thickness of about 18 μm. The inner diameter of the through hole 14 is in the range of from about 150 to 25 μmφ.

With this construction, the recording operation, according to the present invention, will be described below.

When the recording is carried out, the ink 9 supplied from the ink circulating mechanism 42 via the ink supply passage 11 shown in FIG. 20 is supplied from the through hole 14 to the ink emitting position 44 at the tip of the ink guide 50, and a part thereof is recovered by the ink circulating mechanism 42 via the ink recovery passage 43.

A voltage of, e.g., DC 1.5 kV, is always applied to the control electrode 15 as a bias from the bias voltage source 6. A pulse voltage of, e.g., 500 V, serving as a signal voltage in response to a picture signal from the signal voltage source 7 is applied to the control electrode 15 so as to be superimposed on the bias voltage when it is turned on. On the other hand, the counter electrode 18A provided on the reverse surface of the recording medium 17 is set so that the ground potential thereof is 0 V as shown in the drawing.

Now, when the control electrode 15 is turned on to be an ON state (the state that 500 V is applied), i.e., when a voltage of 2 kV, which is the total of the pulse voltage of 500 V superimposed on the bias voltage of DC 1.5 kV, is applied, an ink droplet 8 containing a coloring material component emits out of the ink-droplet emitting position 44 at the tip of the ink guide. The ink droplet 8 is drawn by the counter electrode 18A to fly toward the recording medium 17 to form a picture thereon.

Since the ink 9 flows in the predetermined passage, the ink-droplet emitting position 44 is determined substantially at the center of the ink guide 50, so that the coloring material component does not move in the main scanning direction by the application of the voltage when the ink droplet 8 flies. In addition, in this example, the liquid ink is carried to the separate through hole 14 and the control electrode surrounding the through hole 14, and the ink 9 is supplied by the surface tension to the ink-droplet emitting position 44 via the surface of the ink guide 50 projecting substantially in a vertical direction from the through hole 14. Therefore, the thickness of the thin ink layer formed at the ink-droplet emitting position 44 can be stably maintained at a constant minute value under no influence of the pressure of the ink 9 supplied from the ink circulating mechanism 42, no influence of atmosphere, and no influence of the interference due to the flight of the ink droplet when being recorded at the adjacent dot. Therefore, it is possible to stabilize the flight of the ink droplet 8, and it is possible to record a good picture having a stable concentration on a recording medium 17.

Furthermore, while the coloring material component has had a positive charge in this preferred embodiment, it may be a negative charge. In that case, all the polarity of the voltages applied to the electrodes should be reversed.

While the inner diameter of the hole formed in the control electrode has been the same as that of the through hole, it may be greater than the diameter of the through hole 14.

While the control electrode 15 has been arranged on the insulating substrate 13 on the side of the recording medium, it may be arranged on the opposite side.

(Third Example)

The third example of the second preferred embodiment of an ink jet recording device, according to the present invention, will be described below.

Figure 23:
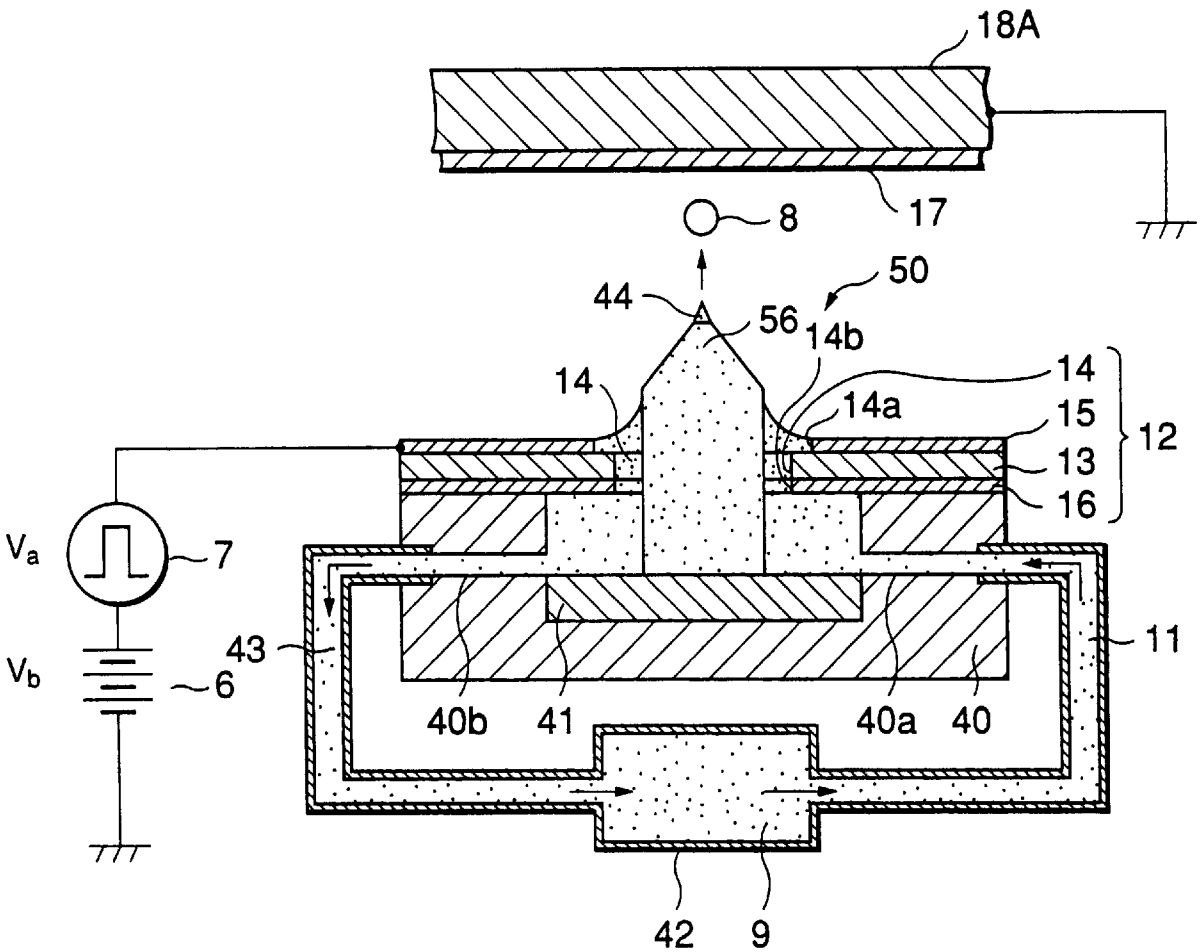
FIG. 23 is a sectional view of an ink jet head portion and a principal part of the third example of the second preferred embodiment of an ink jet recording device according to the present invention.

FIG. 23 shows a cross section of one of separate electrodes corresponding to recording dots similar to FIG. 20. In the third example of the second preferred embodiment, a control electrode substrate 12 is different from that in the second example. This difference will be mainly described. In FIG. 23, the control electrode substrate 12 comprises an insulating substrate 13 having a through hole 14, and a pair of control electrodes formed on both sides around the through hole 14, the pair of control electrodes comprising a first control electrode 15 on the side of the recording medium, and a second control electrode 16 on the ink carrying side.

Figure 22:
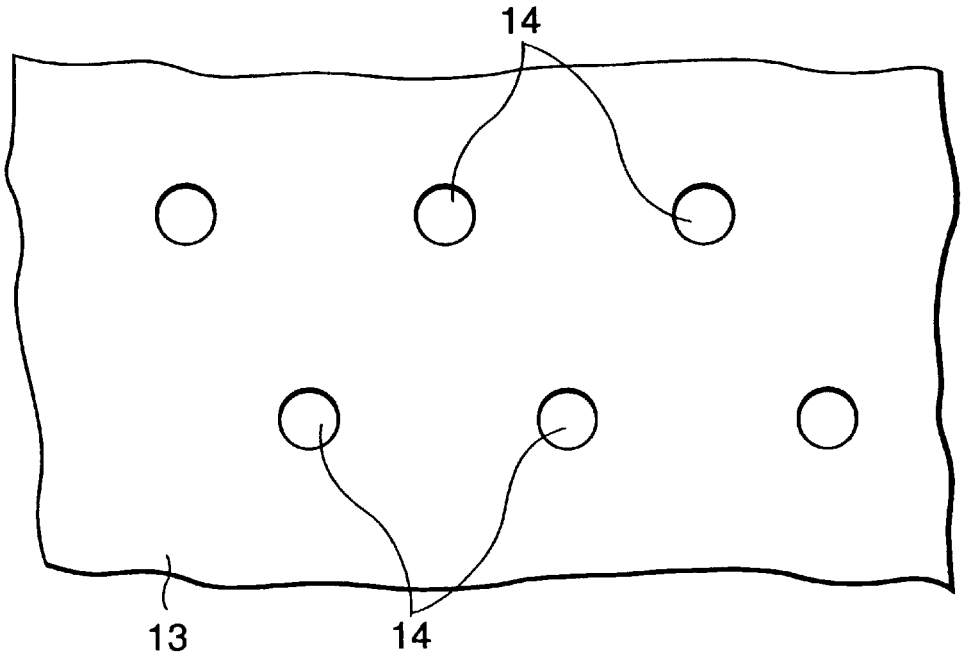
FIG. 22 is a plan view illustrating the shape of a first control electrode in the second example of the second embodiment.

FIG. 22 is a view of the control electrode substrate 12 viewed from the ink carrying side, i.e., from the side of the second control electrode 16. As shown in FIG. 22, two rows of a plurality of through holes 14 corresponding to separate electrodes are arranged so as to extend in main scanning directions. The first control electrode 15 is formed around the corresponding through hole 14 as a common electrode for the respective through holes 14. Since the construction of the second control electrode 16 is the same in the second example shown in FIG. 21, the description thereof is omitted.

A method for applying voltage to the first and second control electrodes in this example will be described below.

Similar to the second example of the second preferred embodiment, a voltage of, e.g., DC 1.5 kV, is always applied to the second control electrode 16 as a bias from the bias voltage source 6. A pulse voltage of, e.g., 500 V serving as a signal voltage corresponding to a picture signal from the signal voltage source 7 is applied to the second control electrode 16 so as to be superimposed on the bias voltage when it is turned on. On the other hand, the first control electrode 15 is always a high impedance state, and the counter electrode 18A provided on the reverse surface of the recording medium 17 is set to be a ground potential of 0 V as shown in FIG. 23.

Now, when the second control electrode 16 is in an ON state (in which 500 V is applied), i.e., when a voltage of 2 kV, which is the total of a bias voltage of DC 1.5 kV and a pulse voltage of 500 V superimposed thereon, is applied, an ink droplet 8 containing a coloring material component flies out of the ink-droplet emitting position 44 at the tip of the ink guide 50. The ink droplet 8 is drawn by the counter electrode 18A to fly toward the recording medium 17 to form a picture thereon. Furthermore, the first control electrode serves as a shield member for decreasing the influence between the voltages applied to the respective separate electrodes when the signal is recorded.

(Fourth Example)

The fourth example of an ink jet recording device according to the second embodiment of the present invention, will be described below.

Figure 24:
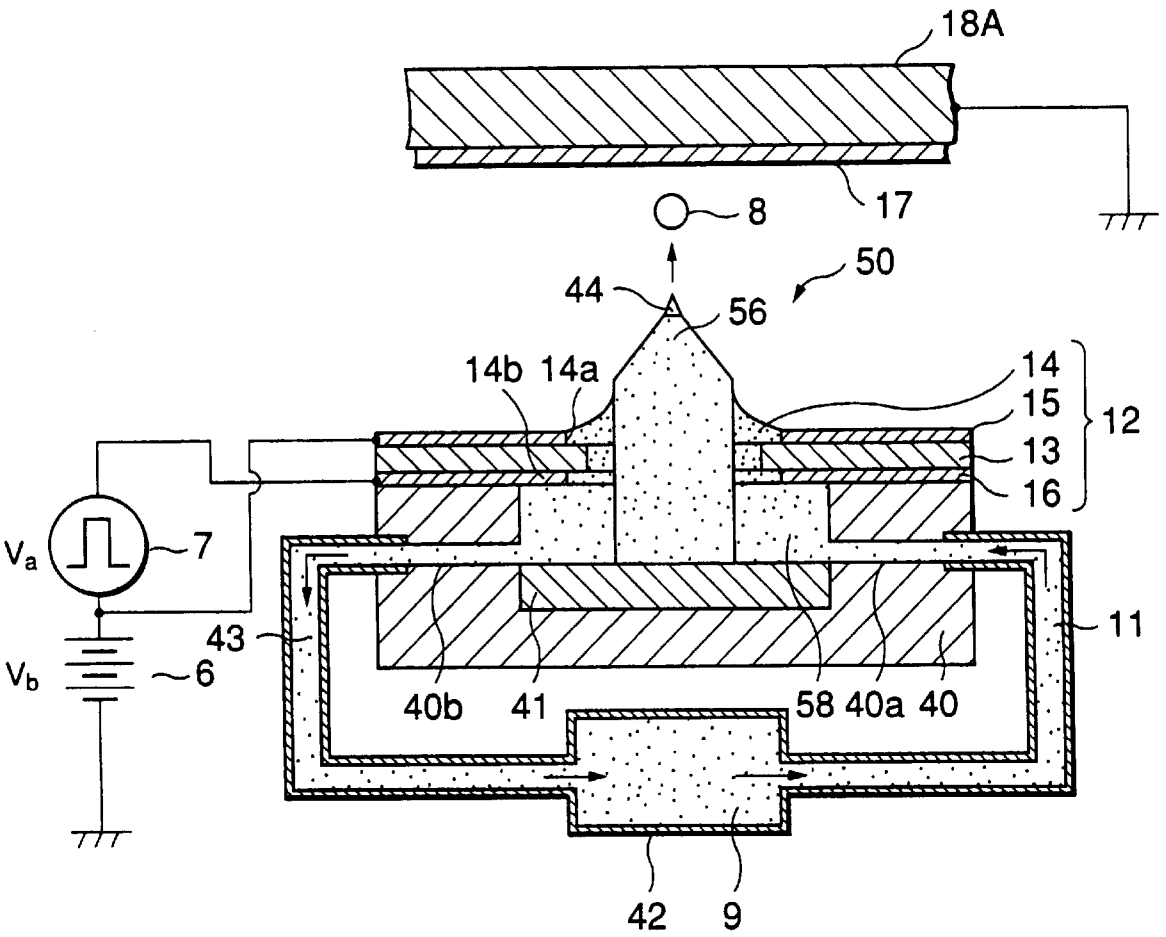
FIG. 24 is a sectional view of an ink jet head portion and a principal part of the fourth example of the second embodiment of an ink jet recording device according to the present invention.

FIG. 24 shows the fourth example of the second preferred embodiment of an ink jet recording device using a line scanning type ink jet head, according to the present invention, which shows a cross section of one of separate electrodes corresponding to recording dots, similar to FIG. 20. In this fourth example, a control electrode substrate 12 is different from that in the second example. This different point will be mainly described below.

As shown in FIG. 24, the control electrode substrate 12 comprises an insulating substrate 13 having a through hole 14, and a pair of control electrodes formed on both sides around the through hole 14, the pair of control electrodes comprising a first control electrode 15 on the side of a recording medium, and a second control electrode 16 on the ink carrying side.

Figure 25:
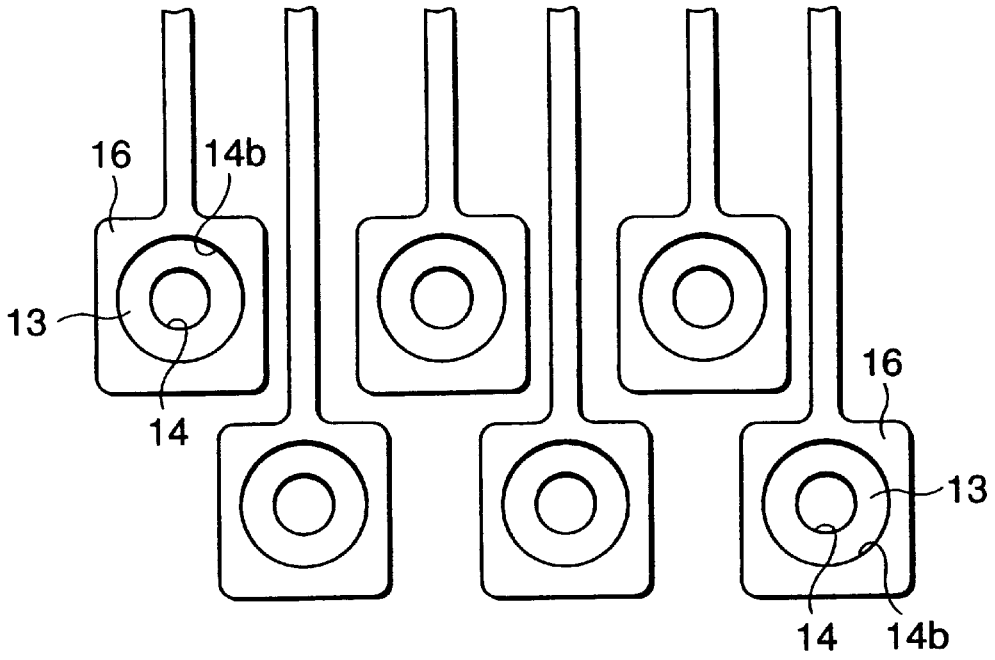
FIG. 25 is a plan view illustrating the shape of a second control electrode in the second embodiment.
Figure 26:
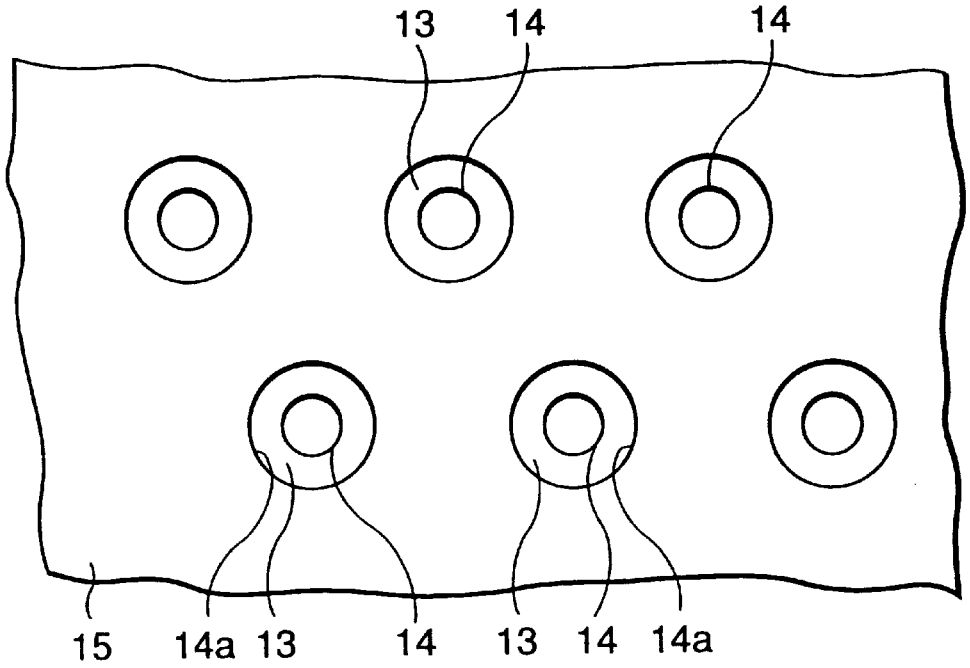
FIG. 26 is a plan view illustrating the shape of a first control electrode in the second embodiment.

Referring to FIGS. 25 and 26, the construction of the control electrode substrate 12 will be described. FIG. 25 is a view of the control electrode substrate 12 viewed from the second control electrode 16. As shown in FIG. 25, two rows of a plurality of separate electrodes are arranged so as to extend in main scanning directions. A through hole 14 is formed so as to pass through the center of each of the separate electrodes, and each of separate second control electrodes 16 is formed around the corresponding through hole 14. Moreover, in this example, the inner diameter of a through hole 14*b* of the second control electrode 16 is greater than the diameter of the through holes 14 of the insulating substrate 13.

FIG. 26 is a view of the control electrode substrate 12 viewed from the side of the first control electrode 15. As shown in FIG. 26, two rows of a plurality of through holes 14 corresponding to separate electrodes are arranged so as to extend in main scanning directions. The first control electrode 15 is formed around the corresponding through hole 14. Moreover, in this example, although the inner diameter of the first control electrode 15 is equal to the diameter of, the first control electrode 15 serves as a common electrode for the respective through holes 14.

Similar to the second example, the insulating substrate 13 is made of a polyimide having a thickness of about 25 $\mu$m, and each of the first and second control electrodes 15 and 16 is made of a copper foil having a thickness of about 18 $\mu$m. The inner diameter of the through hole 14 is in the range of from about 150 to 250 $\mu$m$\phi$.

A method for applying voltage to the first and second control electrodes in this example will be described below.

A voltage of, e.g., DC 1.5 kV, is always applied to the first and second control electrodes 15 and 16 as a bias from the bias voltage source 6. A pulse voltage of, e.g., 400 V serving as a signal voltage corresponding to a picture signal from the signal voltage source 7 is applied to the second control electrode 16 so as to be superimposed on the bias voltage when it is turned on. On the other hand, the counter electrode 18A provided on the reverse surface of the recording medium 17 is set to be a ground potential of 0 V as shown in FIG. 24.

Now, when the second control electrode 16 is in an ON state (in which 400 V is applied), i.e., when a voltage of 1.9 kV, which is the total of a bias voltage of DC 1.5 kV and a pulse voltage of 400 V superimposed thereon, is applied, an ink droplet 8 containing a coloring material component emits out of an ink-droplet emitting position 44 at the tip of the ink guide 50. The ink droplet 8 is drawn by the counter electrode 18A to emit toward the recording medium 17 to form a picture thereon.

The driving voltage of the control electrode substrate can be decreased by controlling the flight of ink droplets with the electric field between the pair of control electrodes sandwiching the thin insulating layer therebetween, so that it is possible to decrease the voltage and size of the driving IC.

Figure 28:
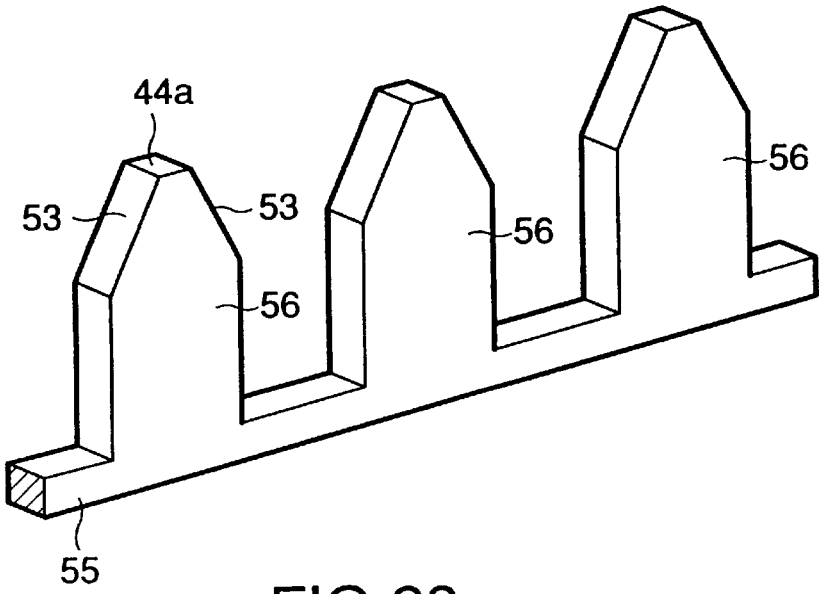
FIG. 28 is a perspective view an ink guide arranged on a flat head substrate in the second embodiments.

FIGS. 27(*a*) through 27(*f*) and FIG. 28 illustrate various modifications of the shape of the ink guide 50. As described above, the ink guide shown in FIG. 27(*a*) has a flat tip portion 44a as the ink-droplet emitting portion 44. The ink guide shown in FIG. 27(*b*) has an ink guide groove 54 near the ink-droplet emitting position so as to have a split shape such as a pen point or nib. The ink guide shown in FIG. 27(*c*) has slant surfaces 53, an ink guide groove 54 and flat portions 44*a* at the tip of the ink guide which is the same as that shown in FIG. 27(*a*).

The ink guide shown in FIG. 27(*d*) has an ink guide groove 54 and flat tip portions 44*a*. The ink guide shown in FIG. 27(*e*) has a two-stepped shape of tapered portions 53, flat portions 44*a* and a triangular tip portion 44*b*, so that it is possible to record characters and pictures having a good S/N ratio by controlling the supply of ink on the basis of a surface tension and the flight of ink on the basis of the application of a signal voltage. The ink guide shown in FIG. 27(*f*) has two-stepped tapered portions 53*a* and 53*b* to improve the advantage of FIG. 27(*e*).

In FIG. 28, a plurality of projecting portions 56 are connected to each other by means of connecting portions forming the base portion 55 to produce ink guides in large quantities and to effectively assemble the ink guides.

(Fifth Example)

An ink jet recording device of the fifth example according to the second preferred embodiment of the present invention, will be described below.

Figure 29:
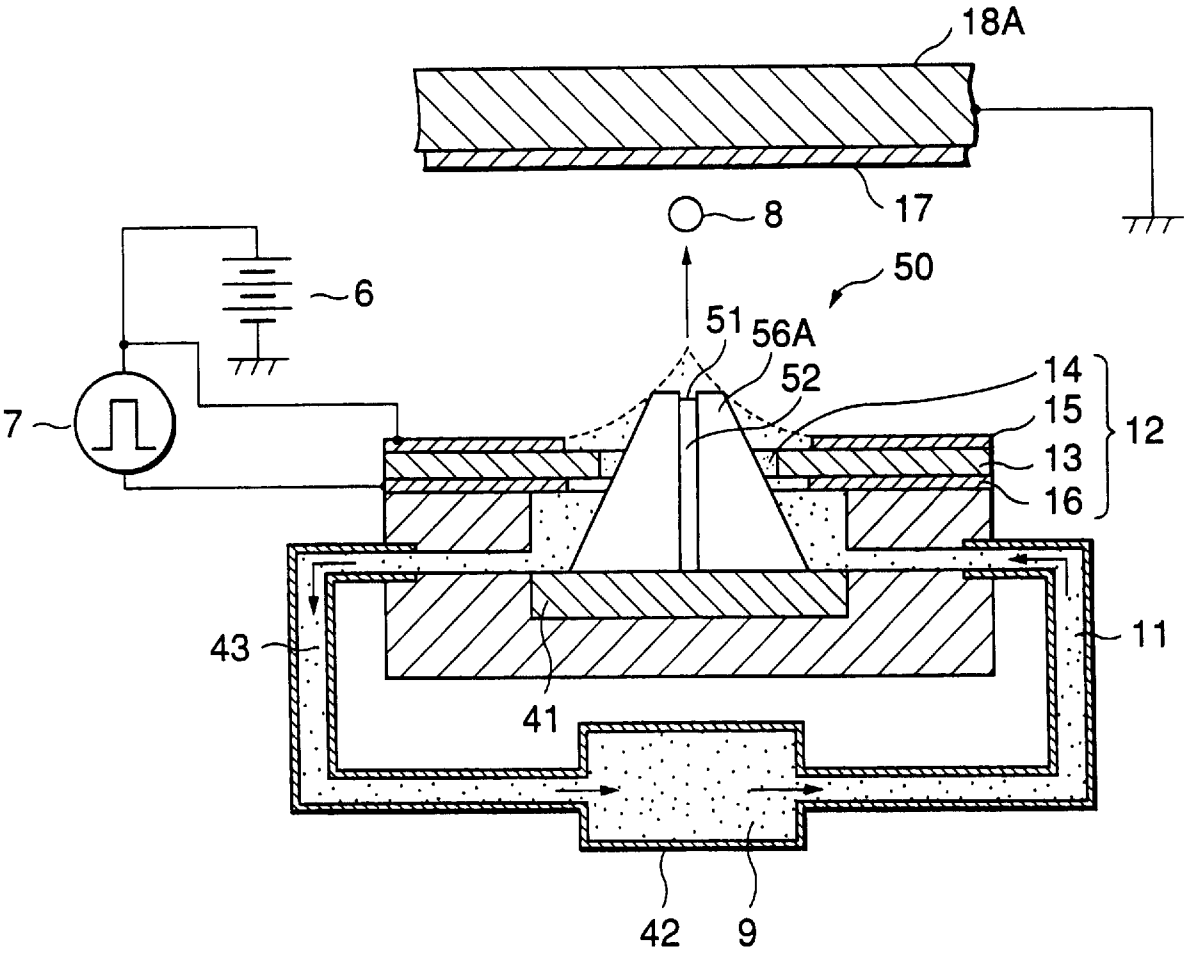
FIG. 29 is a sectional view of an ink jet head portion and a principal part of the second preferred embodiment of an ink jet recording device according to the present invention.

FIG. 29 shows the fifth example of an ink jet recording device using a line scanning type ink jet head, according to the present invention, and which shows a cross section of one of heads corresponding to recording dots.

The construction of the fifth example is the same as that shown in FIG. 24, except that a projecting portion 56 of an ink guide 50 is substituted for the ink guide 50 shown in FIGS. 20, 23 and 24. Since the constructions other than the projecting portions 56A may be the same as those shown in FIGS. 20, and 24, the illustrations and descriptions thereof are omitted.

Figure 30:
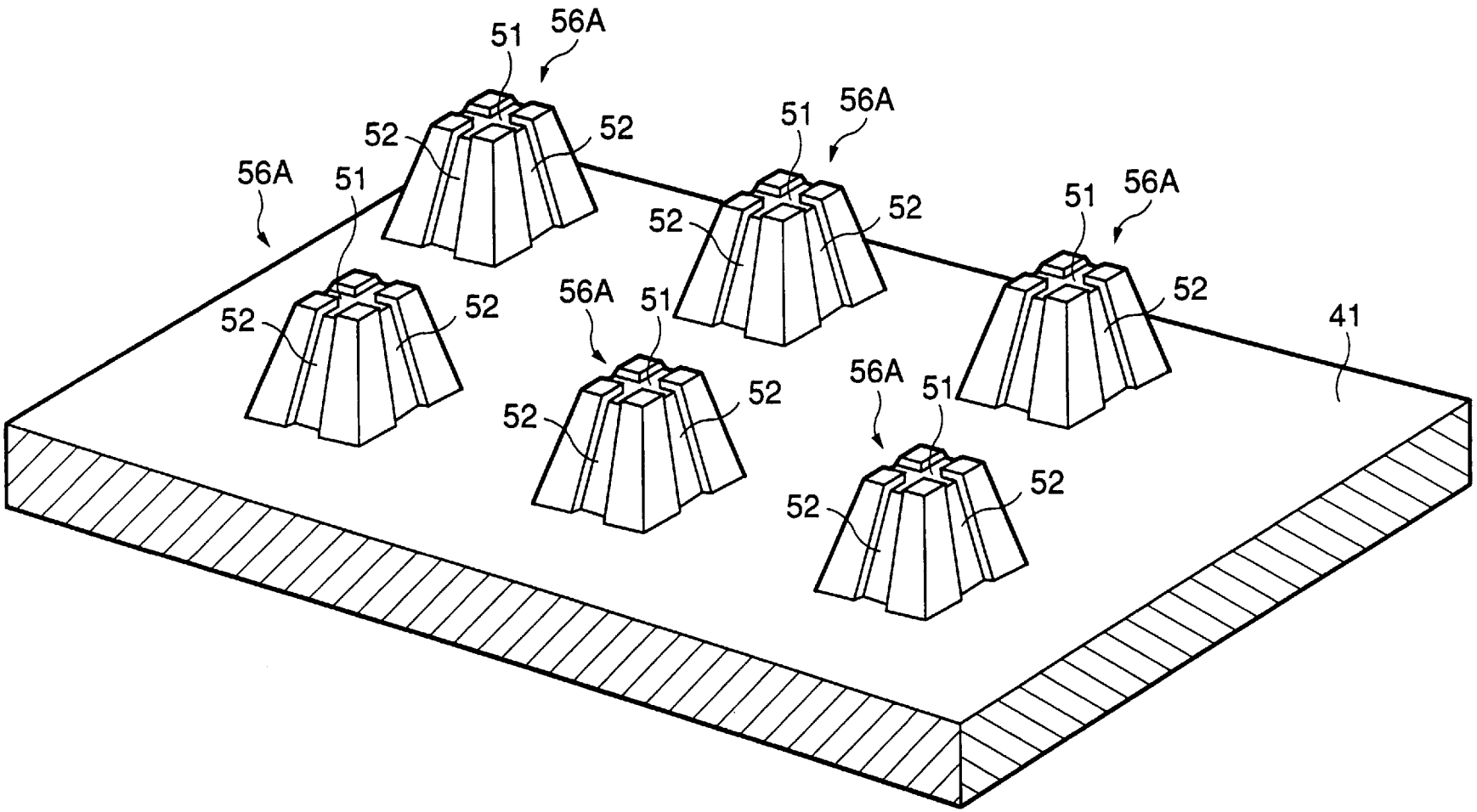
FIG. 30 is a perspective view illustrating projecting ink guides formed on a flat head substrate in the second preferred embodiment.

FIG. 30 illustrates the shapes of the projecting portions 56A arranged on a flat head substrate 41. The respective projecting portions 56A are arranged so as to be coaxial with the respective through holes 14 at the same intervals and pitches as those of the through holes 14. Each of the projecting portions 56A has a substantially truncated pyramid shape. Each of the edge or side surfaces of the projecting portion 56A has a top 51, and a recessed groove 52, The top 51 of the projecting portion 56A serves as an ink-droplet emitting position 44. The top 51 of the projecting portions 56A also has a recessed portion.

Figure 31:
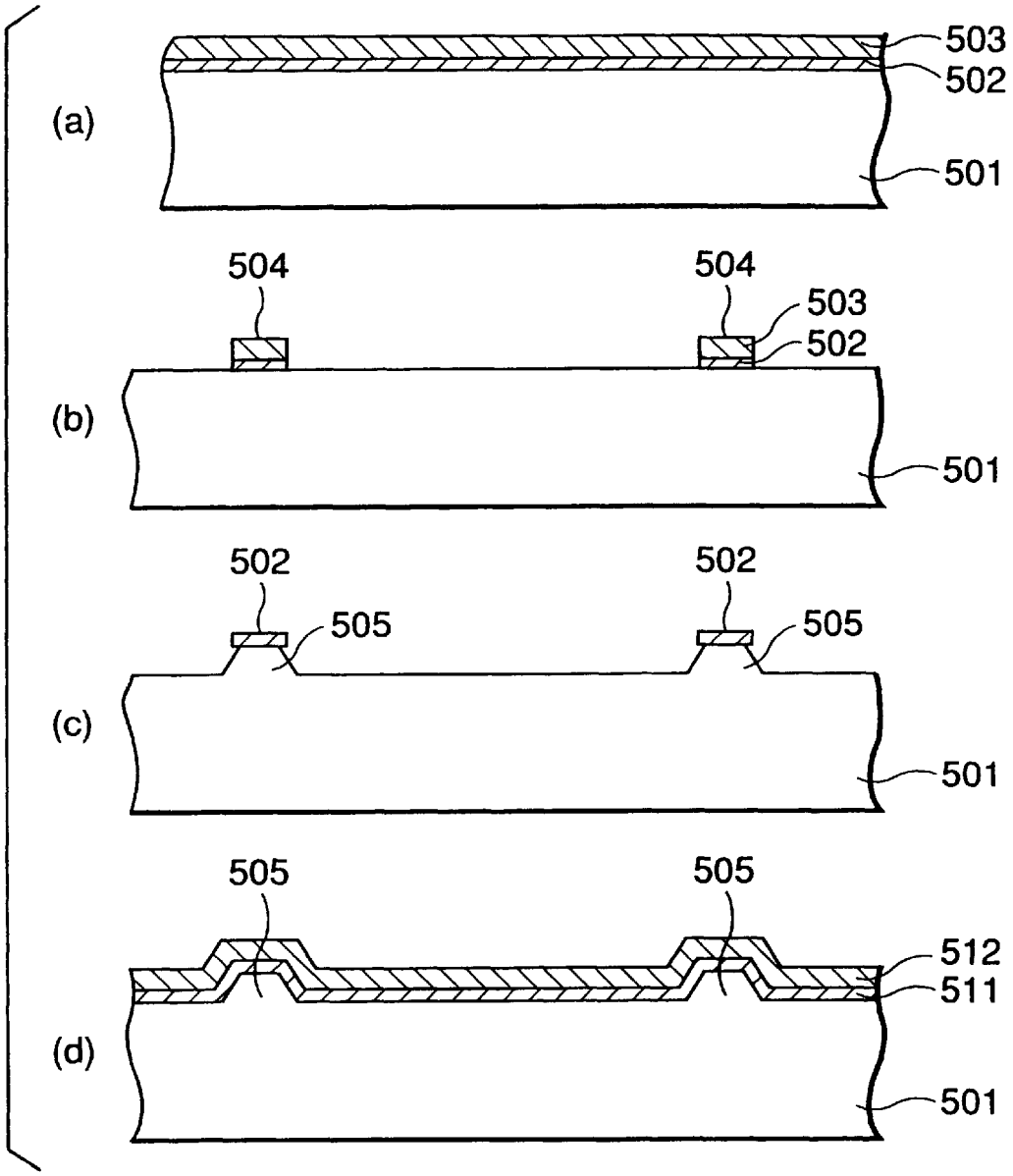
FIGS. 31(*a*) through 31(*d*) are schematic views explaining a process for forming an ink guide in the third preferred embodiment.
Figure 32:
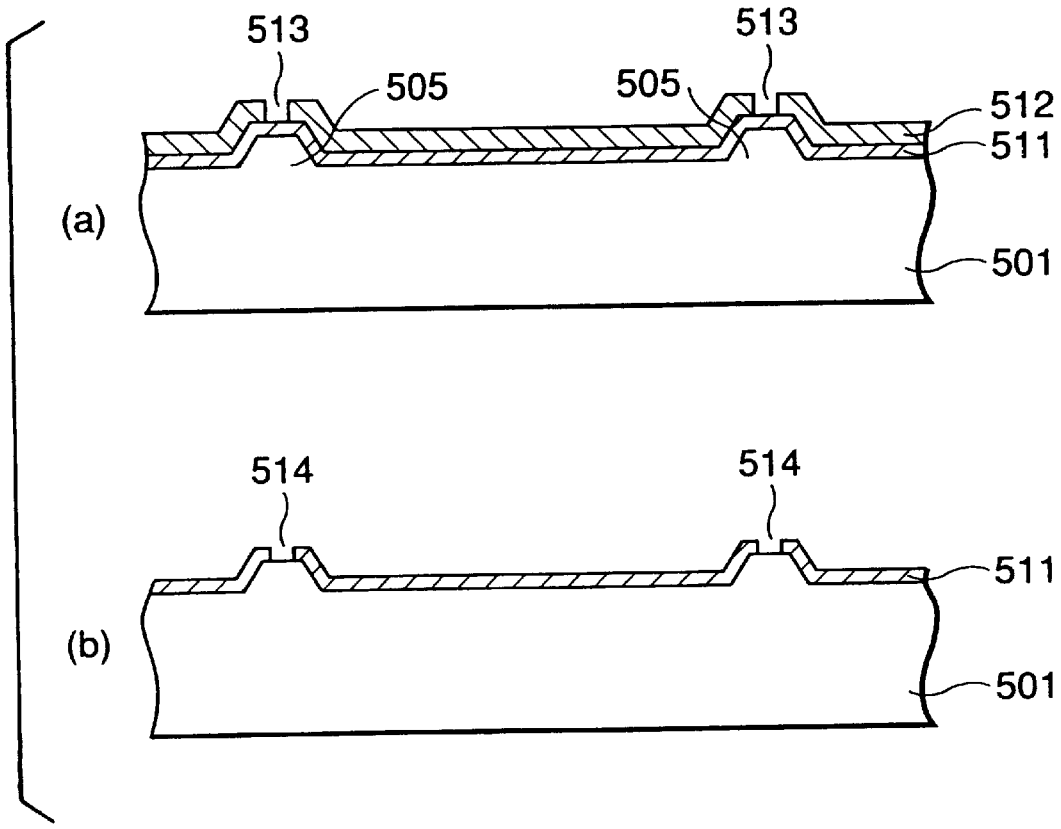
FIGS. 32(*a*) and 32(*b*) are schematic views explaining a process for forming an ink guide in the third preferred embodiment.

FIGS. 31 and 32 show an example of a process for the projecting portions 56A on the flat head substrate 41 shown in FIG. 30. In this fifth example, the anisotropic etching of a silicon (Si) monocrystal substrate is used.

First, as shown in FIG. 31(*a*), an $SiO_2$ thermal oxidation layer 502 having a thickness of 0.1 $\mu$m is formed on a p-type Si monocrystal substrate 501 having a crystal orientation [100] by the dry oxidation method, and a first resist layer 503 is applied thereon by the spin coat method. Then, the patterning, such as exposure and development, is carried out using, e.g., a stepper so as to obtain mask openings 504 of a square of, e.g., 50 $\mu$m. Thereafter, the etching of the $SiO_2$ film is carried out using a $NH_4F$—HF mixed solution as shown in FIG. 31(*b*). After removing the resist, the anisotropic etching is carried out using a 30 wt % KOH aqueous solution, so that truncated pyramid-shaped projections 505 having a flat tip portion and having a height of 70 to 80 $\mu$m are formed on the Si monocrystal substrate 501 as shown in FIG. 31(*c*). The mask opening 504 is greater than a desired truncated pyramid-shaped projection 505 in view of an under etching.

Then, the recessed grooves 51 of the tip portions and the side surfaces of the truncated pyramid-shaped projections 505 are formed. First, after the $SiO_2$ oxidation layer 502 remaining at the tip portion of the truncated pyramid-shaped projection 505 is removed once, a groove forming layer 511 of, e.g., molybdenum, tantalum, copper or chromium, having a thickness of 5 $\mu$m by the sputtering, and then, a second resist layer 512 is formed by the spin coat method, as shown in FIG. 31(*d*).

Subsequently, as shown in FIG. 32(*a*), the recessed groove patterns 513 are formed on the tip portion and the side surfaces of the truncated pyramid-shaped projections 505. Then, the grove forming layer 511 is etched, and the second resist layer 512 is removed, so that the recessed grooves 514 are formed at predetermined positions as shown in FIG. 32(*b*). Thus, the truncated pyramid-shaped portion 56A, each of which has the tip portion and four side surfaces, each having the recessed groove 52, are formed.

In addition, while the flat head substrate having the projecting ink guides has been formed by the photolithography used for the manufacturing of ICs in the fifth example shown in FIG. 29, it may be duplicated using a mold formed by the photolithography similar to the manufacturing of optical disks. Moreover, electrode patterns may be patterned on the projecting ink guides to be combined with the control electrodes to form separate electrodes. That is, the control electrode substrate and the flat head substrate having the projecting ink guides can be manufactured by the photolithography used for the manufacturing of ICs, so that it is possible to provide accurate heads having a high reliability.

THIRD PREFERRED EMBODIMENT (First Example)

Referring to FIGS. 33A through 37, the first example of the third preferred embodiment of an ink jet recording device, according to the present invention, will be described below.

Figure 33A:
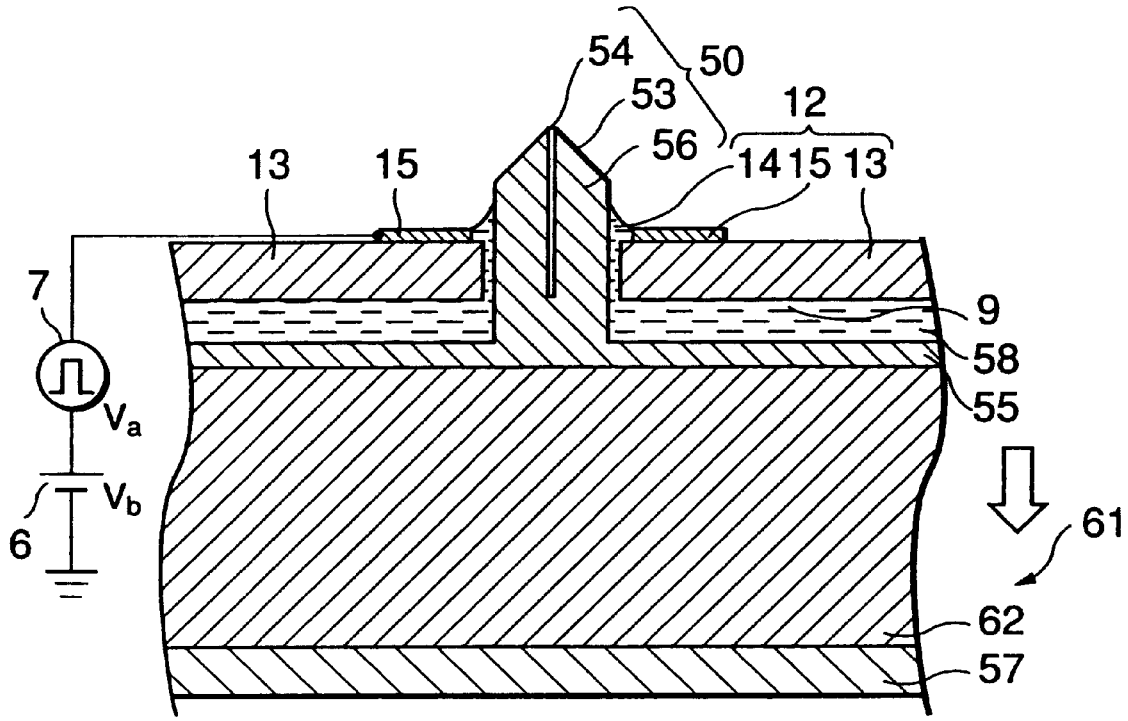
FIGS. 33A and 33B are cross-sectional views of a movable ink guide serving as a principal part of the third preferred embodiment of an ink jet recording device according to the present invention.
Figure 33B:
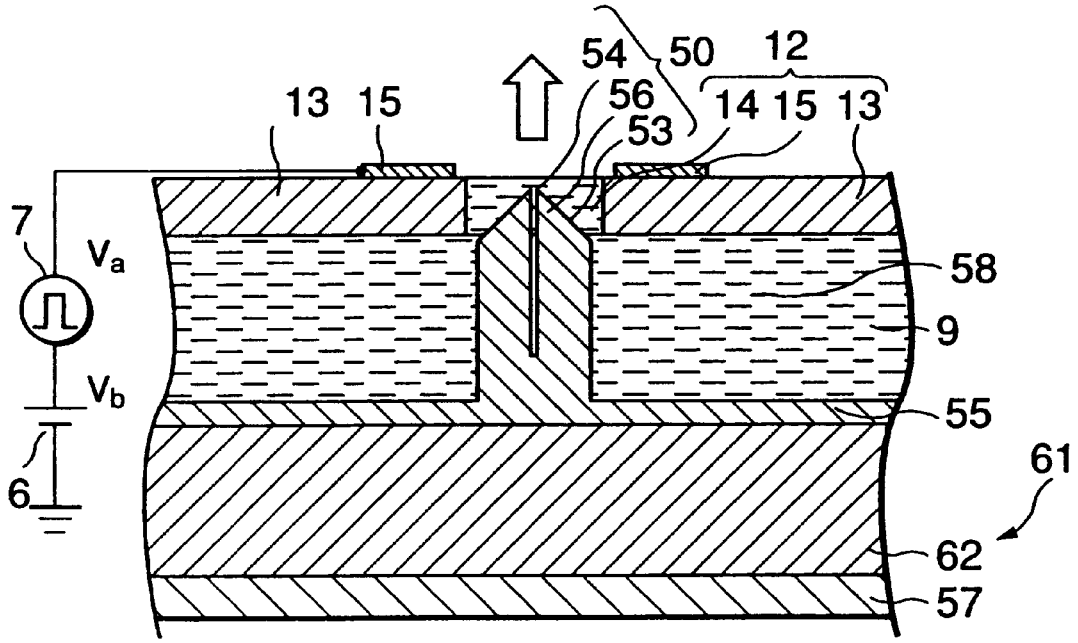

FIGS. 33A and 33B are sectional views illustrating a principal part of an ink jet recording device having the same construction as those shown in FIGS. 18A–18D and 19. In FIGS. 33A and 33B, the same reference numbers are used for the same or corresponding elements of the ink jet recording device shown in FIGS. 18A–18D and 19.

As shown in FIGS. 33A, 33B, 34A and 34B, control electrodes 15 are formed on a control electrode substrate 12 including an insulating substrate 13 and control electrode 15, and through holes 14 are formed in the insulating substrate 13 and the control electrodes 15 for allowing ink to pass therethrough. An ink guide 50 of an insulated resin passes through each of the through holes 14 to project from the upper surface of each of the control electrodes 15 in an ink emitting direction. Similar to the ink jet recording device shown in FIG. 20, each of the ink guides 50 has a base portion 55 and a projecting portion 56. The projecting portions 56 are formed at regular intervals corresponding to those of the through holes 14 which are formed in the control electrode substrate 12 at regular intervals. An ink guide moving mechanism 61 for simultaneously protruding and retracting a row of projecting portions 56 is mounted on the bottom of the base portion 55 of the ink guide 50. In this example, the ink guide moving mechanism 61 comprises a piezoelectric element 62.

A bias voltage Vb is always applied to each of the control electrodes 15 by means of a bias voltage source 6.

When the recording is carried out, a signal voltage Vp corresponding to a recording picture is supplied from a signal voltage source 7 to be superimposed on the bias voltage Vb. When the bias voltage Vb is applied, a liquid ink 9 in the ink chamber 58 slightly wets the surface of the ink guide 50 to rise along an ink guide groove 54 formed in the projecting portion 56 of the ink guide 50. In this state, when the signal voltage Vp is applied, the ink emits out of the tip of the ink guide 50 toward a recording paper facing the tip of the ink guide 50 to form a picture dot on the recording paper.

Figure 34A:
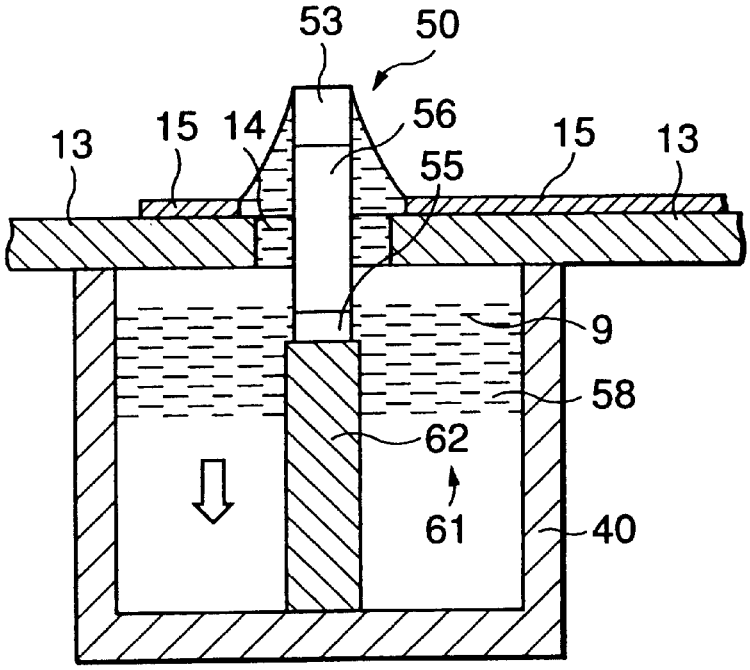
FIGS. 34A and 34B are longitudinal sections of the movable ink guide shown in FIGS. 33A and 33B.
Figure 34B:
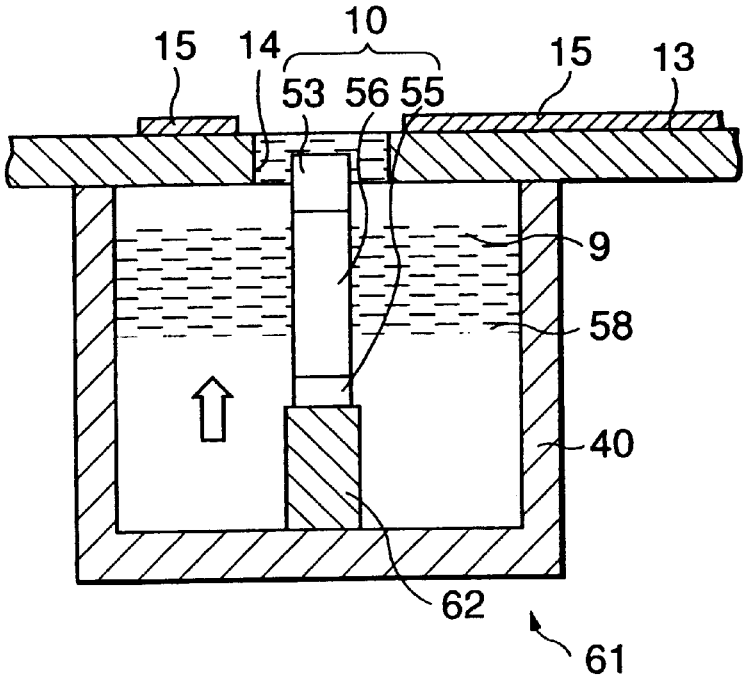

In this first example of the third preferred embodiment, as shown in FIGS. 33B and 34B, it is possible to soak the whole ink guide 50 in the liquid ink 9 by the ink guide moving mechanism 61 when the recording is not carried out. The maximum length of the projecting portion 56 of the ink guide 50 is about 300 $\mu$m, and the thickness of the control electrode substrate 12 is about 100 $\mu$m. If the ink guide 50 can be moved by at least about 500 $\mu$m, when it is required to emit ink, i.e., when the recording is carried out, the projecting portion 56 of the ink guide 50 can be protruded upwards from the liquid ink surface as shown in FIGS. 33A and 34A, and when the recording is not carried out, the projecting portion 56 of the ink guide 50 can be held in the liquid ink.

Since the diameter of the through hole 14 formed in the control electrode substrate 12 is about 150–250 $\mu$m, although the probability of clogging the nozzle is less than those of conventional ink jet printers, the through hole surface may be clogged when the device is not used for a long term.

In this first example of the third preferred embodiment, when the ink guide 50 is moved so as to be arranged below the level of the control electrode 15 as shown in FIG. 33B, it is possible to remove the clogging in a physical manner, such as wiping, since the projecting portion 56 of the ink guide 50 is not damaged in this state.

Referring to FIGS. 34A and 34B, a method for moving the ink guide 50 will be described below.

The bottom of a base portion 55 of an ink guide 50, which has a plurality of projecting portions 56 corresponding to the through holes 14, is bonded to a piezoelectric element 62 serving as a moving mechanism 61, the length of which is variable in vertical directions. Since the piezoelectric element 62 must have a stroke of at least about 200 $\mu$m, it is preferably a stacked piezoelectric element. An electrode (not shown) projects from the piezoelectric element 62 for applying voltage thereto, and extends to the outside of an ink chamber 58. As shown in FIG. 34A, when a normal voltage is not applied, the piezoelectric element 62 is in a shorter state, so that the ink guide 50 is housed in the ink chamber 58. When voltage is applied to the piezoelectric element 62, the piezoelectric element 62 is extended, so that the ink guide 50 projects from the through hole 3 of the control electrode substrate 12 as shown in FIG. 34A to allow the recording.

When the voltage applied to the piezoelectric element 62 is turned off, the projecting portion 56 of the ink guide 50 is housed in the ink chamber 58 again to be in a standby state. Furthermore, as this example, it is desired that the projecting portion 56 of the ink guide 50 is soaked in the ink when the device is not used, and projects only if necessary. As shown in FIGS. 34A and 34B, when the whole head cartridge is removed from the device or mounted thereon again, or when the head cartridge is changed to a new cartridge, the projecting portion 56 of the ink guide 50 may be damaged if it is protruded. Therefore, when the operation of the device is stopped, when the power supply is turned off, or when the head cartridge is removed from the body, it is desired that the projecting portion 56 of the ink guide 50 is immersed in the ink 9.

Figure 35:
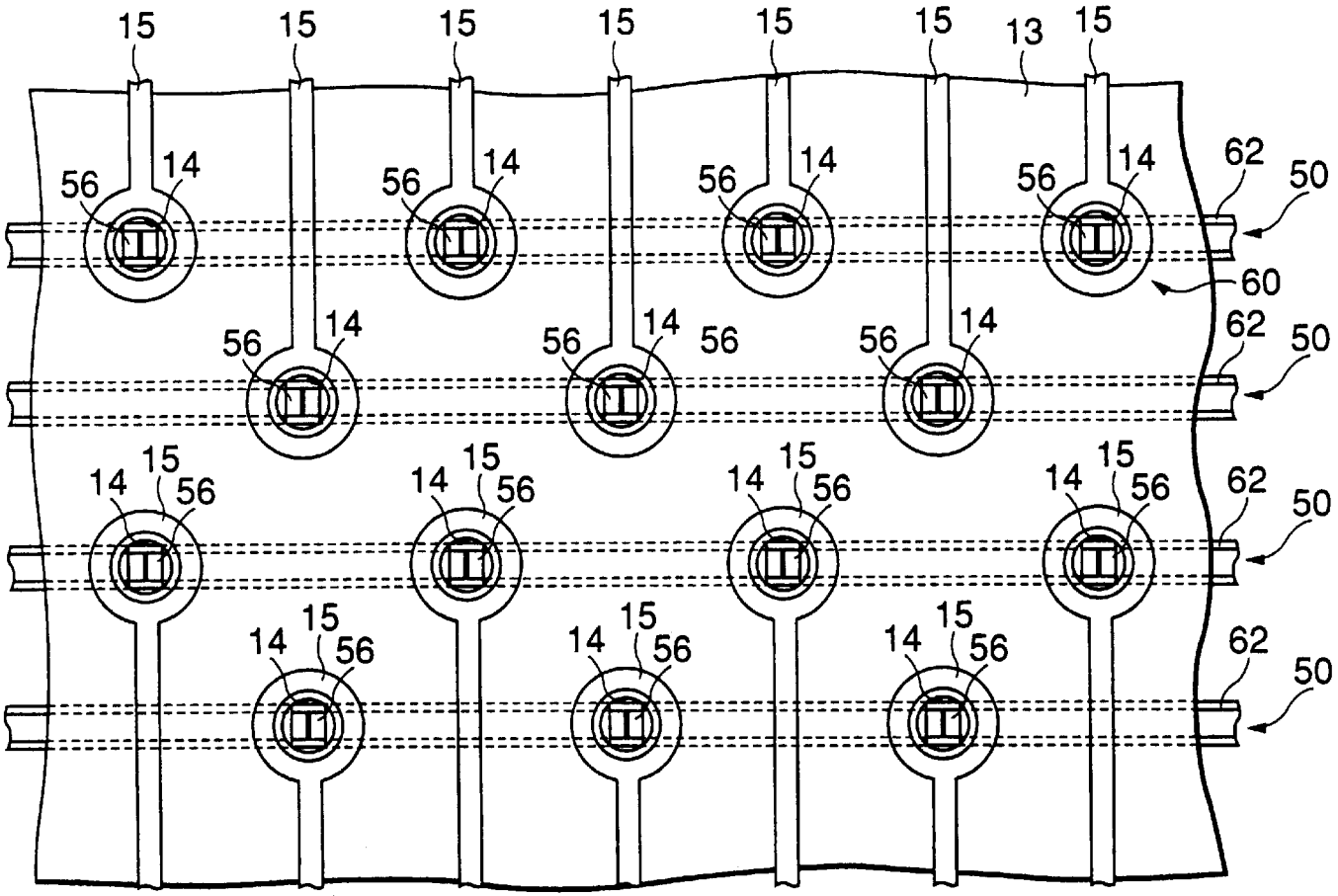
FIG. 35 is a plan view showing the arrangement of separate electrodes of the third preferred embodiment of an ink jet recording device according to the present invention.

In the first example of the third preferred embodiment, the ink jet recording device has a plurality of rows of a plurality of separate electrodes 60, each of which is the same as described above. In this preferred embodiment, the separate electrodes 60 are arranged as shown in FIG. 35. That is, the separate electrodes 60 are staggered so that the positions of the projecting portions 56 of the ink guides 50 in rows of odd numbers are shifted from the positions of the projecting portions 56 of the ink guides 50 in rows of even numbers by a half pitch. In such a staggered arrangement, since the distances between the respective electrodes 60 and the adjacent electrodes are equal to each other, it is possible to emit the ink to form uniform picture dots.

Figure 36:
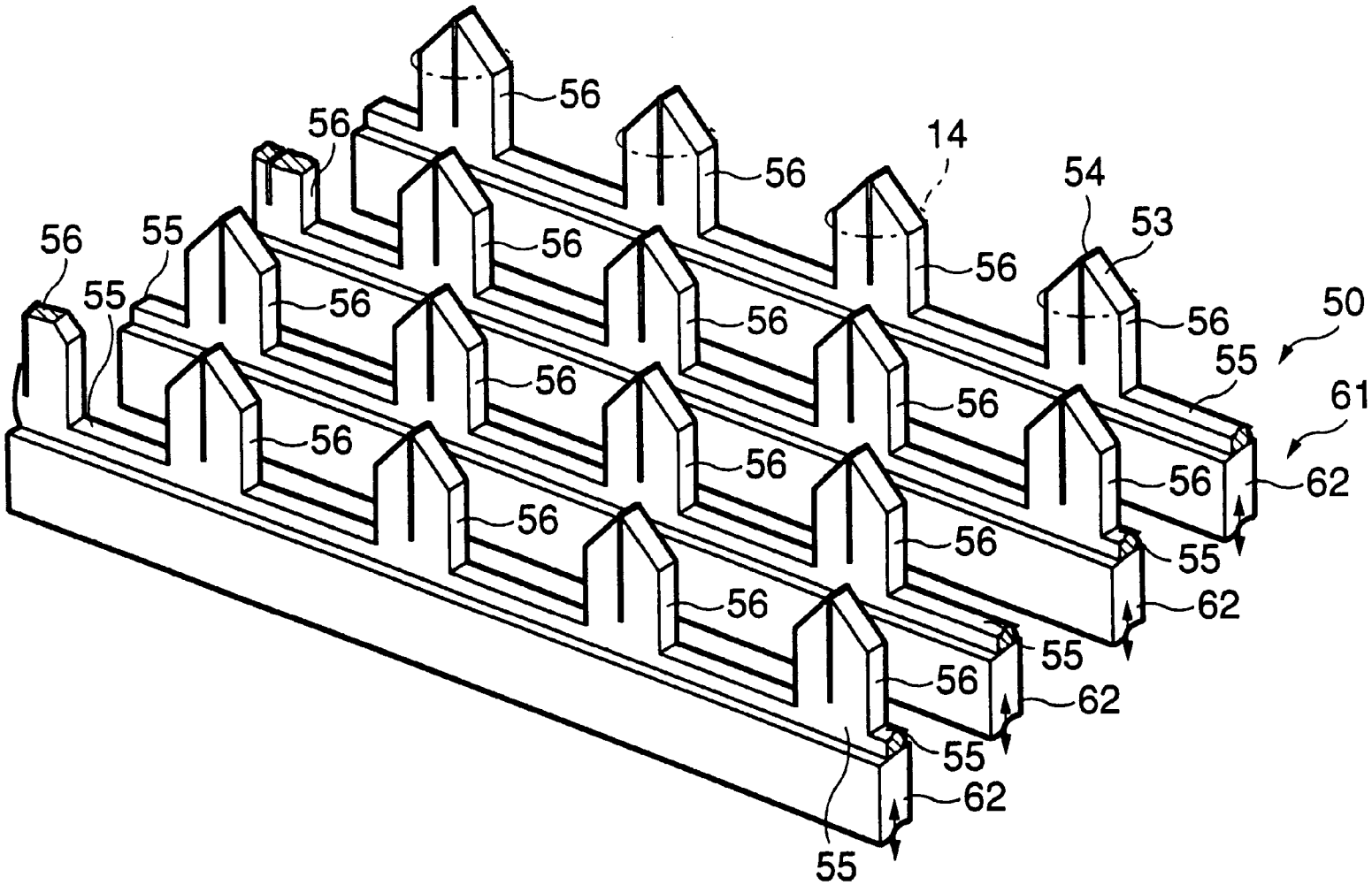
FIG. 36 is a perspective view illustrating the whole construction of an ink guide of the third preferred embodiment of an ink jet recording device according to the present invention.

FIG. 36 is a perspective view of an ink guide 50 of the ink jet recording system of FIG. 35. On the bottom of the base portion 55 of the ink guide 50, a piezoelectric element serving as an ink guide moving mechanism 61 is mounted.

Referring to a simple flow chart of FIG. 37, the serial operation of the first example of the third preferred embodiment of an ink jet recording device, according to the present invention, will be described below.

First, at step ST1, when a signal indicative of a recording start is received, the ink guide 50 housed in the ink is raised to protrude the tip of the projecting portion 56 from the surface of the control electrode 15 by a predetermined height. Then, at step ST2, it is determined whether the ink guide 50 is moved by a predetermined distance sufficient for recording operation. When it is not moved by the predetermined distance, the routine returns to step ST1 wherein the ink guide moving mechanism 61 is restarted to protrude the projecting portion 56 from the through hole 14 by the predetermined distance. When it is determined at step ST2 that the ink guide 50 is moved by the predetermined distance, it is determined that the device is ready for recording, so that the recording operation is started (step ST3).

At this time, the device is in a recordable state shown in FIGS. 33A and 34A. Thereafter, the recording operation is started at step ST3, and the recording operation is continuously carried out (step ST4). When all the recording is completed (step ST5), the ink guide 50 is moved downwards to be immersed in the ink 9 as shown in FIGS. 33B and 34B at step ST6, so that the serial recording operation ends. Until the device is used next time, the ink guide 50 is immersed in the ink to be stored therein. Furthermore, after the serial recording operation is completed, when the next recording signal is not received for a long term while the ink guide is immersed in the ink, it is required to clean the surface of the control substrate by wiping by means of a blade and to carry out the capping to prevent the ink from being dried due to the retention for a long term. In addition, in a case where the device has not been used for a long term, before the ink guide is moved upwards to be protruded, it is required to completely remove the clogging by sucking the ink by means of a pump or the like.

Although it is shown that only ink exists in the ink chamber 58, the ink chamber 58 may be filled with fiber, a porous body, or the like. In a case where only ink exists, it is required to provide a mechanism for always maintaining a constant ink level. On the other hand, in a case where a porous body or fiber is housed in the ink chamber, it is possible to maintain a constant ink emitting state without the need of any liquid-level maintaining mechanisms since the ink is supplied by the used amount by capillary action.

When the projecting portion of the ink guide is immersed in the ink, the ink coloring material adhered to the projecting portion is immersed in the solvent again, so that the coloring material is dissolved in the solvent to clean the tip of the ink guide. Although the adhered coloring material must be waited to be naturally dissolved in this method, there is a method for positively dissolving the coloring material in the solvent. Since the ink guide 50 is mounted on the piezoelectric element 62 as shown in FIGS. 34A and 34B, it is possible to more effectively remove the coloring material by applying minute vibration. In this case, the oscillation frequency may be in the range of from several Hz to several MHz of ultrasonic waves. Alternatively, another piezoelectric element 62 may be provided in the ink chamber 58 to vibrate at a frequency of several Hz to several MHz. In a case where the coloring material is charged, such as in the case of a liquid developing toner wherein a liquid ink is used in a usual liquid developing system, it is possible to remove the coloring material adhered to the ink guide by an electrical control. For example, in a case where the adhered coloring material is charged to be positive, a negative voltage is applied to an additional electrode provided below the ink guide, so that it is possible to attract the adhered ink toward the electrode to remove the coloring material from the guide. Furthermore, this voltage is not only a dc voltage, but it may be also an alternating voltage or a voltage consisting of an alternating voltage and a dc voltage superimposed thereon.

(Second Example)

Figure 38:
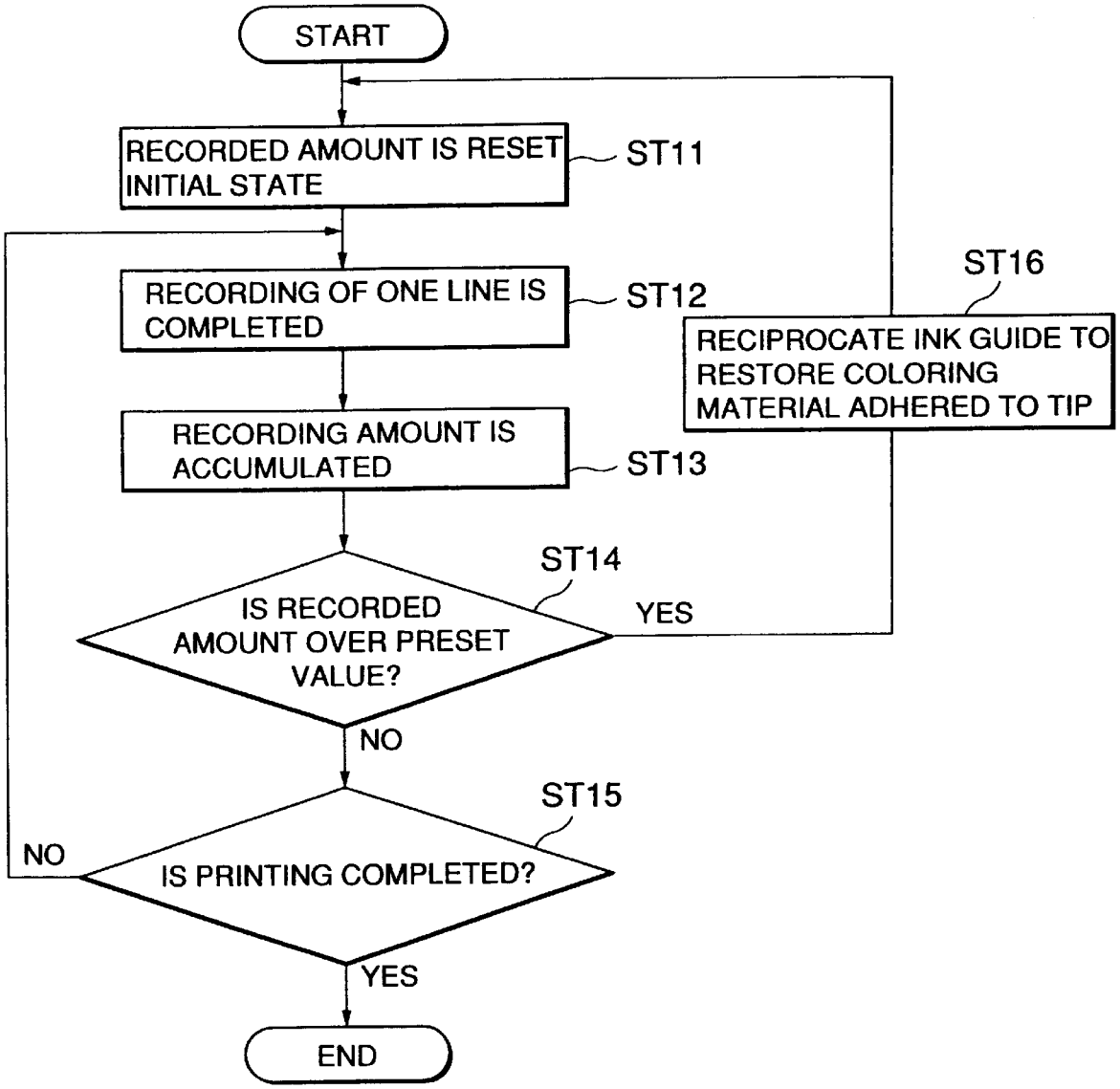
FIG. 38 is a flow chart showing the cleaning operation of the third preferred embodiment of an ink jet recording device according to the present invention.

Referring to FIGS. 33A, 36 and 38, the second Example of the third preferred embodiment of an ink jet recording device, according to the present invention, will be described below. In the second example, since the configuration of the ink jet recording device is the same as that of the first example shown in FIGS. 33A and 36, there is omitted the duplicated description.

FIG. 38 is a flow chart showing a method for presuming the amount of the adhered coloring material to the projecting portion 56 in response to a recording signal to remove the coloring material, in this example of an ink jet recording device, according to the present invention. When the recording is started, a system for measuring a recorded amount, i.e., a printed amount, is reset to an initial state (step ST11). Although the recorded amount may be measured by some methods, there is a method for counting the number of recorded picture dots. In this method, at every time the recording of one line is completed (step ST12), the number of the recorded picture dots is accumulated (step ST13) to be counted. Although the amount of the adhered coloring material may be presumed by counting the number of the recording picture dots of every electrode, it may be presumed by adding all the amount of the recorded data every line as a simple method. In this case, the system for measuring the recorded amount is a counter for counting the number of the recorded picture dots.

When the recording is started, the recorded-amount measuring counter is reset. When the data of one line is recorded, the value of the recorded-amount measuring counter is increased. Then, at step ST14, the value of the recorded-amount measuring counter is compared with a preset value. Since it is initially set to be smaller than the preset value, it is determined at step ST14 that it is "NO", and it is determined at step ST15 whether the printing is completed. When it is "NO" at step ST15, the routine returns to step ST12 wherein the recording operation of the next line is carried out. In such a state, when many lines are continuously recorded, the value of the recorded-amount measuring counter exceeds the present value. That is, since many data are continuously recorded, the coloring material may be adhered to the tip of the projecting portion of the ink guide. In this case, at step ST14, it is determined that the printed amount exceeds the preset value, and the routine goes to step ST16. At step ST16, before the next line is recorded, the coloring material adhered to the tip of the projecting portion is removed, so that the state of the tip of the projecting portion is restored to the initial state. In order to restore the tip of the projecting portion, after the projecting portion is moved downwards to a position below the control electrode to immerse the tip of the projecting portion in the ink, it may be moved upwards to the recording position again. Thus, the coloring material adhered to the tip of the projecting portion is removed, so that the projecting portion is cleared to be set at a predetermined position in a recording mode.

When the state of the projecting portion is restored, the subsequent printing is carried out. In this case, after the value of the printed-amount measuring counter is reset, the recording operation is carried out. If such operations are repeated until the whole printing is completed, the recording can be carried out while cleaning the coloring material adhered to the projecting portion, so that it is possible to continuously record stable pictures.

Figure 40:
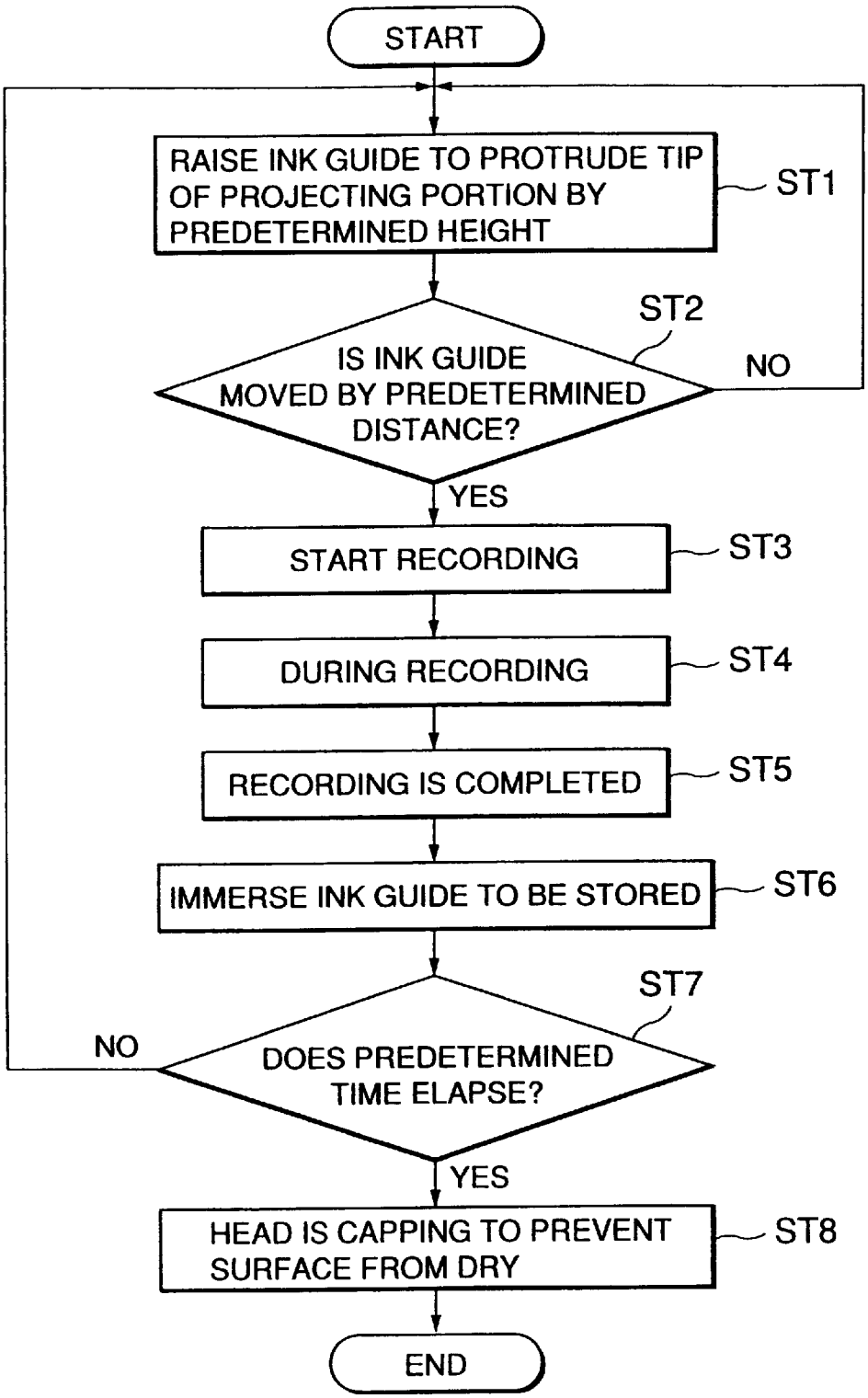
FIG. 40 is a flow chart showing the timing operation of the third preferred embodiment of an ink jet recording device according to the present invention.

Furthermore, before the recording of FIG. 40 is started and after all the recording is completed, the operation for rising the projecting portion to set in a recordable state and the operation for immersing the projecting portion to set in a storage state are carried out.

(Third Example)

Referring to a flow chart of FIG. 39, the operation of the third example of the third preferred embodiment of an ink jet recording device, according to the present invention, will be described below.

In this third example, an ink jet recording device is operated so as to protect an ink guide when a paper jam occurs during recording operation. In a usual printer, when the recording is started, it is recognized whether a paper passes through sensors within a preset time, so that the presence of paper jam is detected. After a predetermined period of time elapses after a paper passes through one of sensors (not shown) arranged at regular intervals, in a case where the paper does not reach the next sensor, it can be detected that a paper jam occurs therebetween. If jam occurs, the recording paper is puckered or bent. Therefore, if jam occurs near the head, the paper may contact the tip of the ink guide to break down the ink guide. When the jammed paper is removed, the recording paper may contact the tip of the ink guide to break down the tip.

Figure 39:
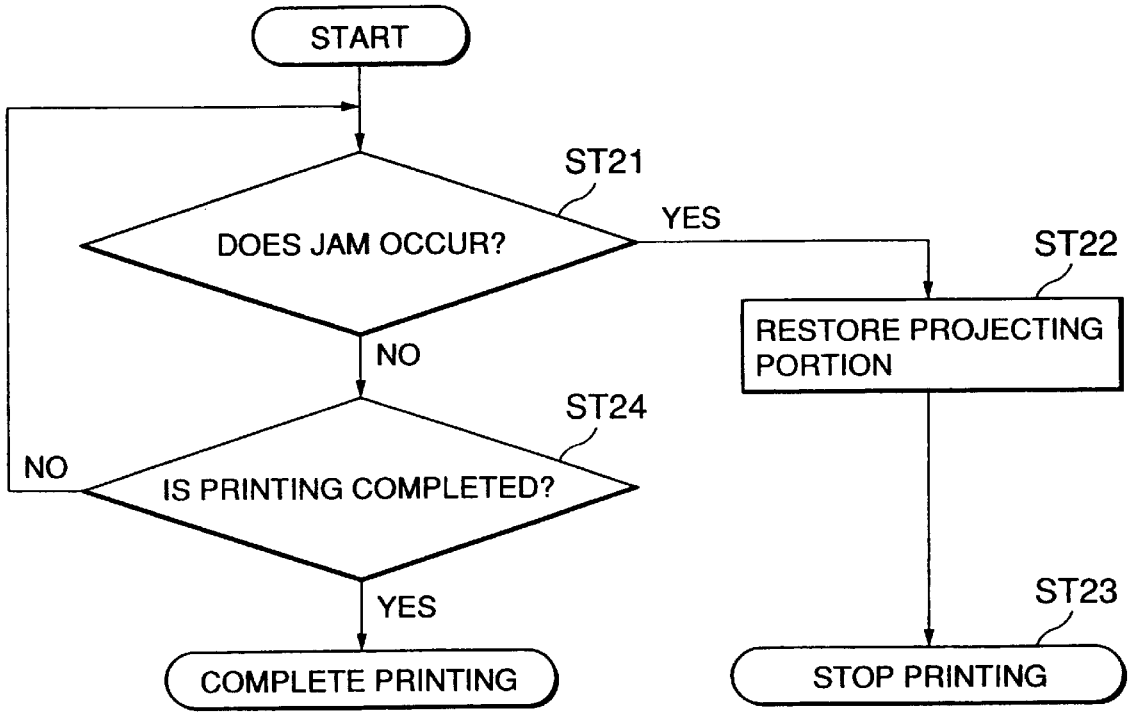
FIG. 39 is a flow chart showing the retracting operation of an ink guide when jam occurs in the third preferred embodiment of an ink jet recording device according to the present invention.

In order to eliminate such problems, as shown in FIG. 39, immediately after a paper jam occurs, the paper feed is stopped in the printer. Simultaneously, the ink guide is retracted to be immersed in the ink, so that it is possible to prevent the tip of the ink guide from being damaged. Specifically, as shown in FIG. 39, it is determined at step ST21 whether a paper jam occurs. When it is determined that a paper jam occurs, the projecting portion 56 of the ink guide 50 is retracted into the ink chamber 58 at step ST22, and the printing is stopped at step ST23. When it is determined at step ST21 that no paper jam occurs, it is determined at step ST24 whether the printing should be completed. When it is required to continue the printing, the operations of steps on or after step ST21 are repeated. When it is determined at step ST24 that the whole printing operation is completed, the printing ends.

Thus, it is possible to prevent a jammed paper or the user's hand from contacting the projecting portion when the user tries to remove the jammed paper, so that it is possible to the projecting portion from being broken down. Furthermore, the detection of jam and the vertical movement of the ink guide are not independently provided, and combined with the first and second examples the third preferred embodiment. Therefore, while the printing is stopped at step ST23, after the projecting portion 56 of the ink guide 50 is housed in the ink chamber 58 similar to the second example, the user may remove the jammed paper by hand or a tool to restore the device. In the case of a minor paper jam, it is possible to remove the jammed paper only by reciprocating the projecting portion of the ink guide several times, and thereafter, the printing may be restarted.

(Fourth Example)

Referring to FIG. 40, in the operation of the first example of the third preferred embodiment of an ink jet recording device shown in FIG. 37, a process for carrying out the capping when a head is not used in the fourth example of the third embodiment of an ink jet recording device according to the present invention, will be described below.

Figure 37:
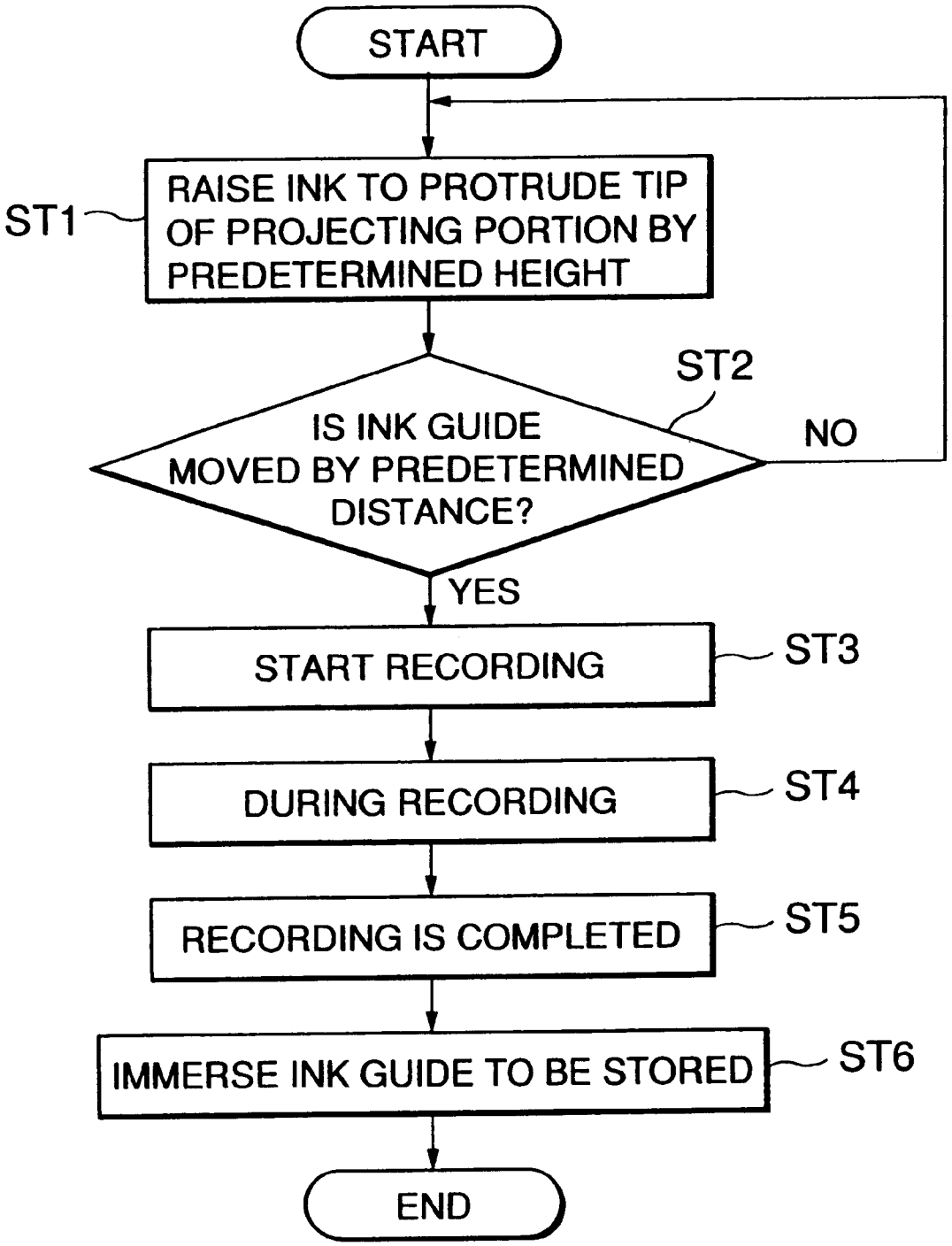
FIG. 37 is a flow chart showing the operation for the vertical motion of an ink guide of the third preferred embodiment of an ink jet recording device according to the present invention.

In FIG. 40, since the processing operations at steps ST1 through ST6 are the same as those in the first example of FIG. 37, the duplicated descriptions are omitted. At step ST6, the projecting portion 56 of the ink guide 50 is immersed in the ink 9 to be in a standby state, and thereafter, it is determined at step ST7 whether a predetermined period of time elapses.

When a printing command or the like is inputted again before the predetermined period of time elapses, the routine returns to step ST1, so that steps ST1 through ST6 are repeated. In a case where the printing operation is not carried out even if the predetermined period of time elapses, the capping operation is carried out at step ST8 in order to prevent the printing failure when the surface of the head is dried and the next printing command is produced. Thus, in this nineteenth preferred embodiment, it is possible to prevent the surface of the head from being dried using functions, such as a timer, when the head is not used for a long term.

(Fifth Example)

Figure 41A:
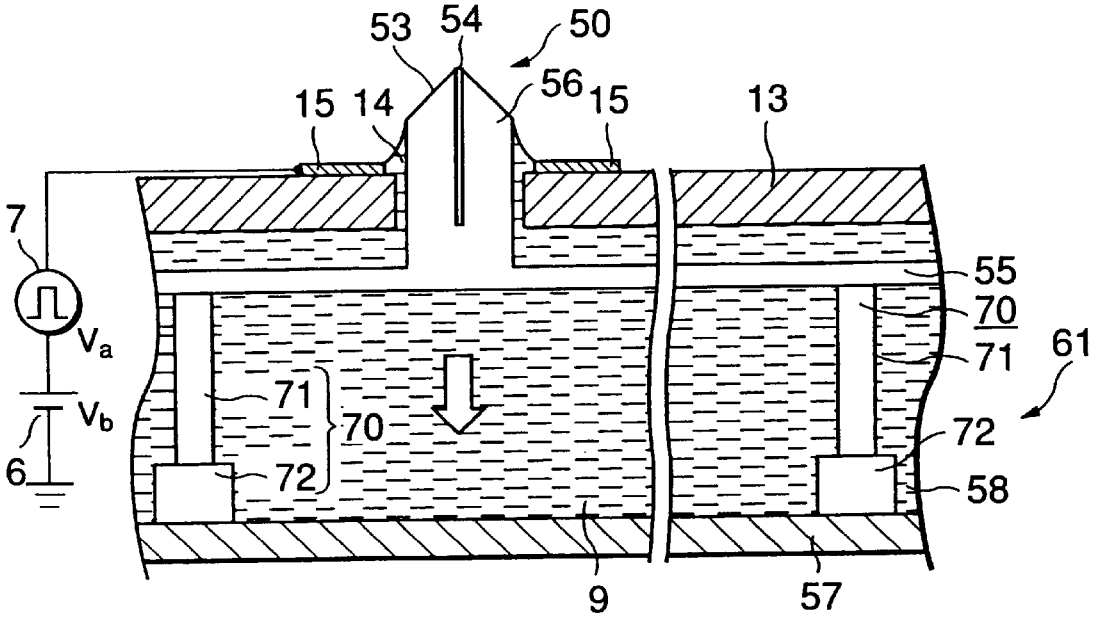
FIGS. 41A and 41B are cross-sectional views of an ink guide serving as a principal part of the third preferred embodiment of an ink jet recording device according to the present invention.
Figure 41B:
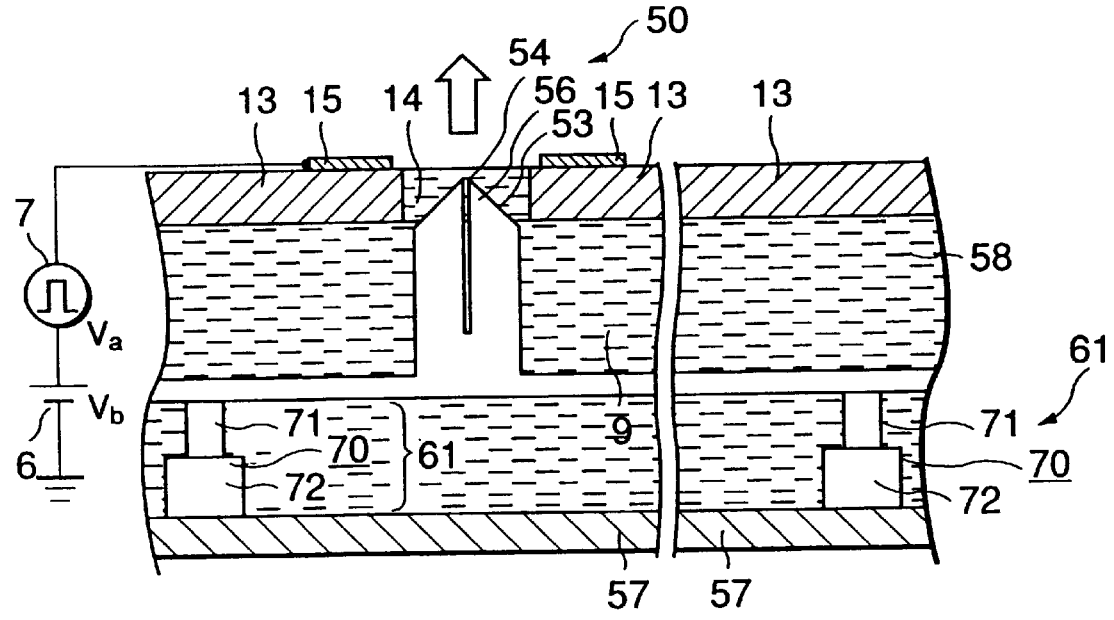
Figure 42A:
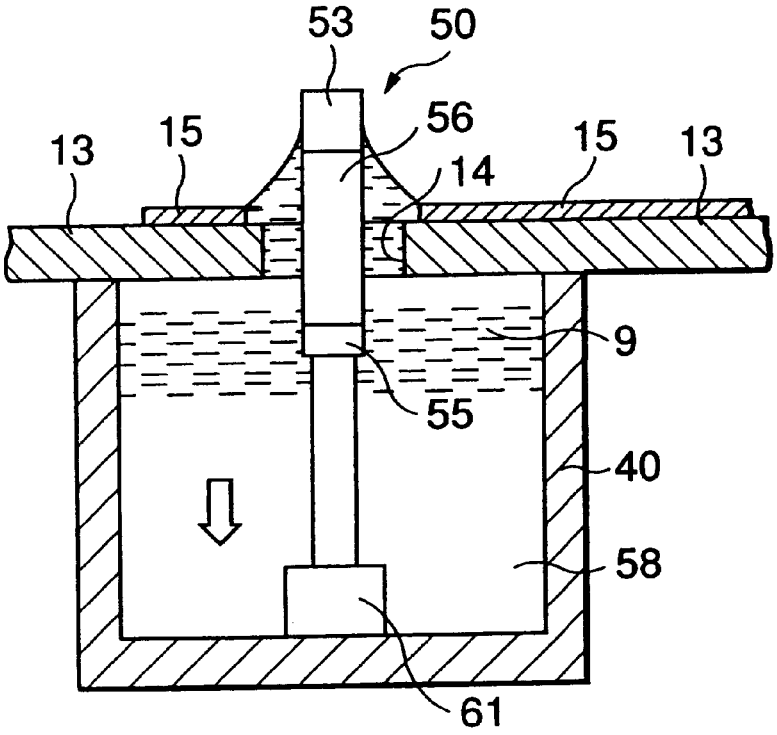
FIGS. 42A and 42B are longitudinal sections of the ink guide shown in FIGS. 41A and 41B.
Figure 42B:
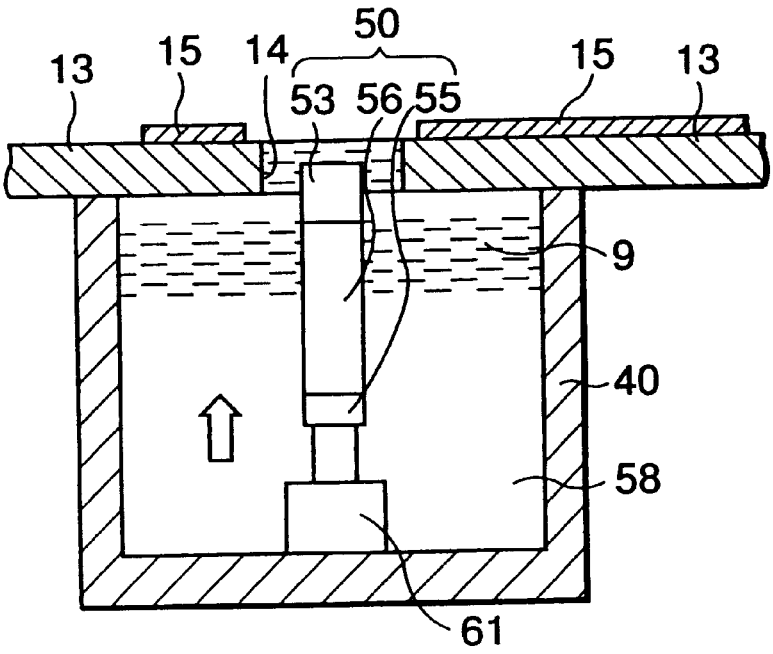
Figure 43:
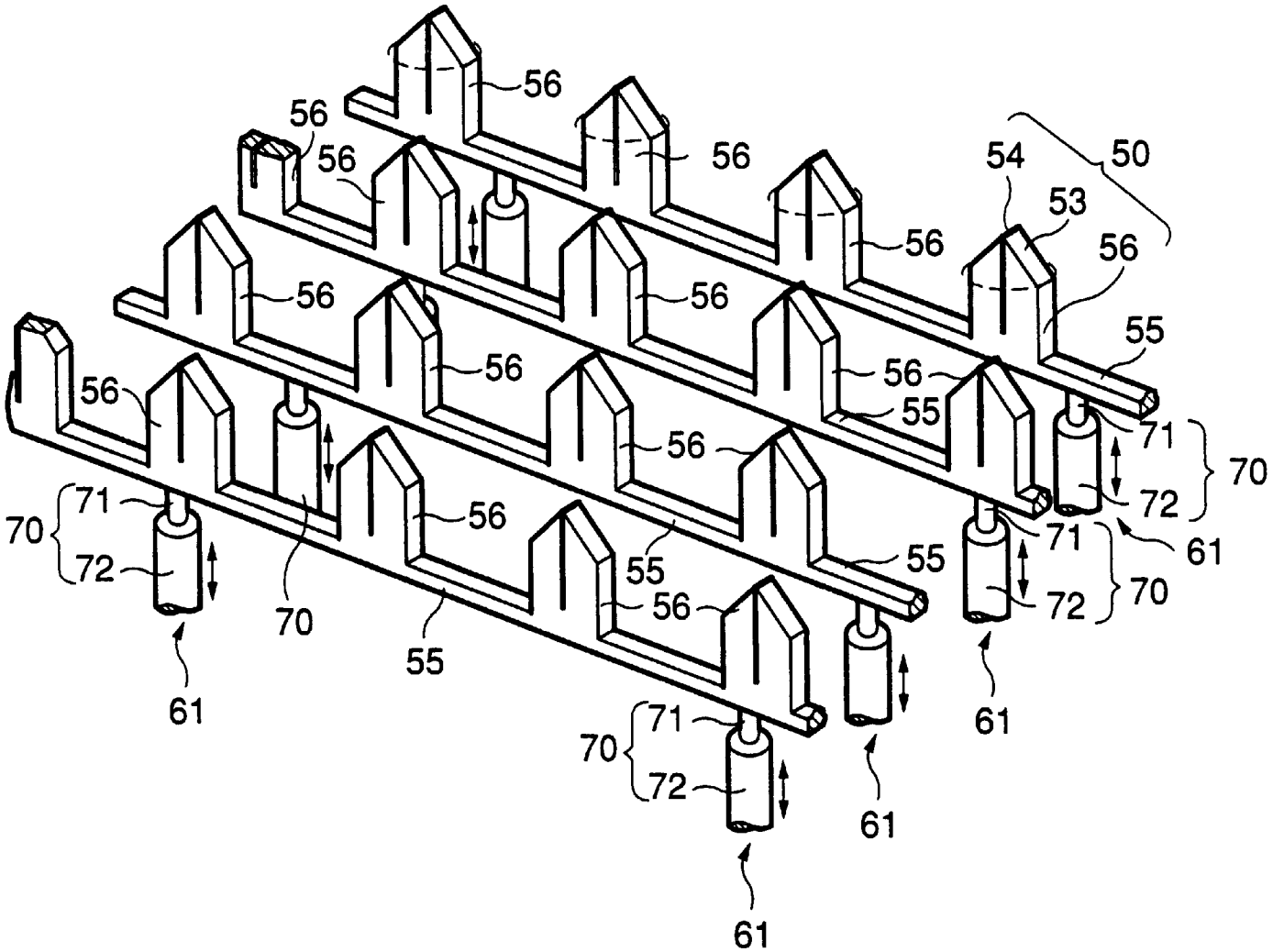
FIG. 43 is a perspective view illustrating the whole construction of ink guides of the third preferred embodiment of an ink jet recording device according to the present invention.

Furthermore, while the piezoelectric element 62 has been used as the ink guide moving mechanism 61 in the first through third examples, the present invention should not be limited thereto, but any mechanisms may be used as long as the ink guide 50 can be moved by a reciprocating motion. For example, as shown in FIGS. 41A thorough 43, the ink guide moving mechanism 61 may be a solenoid 70 comprising a plunger 71 and an electromagnetic coil 72 in the fifth example of an ink jet recording device according to the present invention.

Referring to FIGS. 41A through 43, the fifth example of the third embodiment of an ink jet recording device, according to the present invention, will be described below.

In FIGS. 41A, 41B, 42A and 42B, only an ink guide 50 and a solenoid 70 are shown by a plan view, and a control electrode 15, a separates electrode 4, a trough body 57 and so forth are shown by a cross section, similar to FIGS. 33A through 33B. In FIG. 41A through FIG. 43, a plunger 71 is a movable core of the solenoid 70. When an electromagnetic coil 72 provided in a cylinder is excited by a direct or alternating current, the plunger 71 serving as the movable core is attracted by the center of the coil 72. By this attraction based on electromagnetic force, a base portion 55 of the ink guide 50, the bottom of which is secured to the tip of the plunger 71, is drawn into an ink chamber 58, so that the tips of projecting portions 56 arranged on the base portion 55 at regular intervals can be completely housed in the ink chamber 58 via a through hole 14.

Furthermore, as the ink guide moving mechanism 61, an engaging portion may be provided on the inner wall of an end portion of a detachable trough body 57, so that the ink guide 50 may be moved toward the ink chamber in the ink emitting direction by the manual operation from the outside of the ink chamber 58 without opposing the ink. In addition, an eccentric pivot mechanism, such as a cam, may be provided on the ink chamber 58, so that the eccentric pivot mechanism may be rotated to protrude and retract the ink guide. In addition, racks fixed to the both sides of the base portion of the ink guide may engage pinion gears provided in the ink chamber, so that the pinion gears may be rotated by the operation from the outside of the ink chamber, to protrude and retract the ink guide.

(Sixth Example)

Figure 44:
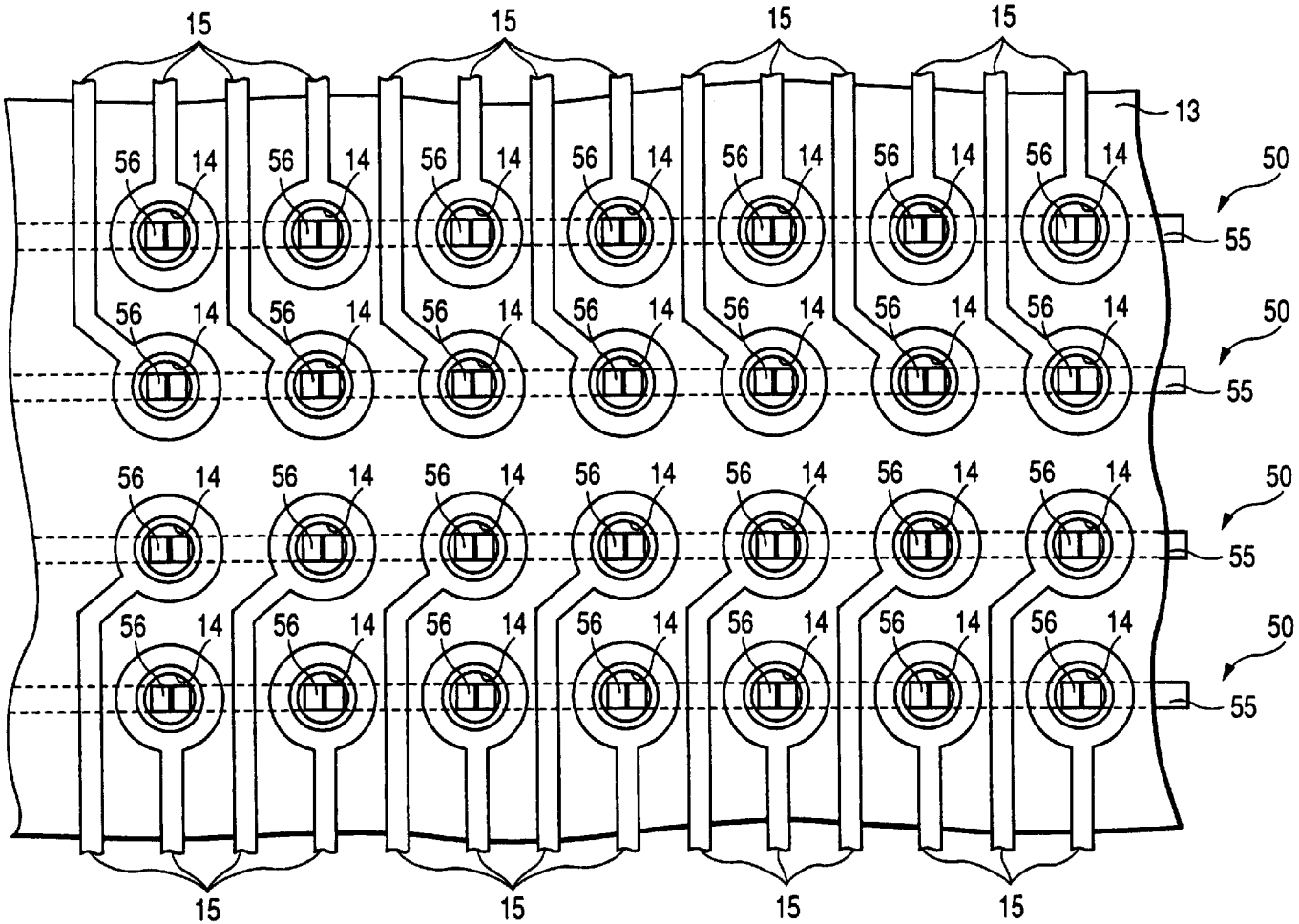
FIG. 44 is a plan view showing the arrangement of emitting nozzles of the third preferred embodiment of an ink jet recording device according to the present invention.

While the separate electrodes have been arranged so that the respective rows of the separate electrodes are staggered in the first through fifth examples of the third embodiment, the present invention should not be limited thereto, but various arrangements may be applied. For example, the separate electrodes may be arranged as a sixth example of the third embodiment of an ink jet recording device shown in FIG. 44. In the sixth example, leads of control electrodes 15 are connected to both edges of an insulating substrate 13, and the control electrodes 15 are formed around each of two rows of through holes 14. An ink guide 50 is provided so that a projecting portion 56 thereof can be protruded from the through hole 14. The ink guide 50 is movable so as to be approached and away from the insulating substrate 13 by means of a moving mechanism (not shown in FIG. 44). In the sixth example, the distance between the adjacent separate electrode is small, so that it is possible to form a high-resolution picture dot.

(Seventh Example)

Figure 45:
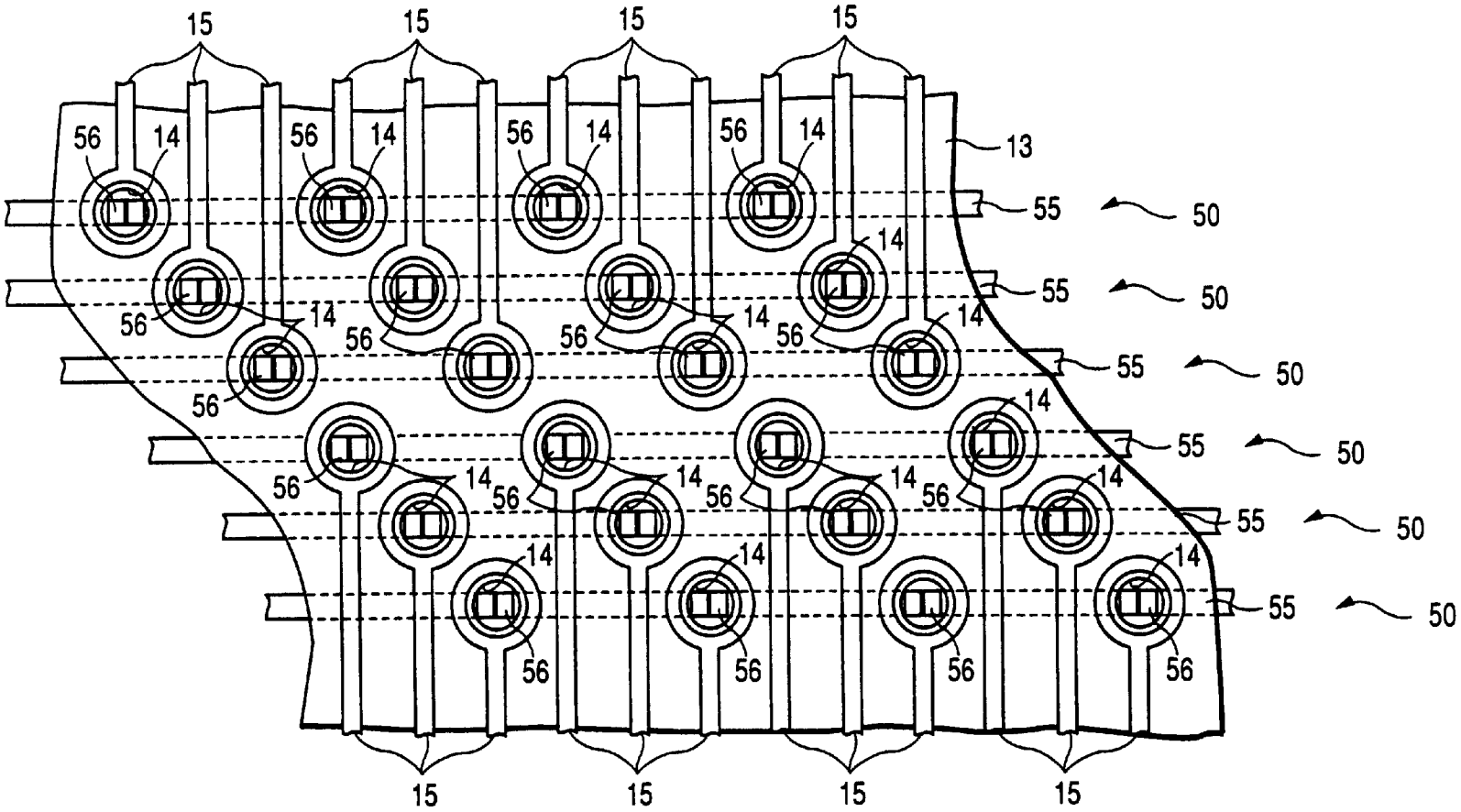
FIG. 45 is a plan view showing the arrangement of emitting nozzles of the third preferred embodiment of an ink jet recording device according to the present invention.

In the seventh example of an ink jet recording device shown in FIG. 45, leads of control electrodes 15 for three rows of separate electrodes extend from both edges of an insulating substrate 13, and three rows of through holes 14 are formed so as to correspond to the three rows of separate electrodes. Projecting portions 56 corresponding to the through holes 14 are provided so as to be protrudable and retractable. Thus, the through holes may be arranged as the first and sixth examples shown in FIGS. 35 and 44.

(Eighth and Ninth Examples)

While the ink guide 50 has been formed so that a row of projecting portions 56 are arranged on the rod-like base portion 55 at regular intervals in the first through seventh examples, the present invention should not be limited thereto. In the eighth and ninth examples of an ink jet recording device shown in FIGS. 46 and 47, a base portion 55 comprises a plate, and a plurality of rows of projecting portions 56 are arranged on the plate-like base portion 55 at predetermined positions.

Figure 46:
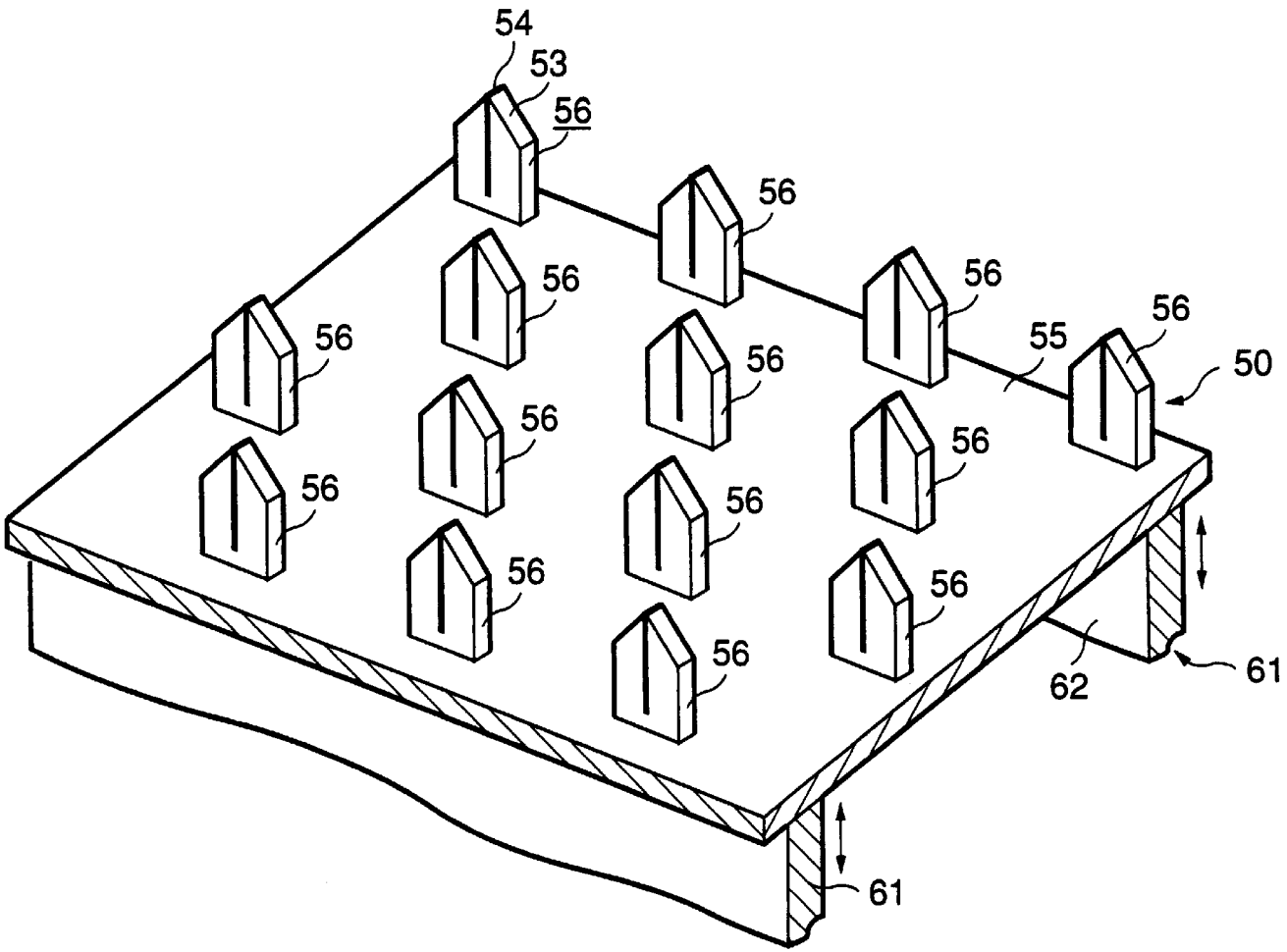
FIG. 46 is a perspective view of an ink guide serving as a principal part of the third preferred embodiment of an ink jet recording device according to the present invention.

In the eighth example of the third embodiment of an ink jet recording device shown in FIG. 46, a pair of ink guide moving mechanisms 61 comprising piezoelectric elements 62 are mounted on the bottom of the plate-like base portion 55 of the ink guide 50 at predetermined positions. When it is required to retract the projecting portions 56 of the ink guide 50 into the ink, the pair of ink guide moving mechanisms 61 can be moved downwards so that the tips of the projecting portions 56 of the ink guide 50 can be housed at a lower level than the levels of the control electrodes 15.

Figure 47:
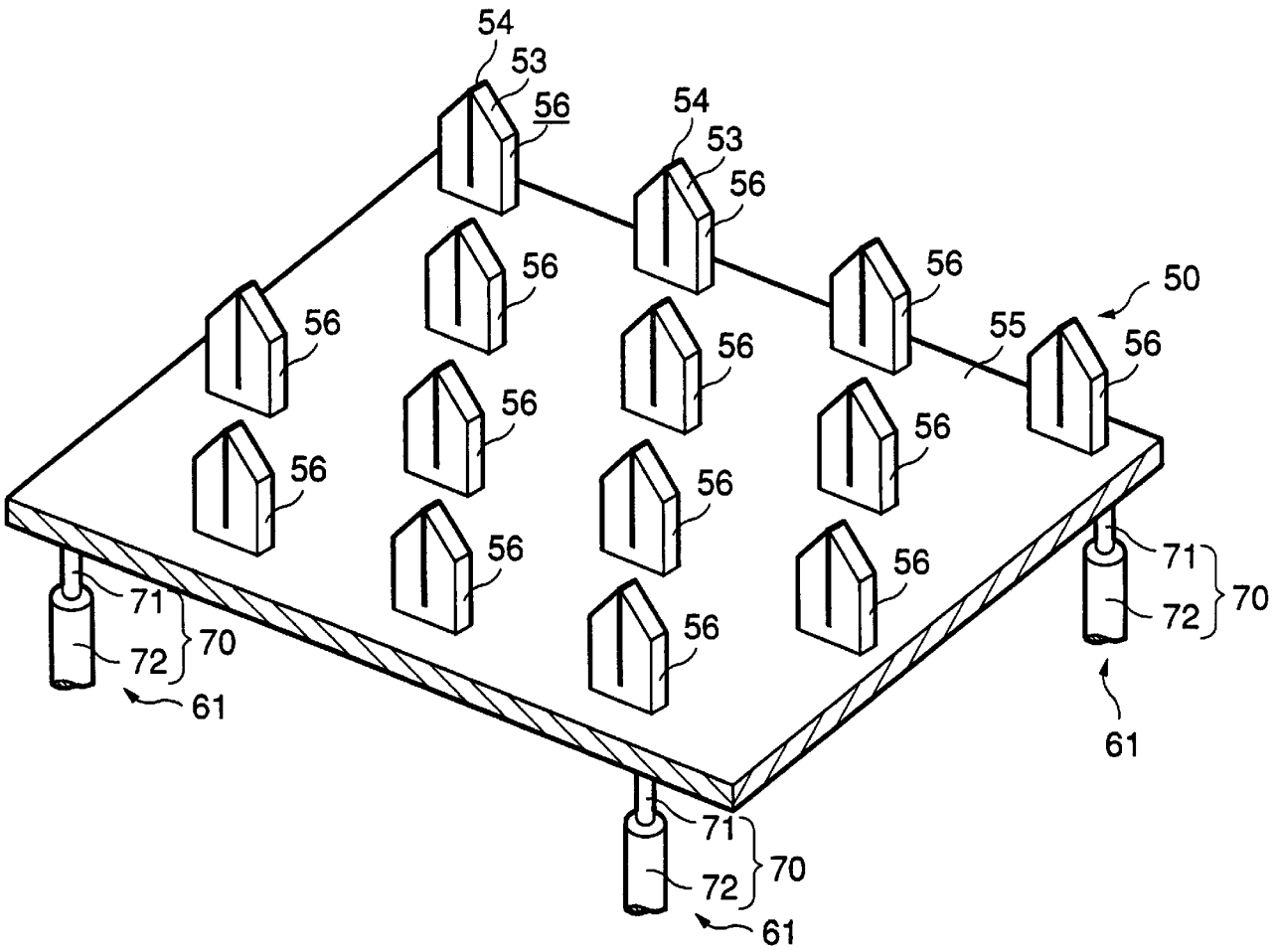
FIG. 47 is a perspective view of an ink guide serving as a principal part of the third preferred embodiment of an ink jet recording device according to the present invention.

In addition, in the ninth example of the third embodiment of an ink jet recording device shown in FIG. 47, ink guide moving mechanisms 61 comprising solenoids 70 are mounted on the bottom of the plate-like base portion 55. Each of the solenoids 70 has the same construction as that in the fifth example, and comprises a plunger 71 serving as a movable core and an electromagnetic coil which can be housed in a cylinder by retracting the plunger 71. In the ninth example, the solenoids 70 serving as the ink guide moving mechanisms 61 are arranged at four positions so that the base portion 55 can be moved upwards and downwards while maintaining to be parallel to the control substrate (not shown in FIG. 47) by simultaneously supplying excitation current to these solenoids 70.

Furthermore, in the case of the ink guide 50 having a plate-like base portion 55 as the eighth and ninth examples of the third embodiment, a manually operable moving mechanism such as a rack and a pinion, and an eccentric cam, may be provided in place of the automatic moving mechanism such as the piezoelectric element 62 and the solenoid 70.

FOURTH PREFERRED EMBODIMENT (The First Example)

An ink jet recording device of the first example according to the fourth preferred embodiment of the present invention, will be described below.

Figure 48:
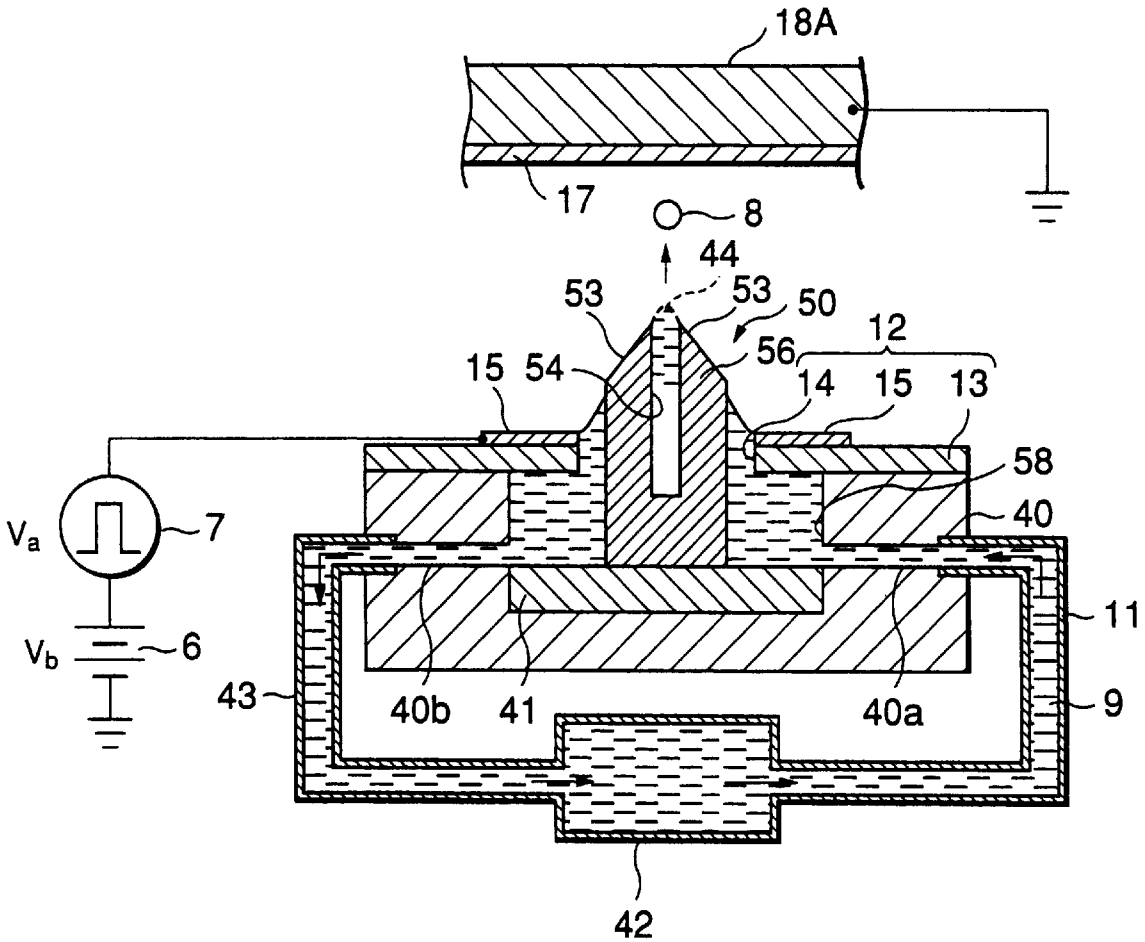
FIG. 48 is a sectional view of an ink jet head portion and a principal part of the third preferred embodiment of an ink jet recording device according to the present invention.

FIG. 48 shows a cross section of a separate electrode corresponding to a recording dot and the surrounding portion thereof in the first example of the fourth embodiment of an ink jet recording device using a line scanning type ink jet head, according to the present invention. In FIG. 48, since the same numerals shown in FIG. 20 denotes the same components in the second example of the second embodiments, the duplicated description is omitted.

Figure 49:
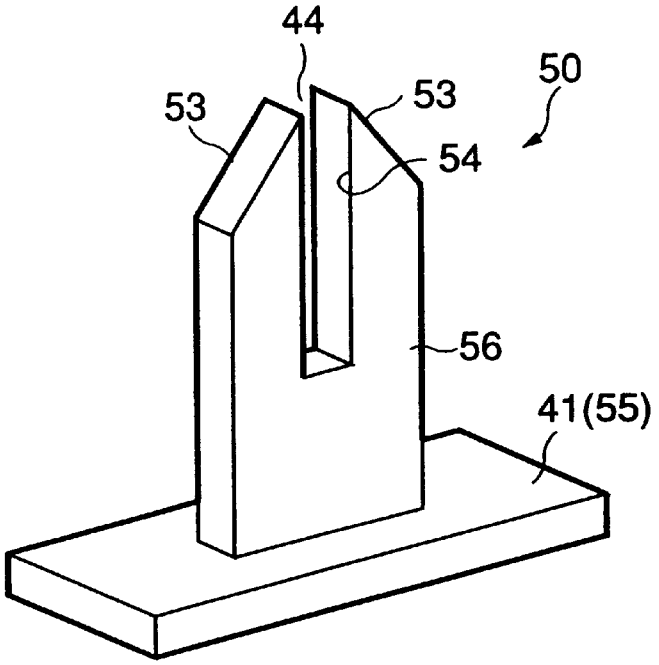
FIG. 49 is a perspective view illustrating the whole shape of an ink guide in the fourth embodiment.
Figure 50:
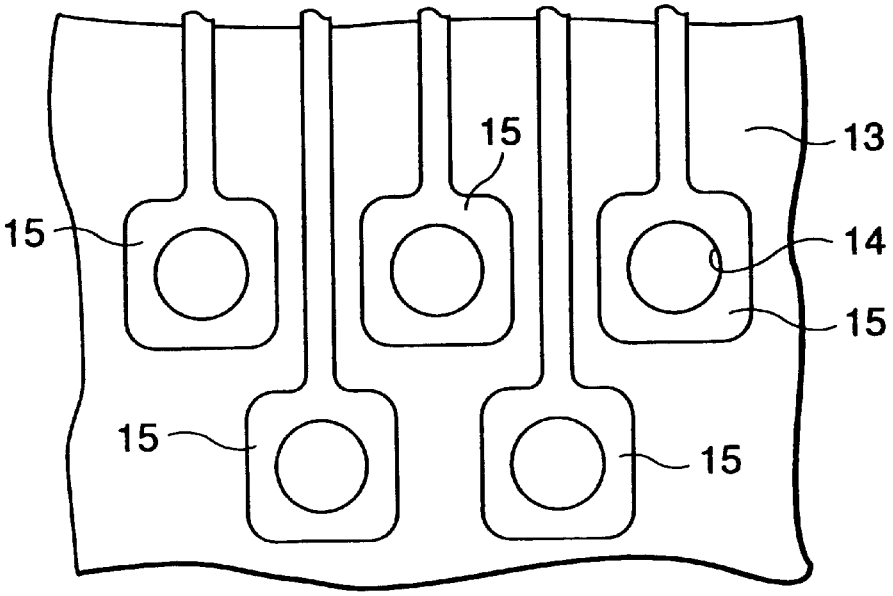
FIG. 50 is a plan view illustrating the arrangement and shape of control electrodes in the fourth preferred embodiment.

FIG. 49 is a perspective view illustrating the shape of the ink guide 50 in the first example of the fourth embodiment of an ink jet recording device according to the present invention. The ink guide 50 is made of a plastic member or the like, on which a conductive film, such as a copper film, is formed by deposition, sputtering or the like. The ink guides 50 are arranged at the same row intervals and pitches as those of the through holes 14 of the insulating substrate 13 so as to correspond to the through holes 14, and supported on the head substrate 41 by predetermined means. The row intervals and pitches correspond to the arrangement of the through holes 14 of the insulating substrate 13 and the control electrodes 15 shown in FIG. 50.

As shown in FIG. 49, the ink guide 50 has the ink guide groove 54 having a width of about 30 to 60 $\mu$m at the center thereof. The gap between the tips of the inclined portions 53 of the projecting portion 56 of the ink guide 50 serves as the ink-droplet emitting position 44. Moreover, the projecting portion 56 of the ink guide 50 projects substantially in a vertical direction from the through hole 14 by a predetermined height in the ink-droplet emitting direction.

In the first example of the fourth embodiment, the inner diameter of the control electrode 15 is substantially the same as the diameter of the substrate through hole 14.

In FIG. 49, the head substrate 41 (the base portion 55) supporting thereon the ink guide 50 is made of an electrically insulating material, and the tip portion of the ink guide has conductivity so as to be chargeable due to the current induced by the control electrode 15.

Furthermore, while the ink guide 50 has been formed as a separate member for each of the separate electrodes in the first example of the fourth preferred embodiment (see FIG. 49), the present invention should not be limited thereto. For example, in order to produce the ink guides in large quantities and effectively assemble the ink guides, a plurality of ink guides may be integral with each other similar to the second through seventh examples of the fourth embodiment of an ink jet recording device shown in FIGS. 51 through 56.

(The Second Example)

Figure 51:
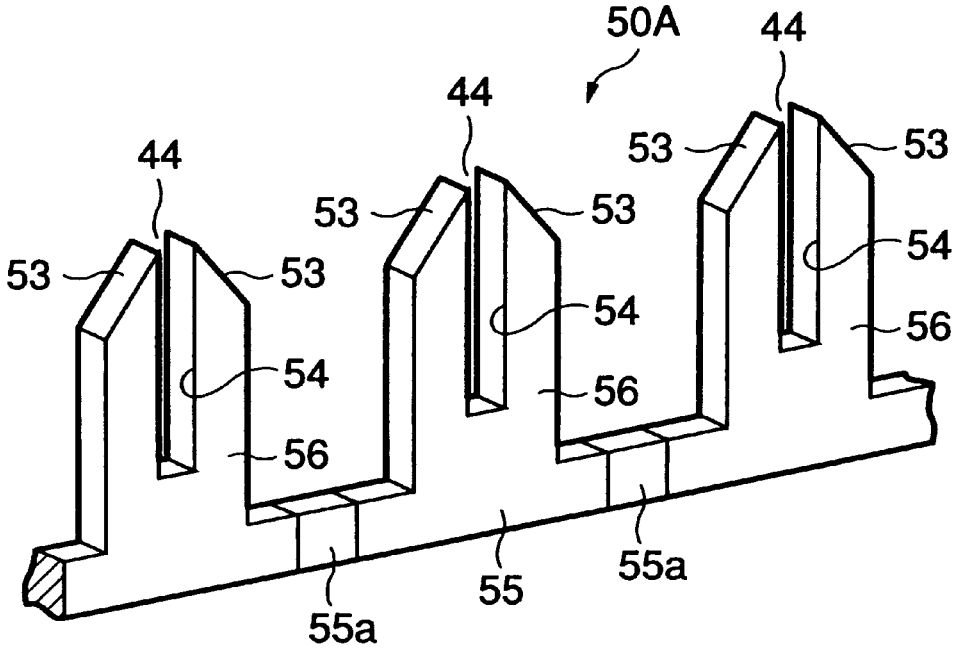
FIG. 51 is a perspective view of an ink guide of the fourth preferred embodiment of an ink jet recording device according to the present invention.

FIG. 51 shows an ink guide 50A of a linear type of the second example of an ink jet recording device according to the present invention. In FIG. 51, the ink guide 50A comprises an elongated rod-like base portion 55, and a plurality of projecting portions 56 projecting from the elongated base portion 55 toward the recording medium at regular intervals. The construction of the projecting portions 56 of the ink guide 50A is basically the same as that in the first example of the fourth preferred embodiment of an ink jet recording device according to the present invention. The elongated base portion 55 has insulating portions 55*a* between the adjacent projecting portions 56. The adjacent projecting portions 56 are electrically insulated from each other by means of the insulating portion 55*a*. The insulating portion 55*a* can be formed by masking portions corresponding to the insulating portions 55*a* to laminate a conductive film on the linear ink guide member 50A.

(The Third Example)

Figure 52:
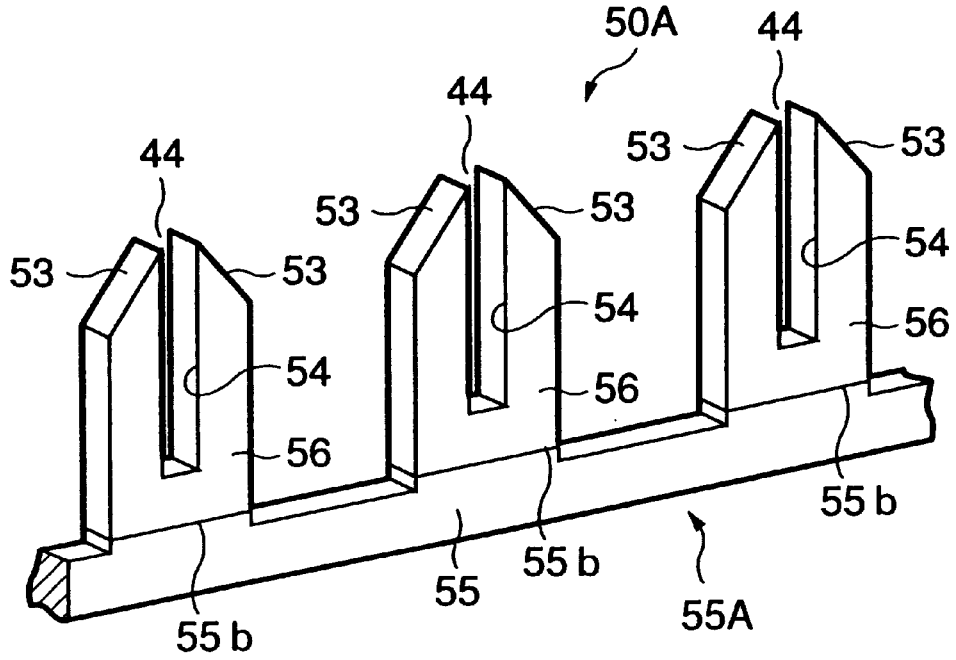
FIG. 52 is a perspective view of an ink guide of the fourth preferred embodiment of an ink jet recording device according to the present invention.

FIG. 52 is a perspective view of a linear ink guide member of the third example of the fourth embodiment of an ink jet recording device according to the present invention. In FIG. 52, the linear ink guide member 50A is constructed so that the projecting portions 56 of the ink guide 50A as shown in FIG. 49 are connected to each other by the elongated base portion 55, in order to produce the ink guides in large quantities and to effectively assemble the ink guides. The region above a borderline 55*b* is formed on the surface of the linear ink guide member, and the whole surface of the projecting portions 56 of the ink guide 50A is covered with a conductive film.

(The Fourth Example)

Figure 53:
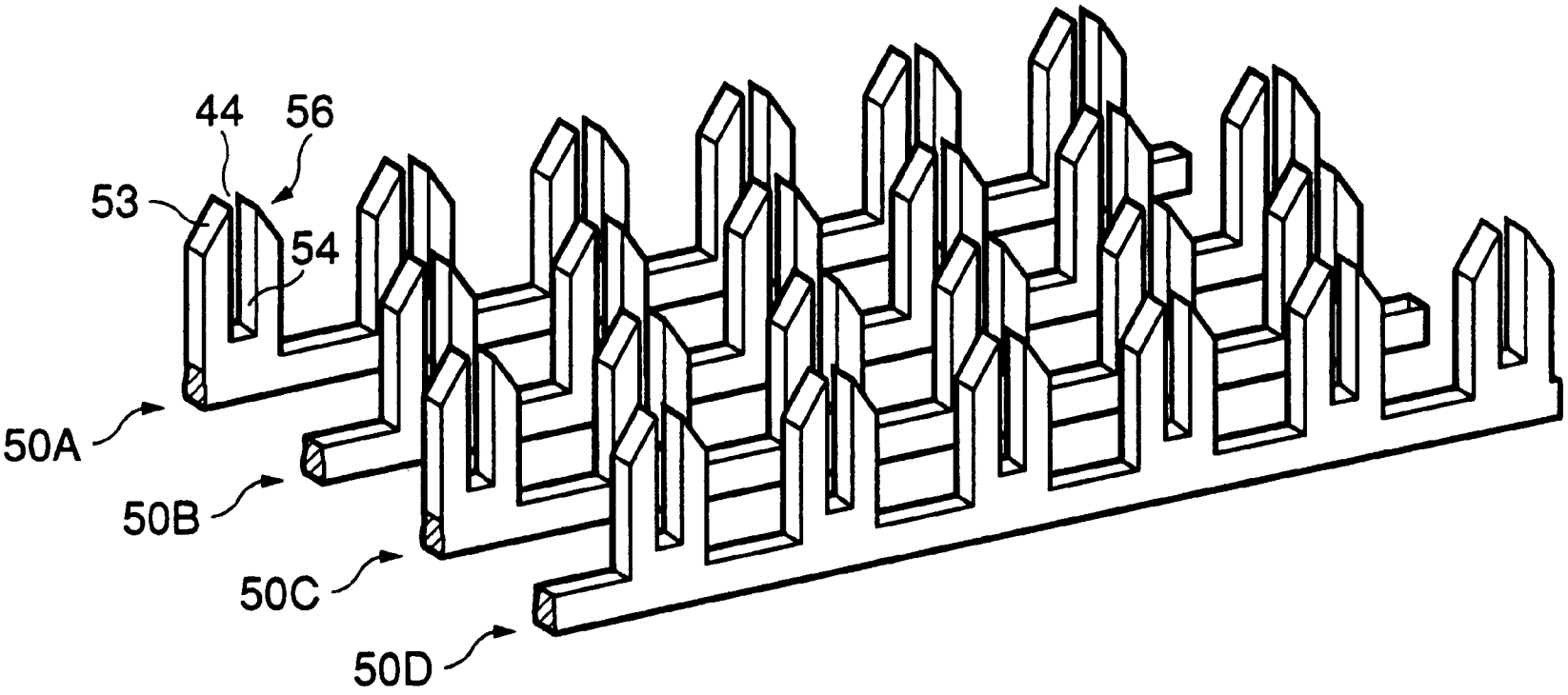
FIG. 53 is a perspective view of an ink guide of the fourth preferred embodiment of an ink jet recording device according to the present invention.

While the linear ink guide member having the elongated base portion has been formed in a row in the second and third examples, the present invention should not be limited thereto. For example, as shown in FIG. 53, a plurality of rows, e.g., four rows, of projecting ink guides 50A through 50D may be provided in the fourth example of an ink jet recording device according to the present invention. In FIG. 53, the ink guides 50A through 50D are staggered so that the adjacent rows are shifted by a fourth of pitch. Thus, in the fourth example, it is possible to increase the density of separate electrodes forming a scanning line head of the ink jet.

(The Fifth Example)

Figure 54:
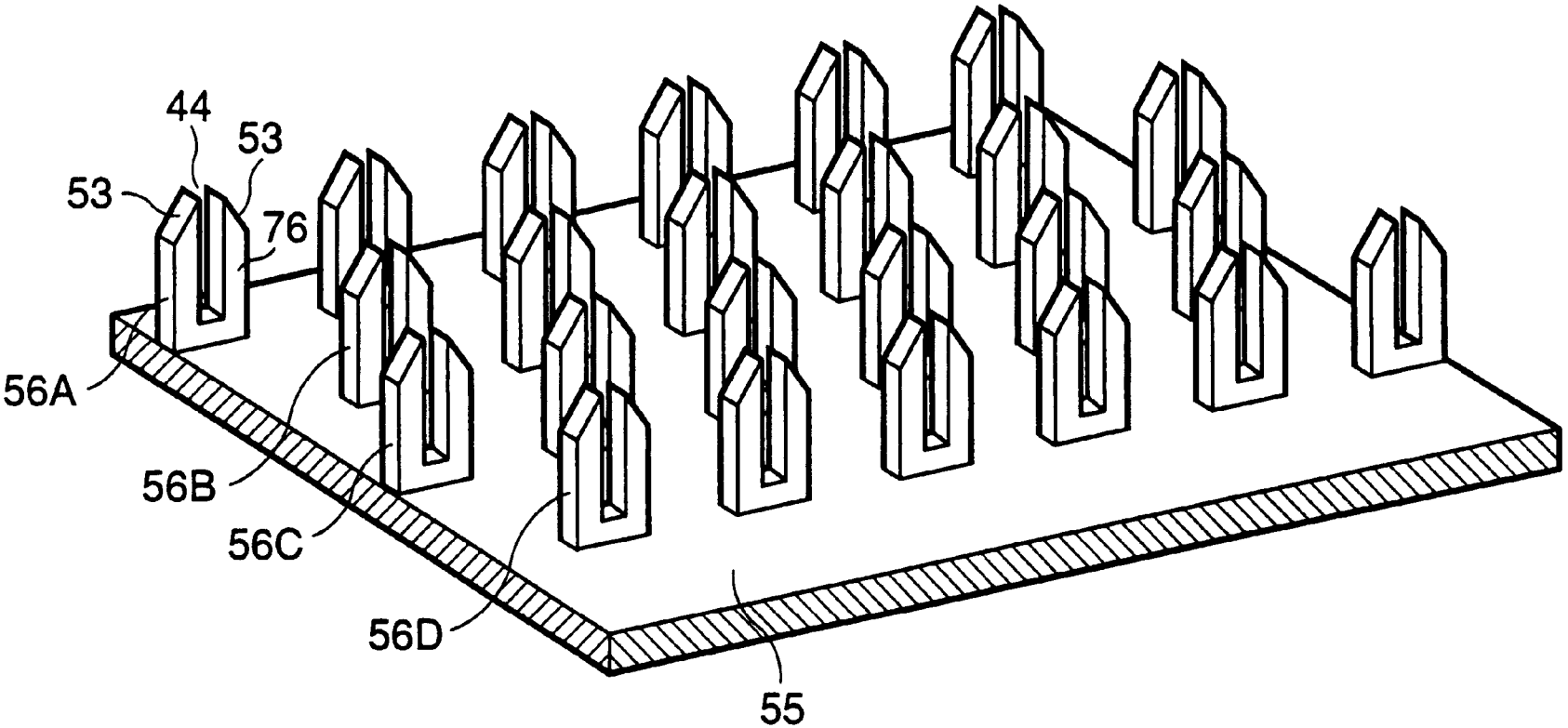
FIG. 54 is a perspective view of an ink guide of the fourth preferred embodiment of an ink jet recording device according to the present invention.

While the elongated ink guide base portion has been provided in the second through fourth examples, the present invention should not be limited thereto, but a plate-like base portion 55 may be substituted for the linear projecting portions 56A–56D as shown in FIG. 54. In the fifth example of the fourth preferred embodiment of an ink jet recording device in FIG. 54, four rows 56A–56D of projecting portions 56 of the ink guide 50 are provided on a plate-like base portion 55 of an insulating member so as to have the same arrangement as that in the fourth example of the fourth preferred embodiment.

In the second and third examples, while the conductive film have been laminated using a mask at a location to be an insulating portion after the elongated base portion has been integrally formed with a plurality of projecting ink guide in a row, the present invention should not be limited thereto. For example, the base portion and the projecting members may be formed of an insulating member and conductive members, respectively, and then, they may be integral with each other.

(The Sixth Example)

Figure 55:
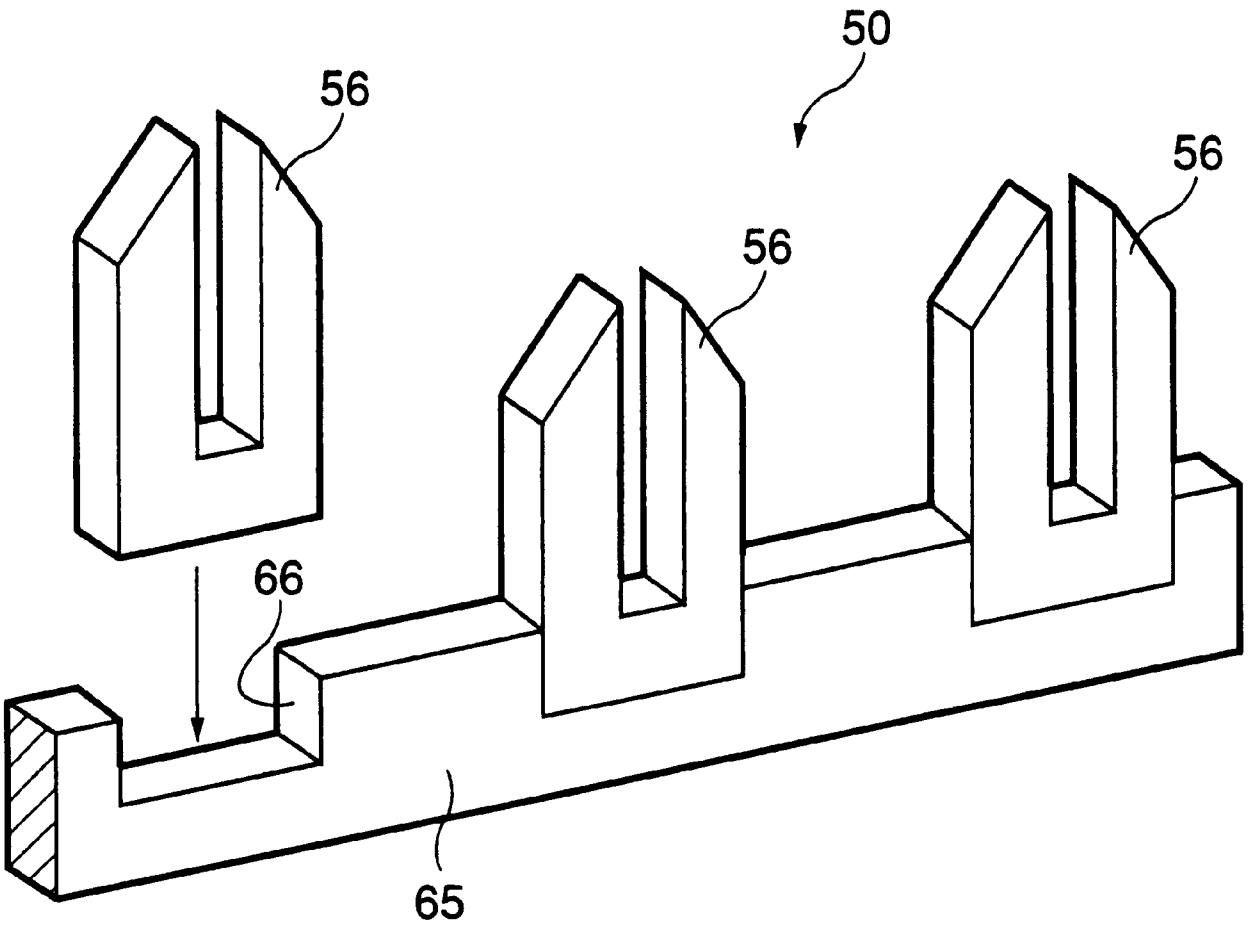
FIG. 55 is a perspective view of an ink guide of the fourth preferred embodiment of an ink jet recording device according to the present invention.
Figure 56:
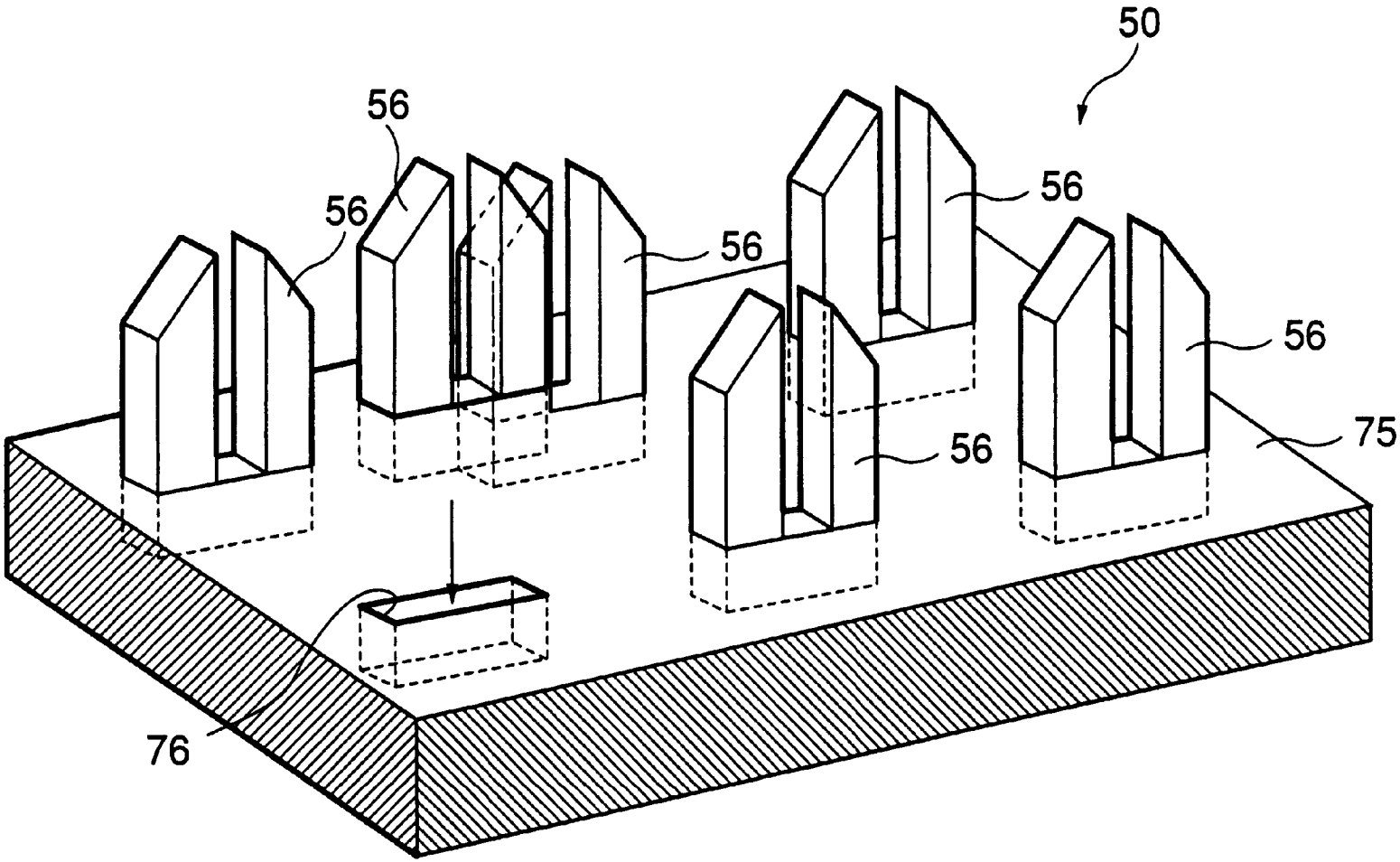
FIG. 56 is a perspective view of an ink guide of the fourth preferred embodiment of an ink jet recording device according to the present invention.

In the sixth example of the fourth preferred embodiment shown in FIG. 55, an ink jet recording device includes an insulating elongated base portion 65 having a plurality of engaging portions 66 formed at regular intervals, and a plurality of projecting portions 56, each engaging the corresponding engaging portion 66. If the operation for inserting the projecting ink guide 50 into the engaging portion 66 is automatically carried out, it is possible to relatively easily form an elongated linear ink guide member 11.

(The Seventh Example)

The ink guide formed by engaging the projecting ink guides into engaging portions of the insulating base portion should not be limited to a linear ink guide member having an elongated base portion, but it may be applied to a plate-like ink guide having a plate-like base portion. That is, as in the seventh example of the fourth preferred embodiment shown in FIG. 56, engaging portions 76 may be formed in an insulating plate-like base portion 75 at regular intervals in longitudinal and lateral directions, and conductive projecting portions 56 of the ink guide 50 may be fitted into the engaging portions to form a plate-like ink guide member 50.

FIFTH EMBODIMENT

(The First example)

The first example of the fifth preferred embodiment of an ink jet recording device, according to the present invention, will be described below.

Figure 57:
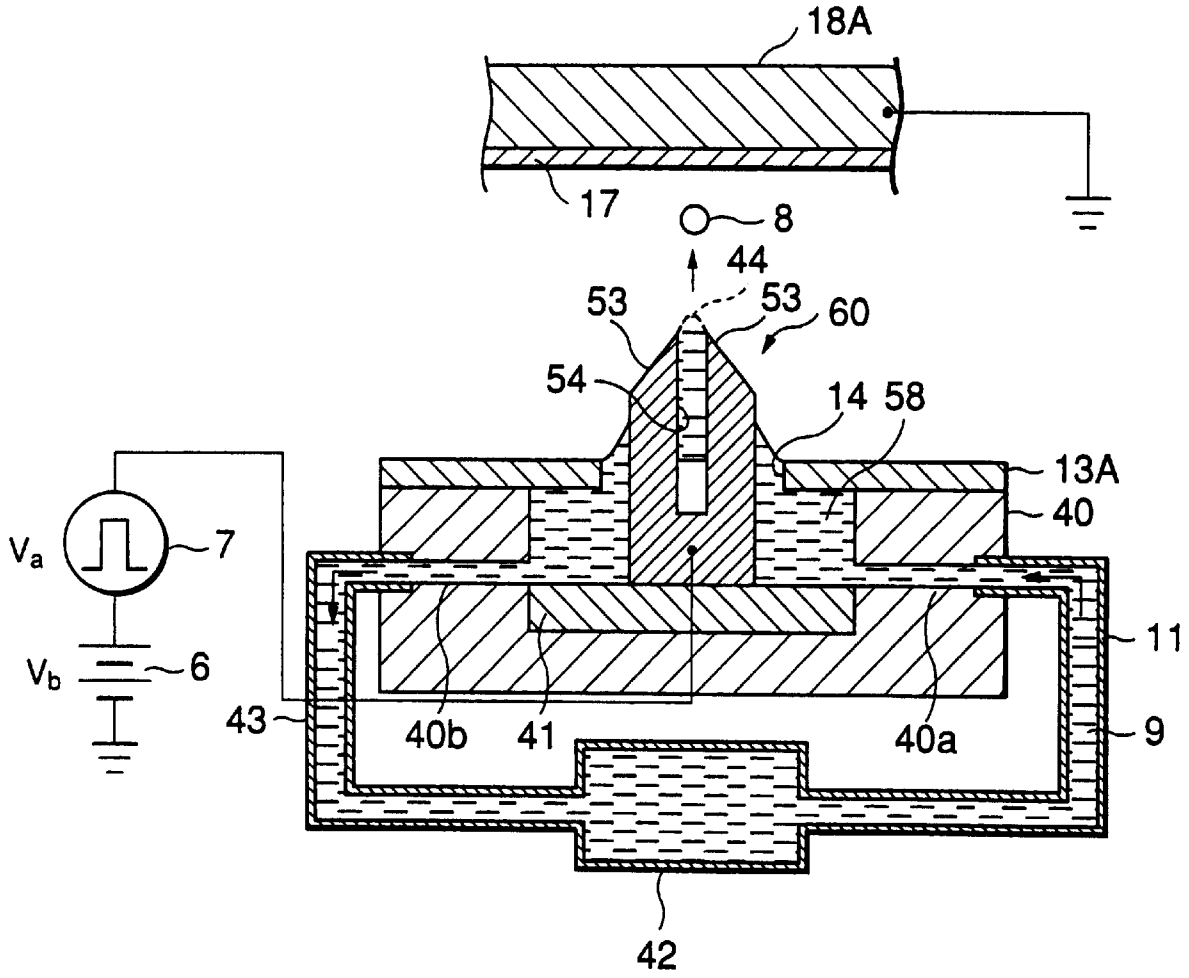
FIG. 57 is a sectional view of an ink jet head portion and a principal part of the fifth preferred embodiment of an ink jet recording device according to the present invention.

FIG. 57 is a sectional view of the first example of the fifth preferred embodiment of an ink jet recording device according to the present invention, which shows a cross section of portions surrounding one of separate electrodes 60. In FIG. 57, an ink 9 comprises: a coloring material component having a positive charge, a charge control agent, a binder and so forth, which are colloidally dispersed and suspended in an insulating solvent having a resistibility of not less than 108 Ωcm.

As shown in FIG. 57, the ink 9 is supplied from an ink circulating mechanism 42 containing a pump (not shown) and an ink supply pipe 11 to an ink chamber 58 between a head substrate 41 and an upper lid 13A via an ink supply passage 40*a* formed in a head block 40, and recovered in the ink circulating mechanism 42 via an ink recovery passage 40*b* formed in the head block 40 and an ink recovery pipe 43.

Figure 58:
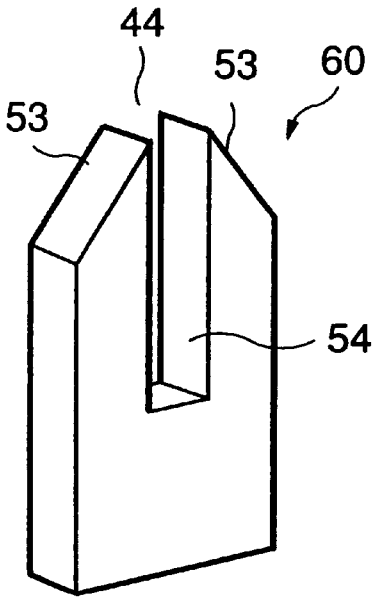
FIG. 58 is an enlarged perspective view of one of separate electrodes in the fifth embodiment.

FIG. 58 is a perspective view of the shape of each of the separate electrodes 60 in the first example of the fifth preferred embodiment of an ink jet recording device according to the present invention. Each of the separate electrode 60 is made of a plastic member or the like, on which a conductive film, such as a copper film, is formed by deposition, sputtering or the like. Each of the separate electrode 60 is supported on the head substrate 55 by predetermined means. As shown in FIG. 58, each of the separate electrodes 60 has a pair of inclined portions 53 formed by cutting the tip portion of a plate-like member having a constant thickness so that the tip portion has a triangular or trapezoidal shape, and an ink guide groove 54 having a width of about 20 to 100 $\mu$m at the center thereof. The tip portion of each of the separate electrodes 60 serves as an ink-droplet emitting position 44. Moreover, each of the separate electrode 60 projects substantially in a vertical direction from the through hole 14 by a predetermined height in the ink-droplet emitting direction.

A recording paper serving as the recording medium 17 is arranged so as to face the tip of each of the separate electrode 60. On the reverse surface of the recording medium 17 on the opposite side of the separate electrode 60, the counter electrode 18A also serving as a platen 18 for guiding the recording medium 17 is arranged.

The recording operation of the first example of the fifth preferred embodiment of an ink jet recording device, according to the present invention, will be described below.

When the recording is carried out, the ink 9 supplied from the ink circulating mechanism 42 to the ink chamber 58 via the supply passage 40*a*, is supplied to the ink emitting position 44 at the tip of the separate electrode 60 via the through hole 14 of the upper lid 13A. A part of the ink is recovered in the ink circulating mechanism 42 via the ink recovery passage 40*b*.

To the separate electrode 60, a DC voltage of, e.g., 1.5 kV, is always applied as a bias from a bias voltage source 6. In addition, a pulse voltage of, e.g., 500 V, is applied from a signal voltage source 7 to the separate electrode 60 as a signal voltage corresponding to a picture signal when it is turned on, so as to be superimposed on the bias voltage. On the other hand, the counter electrode 18A provided on the recording medium 17 is set so as to have a ground potential of 0 V as shown in FIG. 57.

Now, when the separate electrode 60 is turned on to be ON state (when 500 V is applied), i.e., when a voltage of 2 kV, which is the total of a pulse voltage of 500 V superimposed on a bias DC voltage of 1.5 kV, is applied, an ink droplet 16 containing a coloring material component emits out of the ink-droplet emitting position 44 at the tip of the separate electrode 60, and then, the ink droplet 16 is drawn by the counter electrode 18A to fly toward the recording medium 17 to form a picture thereon.

Thus, since the passage for the ink 9 is defined, the ink-droplet emitting position 44 is defined substantially at the center of the separate electrode 60, so that the coloring material component does not escape in the main scanning direction by the application of the voltage when the ink droplet flies. In addition, in this preferred embodiment, the ink 9 is carried to the through hole 14, and the ink 9 is supplied by the wetting and surface tension of the ink to the ink-droplet emitting position 44 via the surface of the separate electrode 60 projecting substantially in a vertical direction from the through hole 14 and via the ink guide groove 54 formed at the center of the separate electrode 60. Therefore, the size and position of meniscus formed at the ink-droplet emitting position 44 can be stably maintained under no influence of the pressure of the ink 9 supplied form the ink circulating mechanism 42, atmosphere and mechanical vibration, and under no influence of the interference due to the flight of the ink droplet when the adjacent dots are recorded. Therefore, it is possible to stabilize the flight of the ink droplet 8 and to record a good picture having a stable density on the recording medium 17.

(The Second Example)

Figure 59:
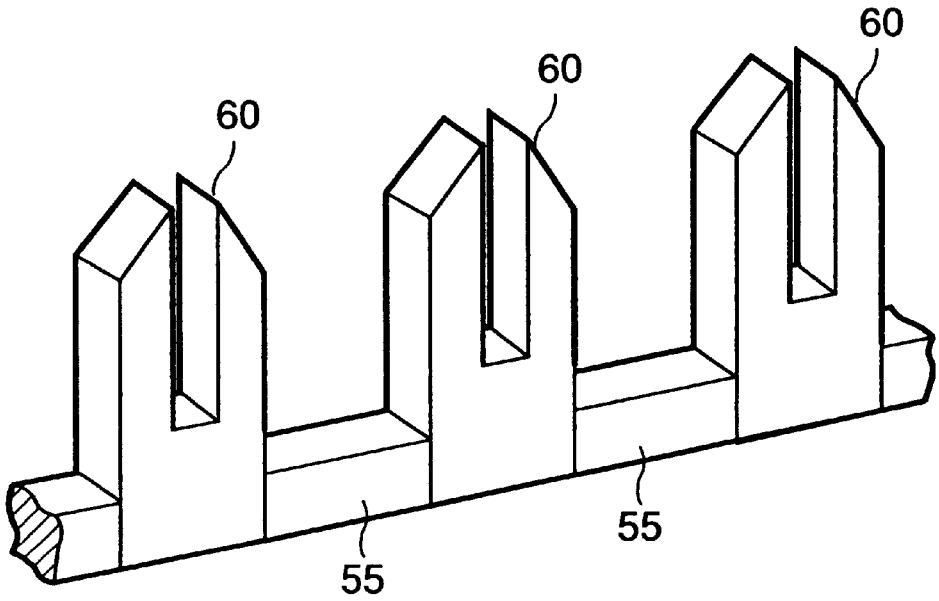
FIG. 59 is a perspective view of separate electrodes in the fifth preferred embodiment.

FIG. 59 shows an example of the arrangement of a unit of a plurality of separate electrodes 60, each of which is the same as the separate electrode 60 shown in FIG. 58, in the second example of the fifth preferred embodiment of an ink jet recording device according to the present invention. As shown in FIG. 59, the plurality of separate electrodes 60 are connected to each other by means of connecting portions 55 in order to produce the separate electrodes 60 in large quantities and to effectively assemble the separate electrodes 60. In FIG. 59, a conductive film is formed on the surface of the portion corresponding to the separate electrode 60 shown in FIG. 58 so that the respective separate electrodes are separated from each other, and each of the conductive films is electrically connected to the bias voltage source 6 and the signal voltage source 7.

Thus, the separate electrode 60 is not used by itself, and a plurality of separate electrodes 60 are connected to each other, e.g., a row of separate electrodes 60 is formed as a set, so that it is possible to quickly manufacture and assemble the electrodes. The connected separated electrodes 60 may be simply manufactured by forming the connected shape of a resin or the like shown in FIG. 59,and masking the portions corresponding to the connecting portions 55 to coat the other portions with conductive films.

(The Third and Fourth Examples)

Figure 60:
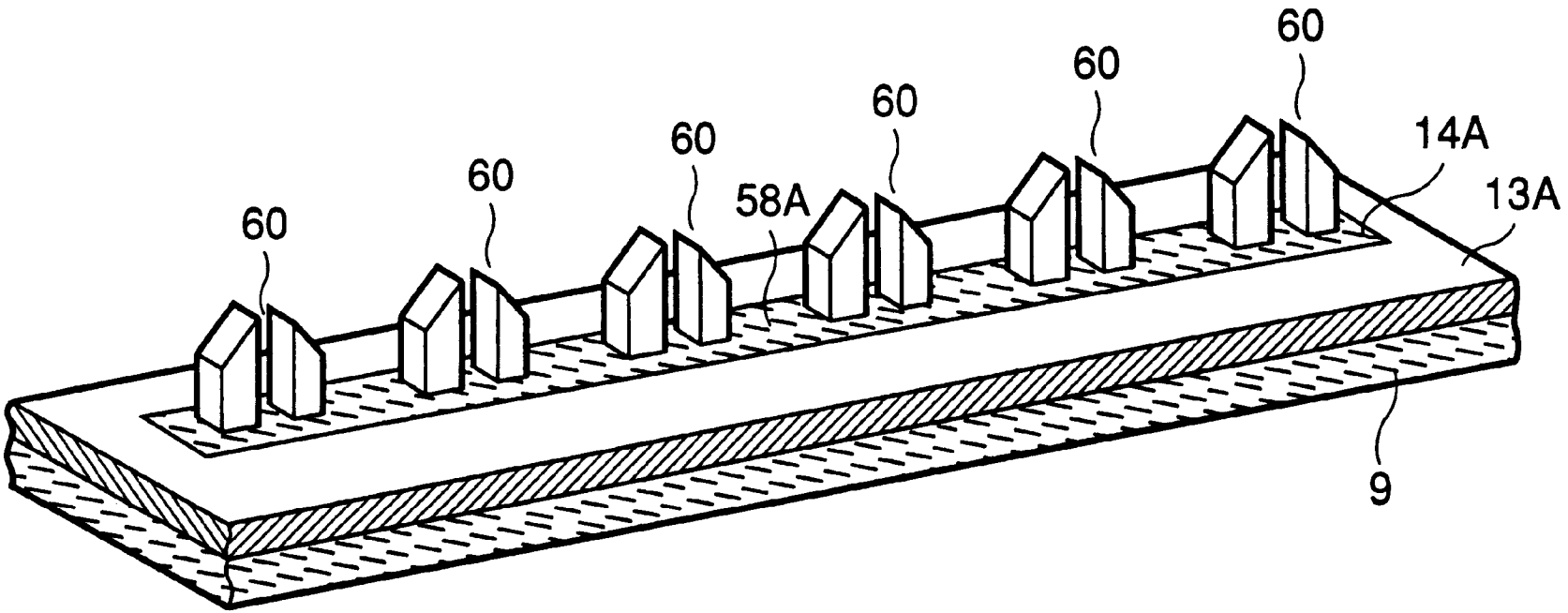
FIG. 60 is a perspective view of an ink jet head, on which a plurality of separate electrodes are aligned with each other, in the fifth preferred embodiment.
Figure 61:
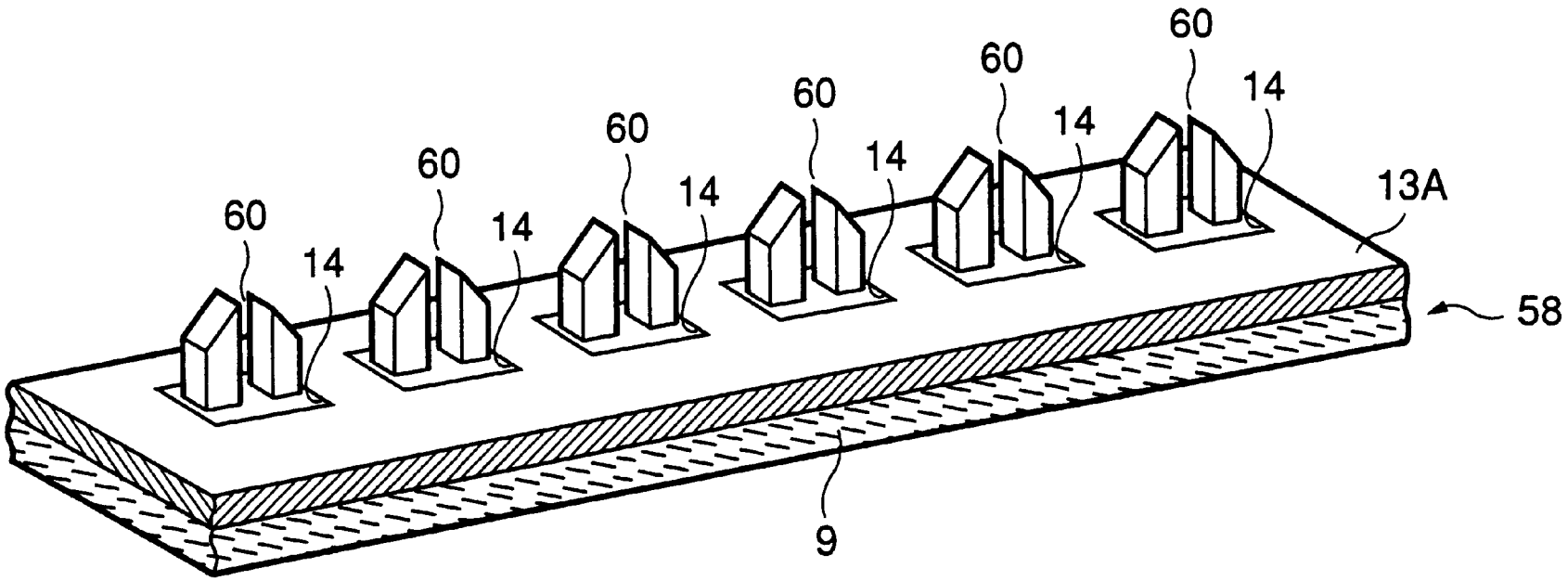
FIG. 61 is a perspective view of an ink jet head, on which a plurality of separate electrodes are aligned with each other, in the fifth preferred embodiment.

Referring to FIGS. 60 and 61, the third and fourth examples of the fifth preferred embodiment of an ink jet recording device, according to the present invention, will be described below.

FIG. 60 is a perspective view of a line head, on which a plurality of separate electrodes are arranged in a row at regular intervals, in the third example of an ink jet recording device according to the present invention. In FIG. 60, a through hole 14A serves as a common hole for a row of separate electrodes 60, and the through hole 14A has a common ink chamber 58A for the respective separate electrodes 60.

FIG. 61 is a perspective view of an ink jet head, on which a plurality of separate electrodes are arranged in a row at a regular intervals, in the fourth example of the fifth preferred embodiment of an ink jet recording device according to the present invention. In FIG. 61, a plurality of through holes 14 are formed at regular intervals so as to correspond to the respective separate electrodes 60. At this point, this preferred embodiment is different from the third example of the fifth preferred embodiment shown in FIG. 60. In both of the third and fourth examples of the fifth preferred embodiment, an upper lid 13A is formed so that an ink 9 is supplied in a direction perpendicular to the row of the separate electrodes 60 and recovered in the same direction.

(The Fifth and Sixth Examples)

Furthermore, in the above examples of the fifth preferred embodiment, while the separate electrode has been used by itself or while the separate electrodes have been arranged in a row, the present invention should not be limited thereto, a plurality of rows of a plurality of separate electrodes may be arranged so as to extends two-dimensionally in two directions, i.e., in longitudinal and lateral directions. As examples of such arrangements, referring to FIGS. 62 and 63, the fifth and sixth examples of the fifth preferred embodiment of an ink jet recording device, according to the present invention, will be described below.

Figure 62:
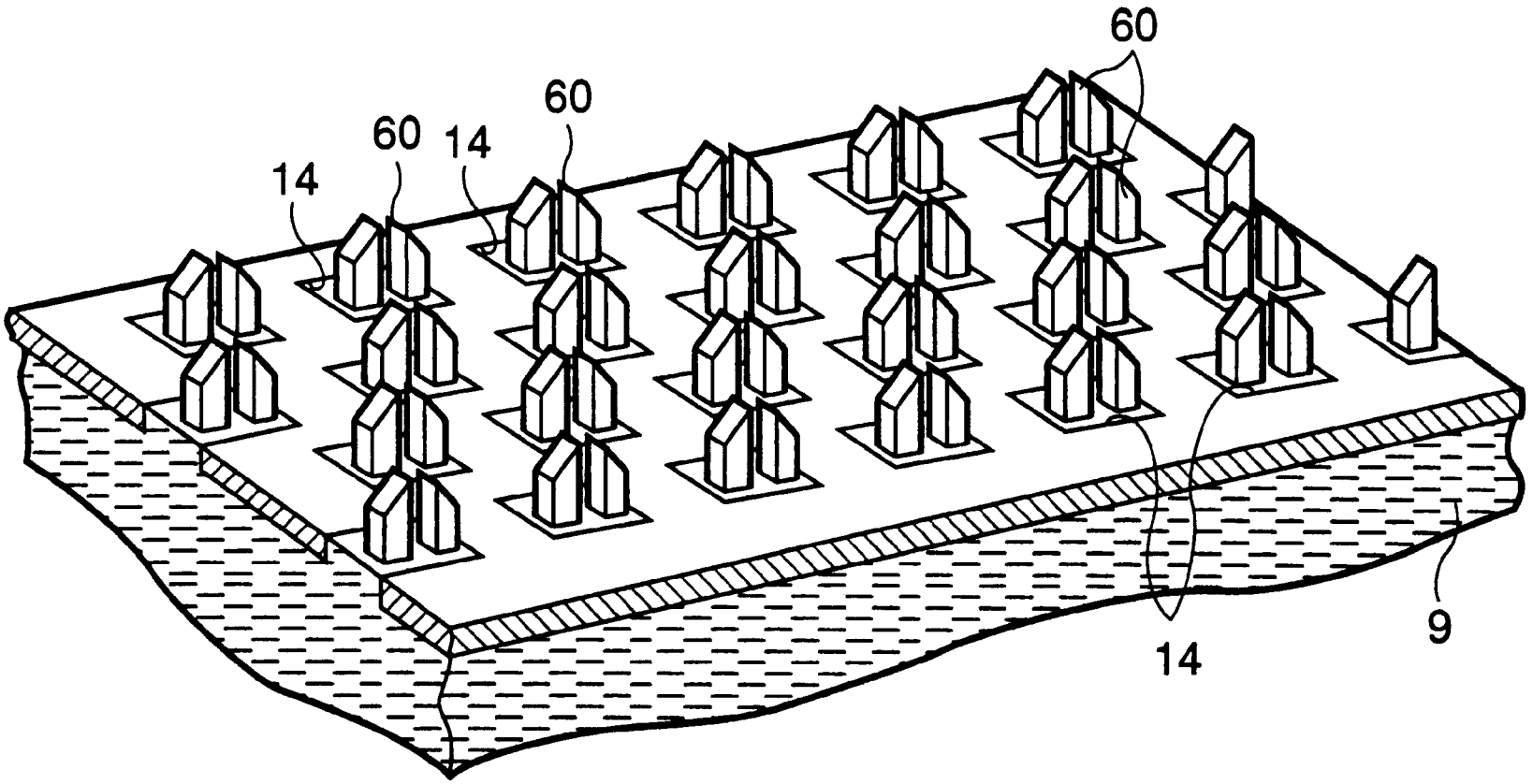
FIG. 62 is a perspective view of an ink jet head, on which a plurality of rows, each comprising a plurality of separate electrodes aligned with each other, are arranged in parallel, in the fifth preferred embodiment.

In the fifth example of the fifth preferred embodiment shown in FIG. 62, a plurality of separate electrodes 60 are arranged in a plurality of rows at regular pitches and intervals. FIG. 62 is a perspective view of such a plurality of rows of line heads viewed from the side of a recording medium 17. Similar to FIG. 61, a plurality of through holes 14 are separated from each other so as to correspond to the separate electrodes 60. Therefore, each of the through holes 14 is filled with an ink 9 so as to serve as an ink-chamber.

In the sixth example of the fifth preferred embodiment shown in FIG. 62, a plurality of rows of separate electrodes 60 are arranged so as to extend in two directions which are perpendicular to each other, i.e., in longitudinal and lateral directions, and an ink supply hole 14A is formed for each row of separate electrodes 60 extending in the longitudinal direction. In the shown example, four through holes 14A are formed for four rows of separated electrodes 60. Thus, four common slit-like through holes 14A are formed at the positions corresponding to the respective rows of separate electrodes 60. Each of the through holes 14A serves as an ink tank for a row of separate electrodes 60.

Figure 63:
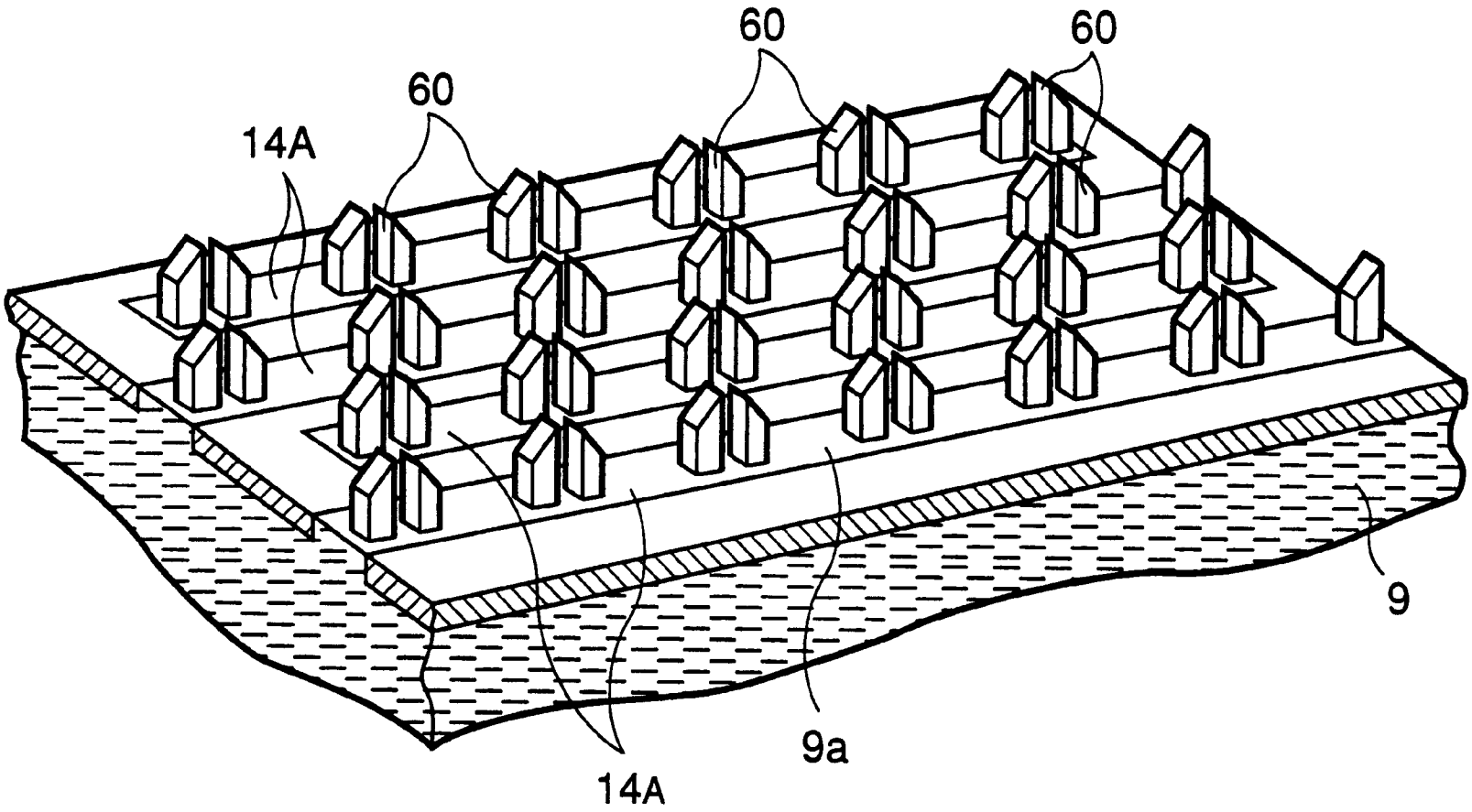
FIG. 63 is a perspective view of an ink jet head, on which a plurality of rows, each comprising a plurality of separate electrodes aligned with each other, are arranged in parallel, in the fifth preferred embodiment.

In the fifth and sixth example of the fifth preferred embodiments shown in FIG. 62 and 63, the separate electrodes 60 in a row is shifted from the separate electrodes 60 in the adjacent row by a fourth pitch so that the separated electrodes 60 are staggered. Thus, in these examples, it is possible to improve the density of separate electrodes forming a scanning line head of an ink jet.

THE SIXTH EMBODIMENT:

(The First Example)

Figure 64:
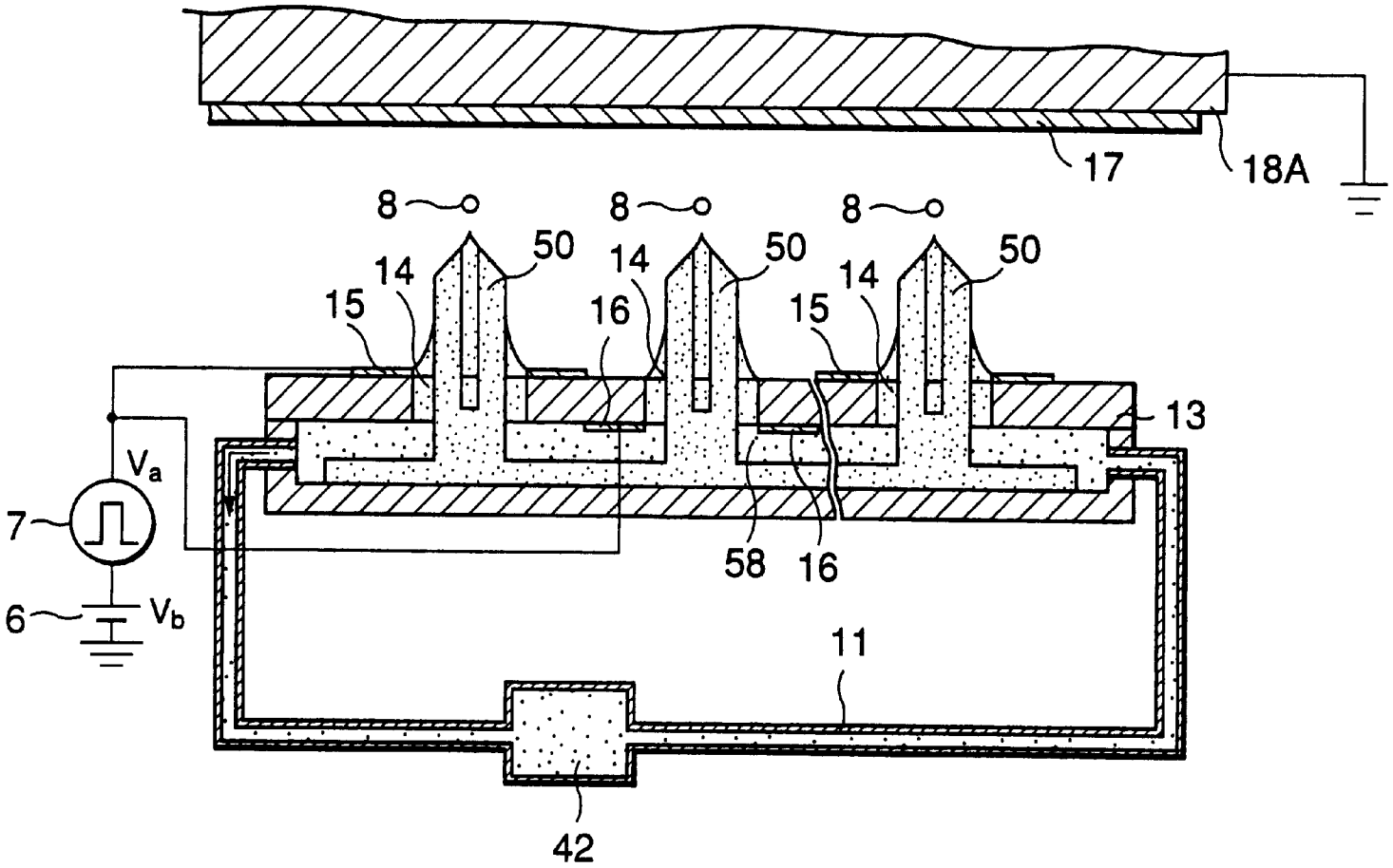
FIG. 64 is a sectional view of a recording head portion of the sixth preferred embodiment according to the present invention.

Referring to FIG. 64, the first example of the sixth preferred embodiment of an ink jet recording device, according to the present invention, will be described below.

FIG. 64 is a sectional view of a principal part of the first example of the sixth preferred embodiment of an ink jet recording device according to the present invention, which is substantially the same as the ink jet recording device shown in FIG. 18B. In FIG. 64, the same reference numbers are used for the same or corresponding elements to those of the ink jet recording device shown in FIG. 18B.

In the first example of the sixth preferred embodiment of an ink jet recording device shown in FIG. 64, first and second control electrodes 15 and 16 are formed on both sides of an insulating substrate 13. The insulating substrate 13 and the control electrodes 15 and 16 have through holes 14 for allowing ink therethrough. An ink guide 50 having a projecting portion 56 passes through each of the through holes 14 from the side of an ink chamber 58 toward a recording medium 17 in an ink emitting direction. To the control electrodes 15 and 16, a bias voltage Vb is always applied from a bias voltage source 6, and a signal voltage Va corresponding to a recording picture is superimposed from a signal voltage source 7. Since the bias voltage Vb is always applied, a liquid ink in the ink chamber 58 lightly wets the surface of the ink guide 50 and rises on the ink guide 50. When the signal voltage Va is applied, an ink droplet 8 emits out of the tip of the ink guide 50 toward a recording medium 17 which is mounted on a counter electrode 18A arranged so as to face the ink guide 50.

As shown in FIG. 64, in the first example of the sixth preferred embodiment, the control electrodes 15 and 16 are arranged on both sides of the insulating substrate 13, respectively. That is, the first control electrode 15 is provided on one surface of the insulating substrate 13 on the side of the recording medium 17 around the through hole 14, and the second control electrode 16 is provided on the other surface of the insulating substrate 13 on the side of the ink chamber 58 around the through hole 13. Thus, as shown in FIG. 65, two surfaces of the insulating substrate 13 are effectively utilized, so that the control electrodes 15 and 16, which contain annular control electrode bodies and leads for supplying voltage to the bodies, may be effectively distributed to form the through holes 14 having a higher density than that in the device shown in FIG. 18B.

Figure 65:
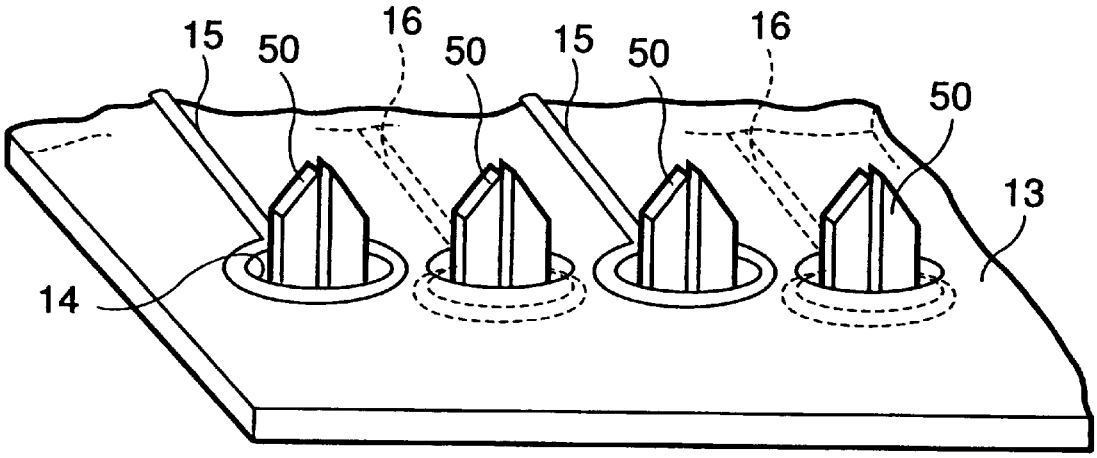
FIG. 65 is a perspective view of a recording head of the sixth preferred embodiment according to the present invention.
Figure 66:
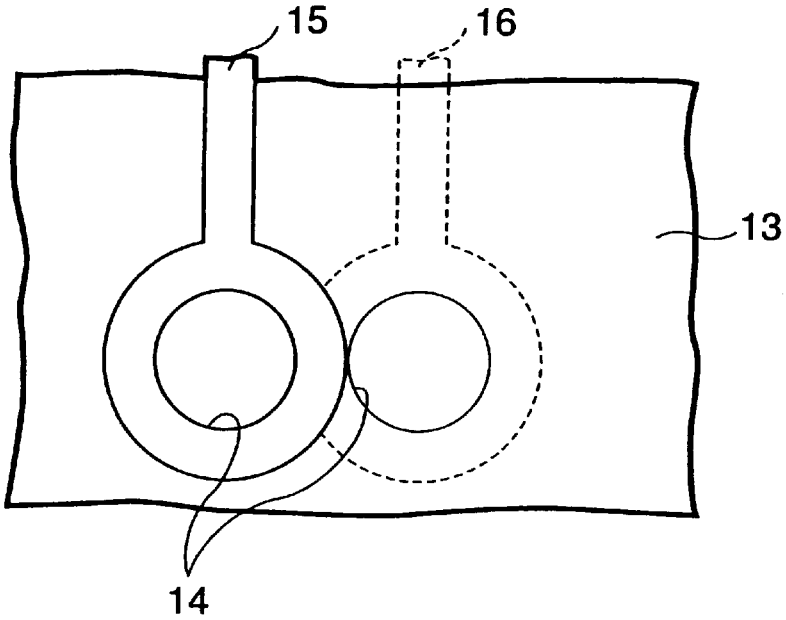
FIG. 66 is a partially-enlarged plan view illustrating an ink discharging hole in the sixth embodiment.

Furthermore, FIGS. 64 and 65 show that the control electrodes 15 and 16 are not overlapped for clear illustration. In practice, as shown in FIG. 66, the adjacent through holes 14 may approach each other so as not to damage the strength of the insulating substrate 13 when the through holes 14 are formed therein, so that the control electrodes 15 and 16 may be overlapped on both surfaces of the substrate. If there is such an overlapped portion, the efficiency of the utilized area of the insulating substrate 13 can be greatly improved, and both surface of the substrate can be sufficiently utilized.

FIG. 65 is a perspective view of FIG. 64. As shown in FIG. 65, if the electrodes are formed on both surfaces of the substrate, it is possible to arrange the electrodes so that the adjacent electrodes contact each other if the electrodes are formed on one surface of the substrate.

Figure 67:
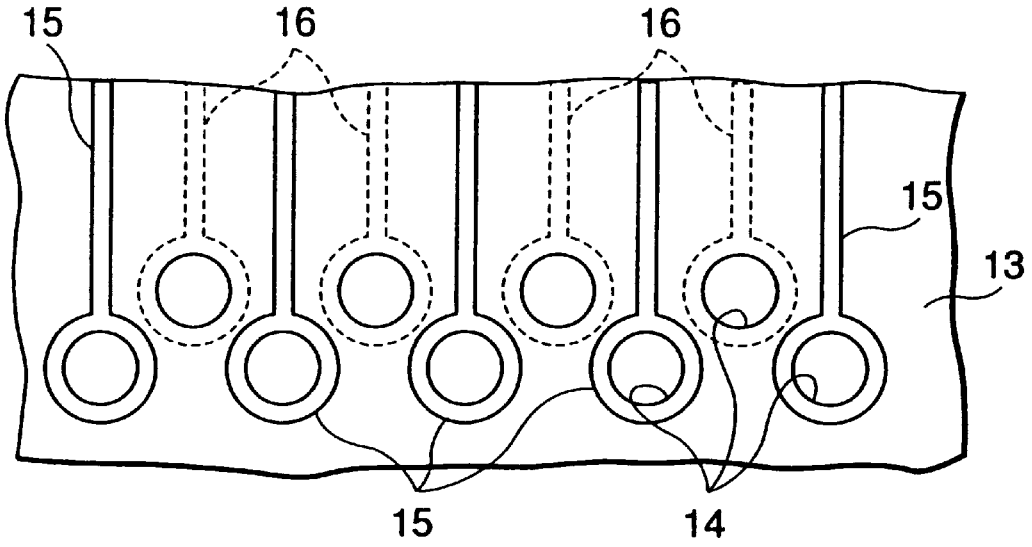
FIG. 67 is a plan view illustrating staggered control electrodes in a modification of the sixth preferred embodiment.
Figure 68:
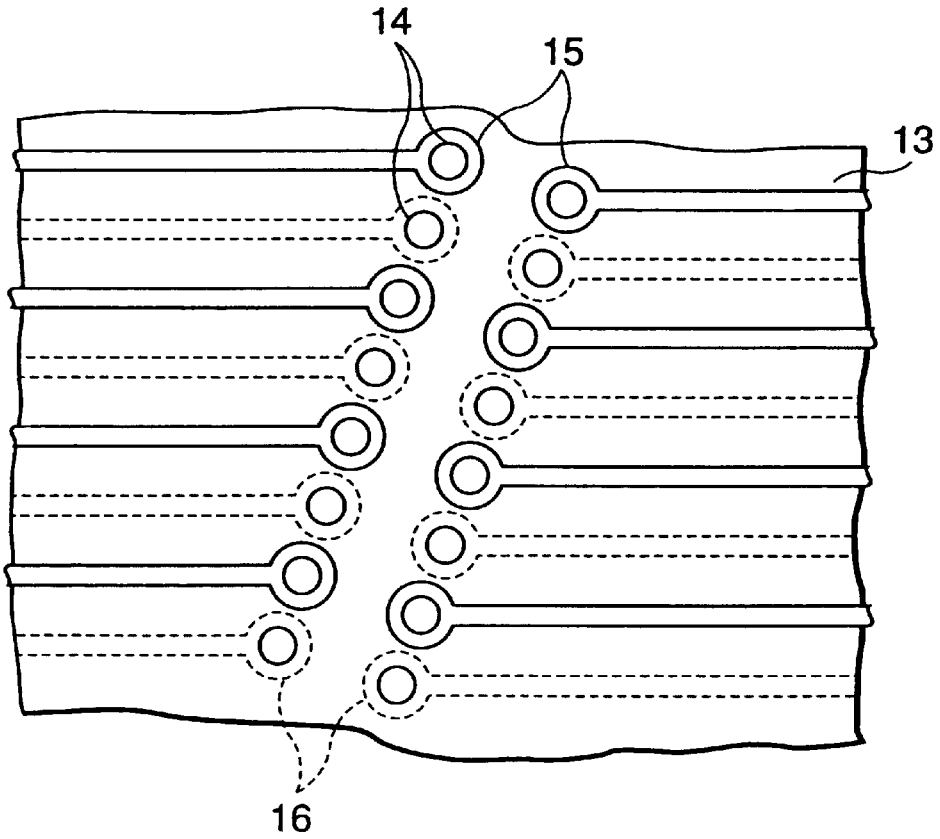
FIG. 68 is a plan view illustrating two rows of control electrodes facing each other in another modification of the sixth preferred embodiment.
Figure 69:
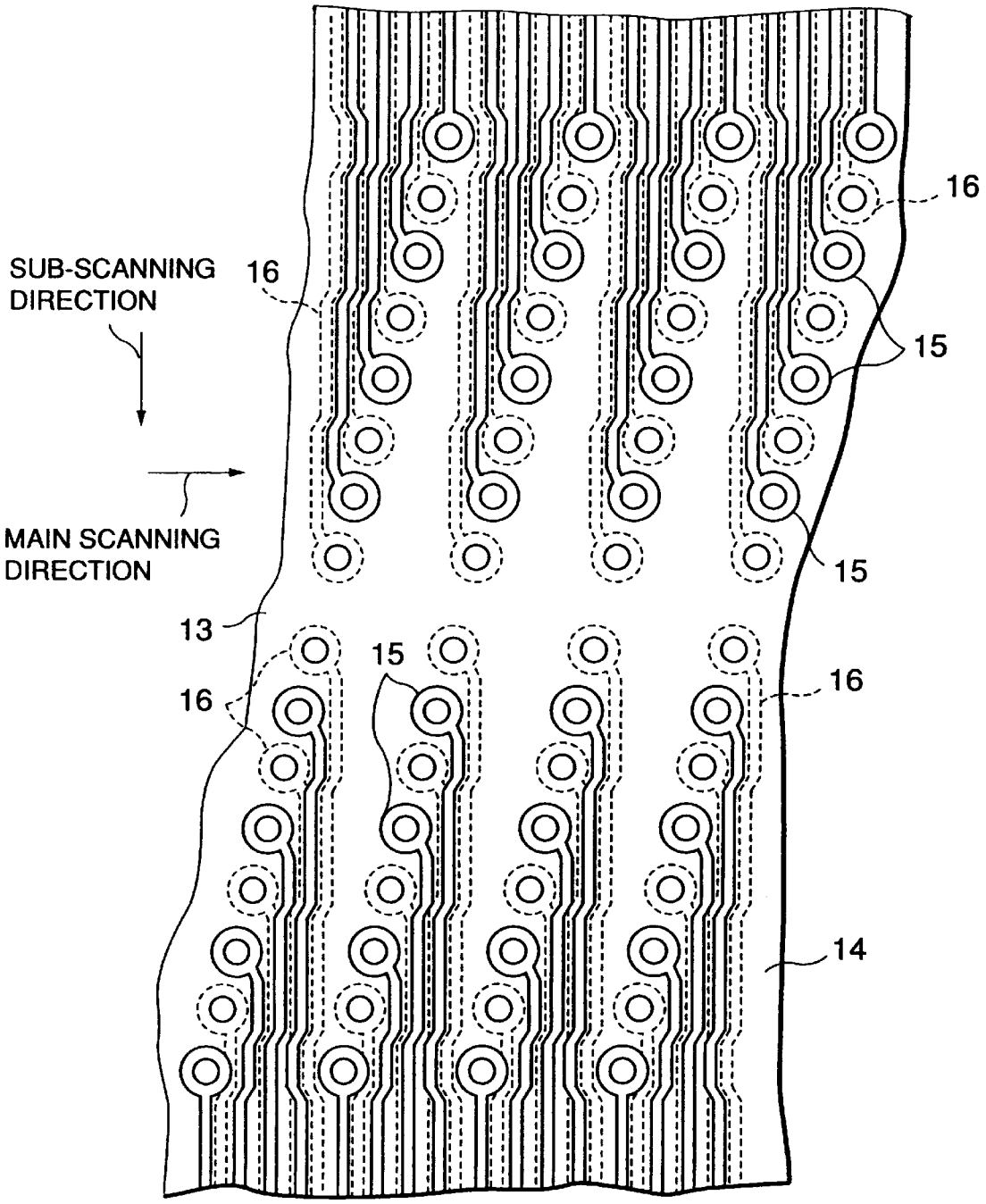
FIG. 69 is a plan view illustrating a plurality of rows, each including a plurality of control electrodes, in another modification of the sixth preferred embodiment.

FIGS. 67 through 69 show examples of modifications of the arrangement of control electrodes in the sixth preferred embodiment. In FIG. 67, the first and second control electrodes 15 and 16 are arranged so as to be staggered. For example, if the control electrodes are mutually arranged on the surface and the reverse surface of the insulating substrate 13, the pitches of the through holes 14 can be decreased, so that it is possible to form a recording head providing a high resolution.

In order to further increase the density of the control electrodes 15 and 16, the control electrodes 15 and 16 may be arranged in two rows while the lead portions are extended to both sides of the substrate. In this example, the rows of control electrodes 15 and the rows of control electrodes 16 are mutually provided on one surface of the insulating substrate 13 on the side of the recording medium and the other surface of the insulating substrate 13 on the side of the ink chamber.

In order to still further increase the density of the control electrodes, a plurality of electrodes may be arranged in parallel as shown in FIG. 69. In this case, since electrodes arranged so as to be inclined with respect to the main scanning direction are arranged in parallel so as to extend in the feed direction, the density of leads has an influence upon the increase of resolution of the head. For example, if the electrodes are mutually formed on the surface and the reverse surface of the control substrate, the density of electrodes can be increased twice as much as that of the current device.

(The Second example)

Figure 70:
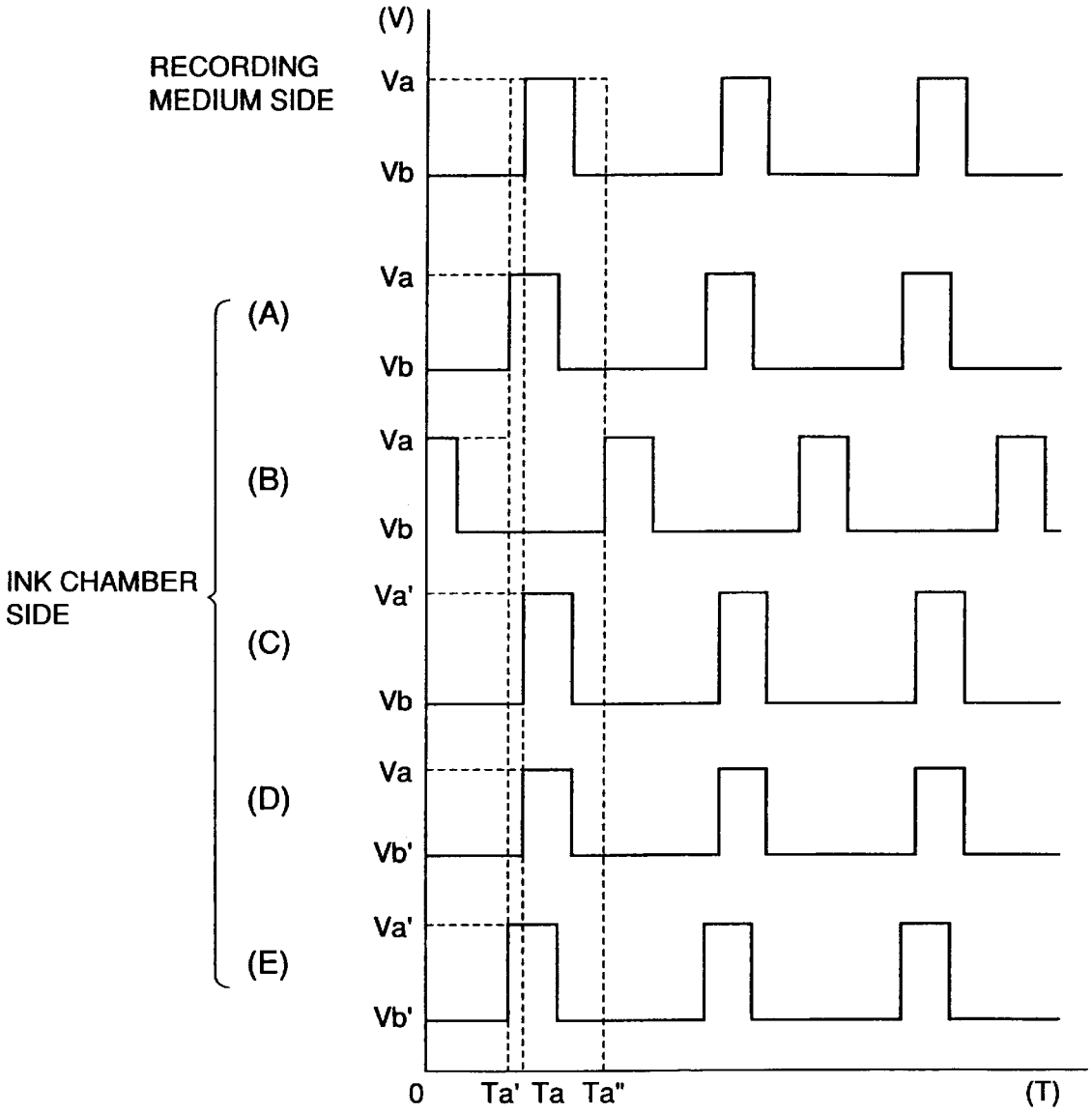
FIG. 70 is a characteristic graph showing voltage waveforms of bias and recording signals applied to control electrodes of the sixth preferred embodiment of an ink jet recording device according to the present invention.

In the first example of the sixth preferred embodiment, although the voltage values of the bias voltage and the signal voltage, which are applied to the control electrodes provided on both sides of the insulating substrate 13, are not particularly limited, the voltage values applied to the control electrodes provided on both surfaces of the insulating substrate may be different from each other since the energy amounts required to emit the ink droplet are different between the side of the recording medium and the side of the ink chamber. FIG. 70 shows voltage waveforms supplied to the second example of the sixth preferred embodiment of an ink jet recording device according to the present invention.

Referring to FIG. 70, examples of voltages applied to the respective control electrodes 15 and 16 on the sides of the recording medium 17 and the ink chamber 58 will be described. Assuming that a signal applied to the control electrode provided on the surface of the insulating substrate on the side of the recording medium has a basic waveform, the timing of the signal voltage applied to the control electrode provided on the side of the recording medium may be advanced or delayed than that of the signal voltage applied to the control electrode provided on the side of the ink chamber, as shown in the waveforms of FIGS. 70(A) and 70(B). Since the control electrode provided on the side of the ink chamber is further from the emitting point than the control electrode provided on the side of the recording medium, if the applying timing of the signal voltage applied to the control electrode provided on the side of the ink chamber is slightly advanced as shown in the waveform of FIG. 70(A), the ink-droplet emitting timings can be substantially coincident with each other. In addition, if the applying timing of which is arranged at the intermediate between the applying timings of the control electrodes on the side of the recording medium, the ink-droplet emitting timings in the adjacent ink through holes are shifted from each other, so that it is possible to prevent the electrical interference therebetween.

In addition, the values of the signal voltage and the bias voltage may be changed as shown in the wave forms of FIGS. 70(C) and 70(D). In the case of the waveform (C), although the value of the bias voltage Vb is equal to the value of the bias voltage applied to the control electrode on the side of the recording medium, the value of the signal voltage Va' applied to the control electrode on the side of the ink chamber is set to be greater than the value of the signal voltage Va applied to the control electrode on the side of the recording medium. In addition, in the case of waveform (D), the value of the signal voltage Va is set to be equal to the values of the first and second control electrodes, and the value of the bias voltage Vb' of the control electrode on the side of the ink chamber is set to be higher than the value of the bias voltage Vb applied to the control electrode on the side of the recording medium. Thus, the values of the applied voltages are different from each other to compensate the difference of distances from the ink-droplet emitting points.

Furthermore, in the second example of the sixth preferred embodiment, the waveforms (A) through (D) may be combined as shown in the waveform (E). Because the control electrode 16 on the side of the ink tank is further from the ink emitting point than the electrode 15 on the side of the recording medium by the thickness of the insulating substrate. The timing and the variation of the applied voltage are determined by the factors such as the material and the thickness of the insulating substrate.

Furthermore, in the first and second examples of the sixth preferred embodiment of an ink jet recording device shown in FIGS. 64 and 65, while the bias voltage Vb and the signal voltage Va have been superimposed to be applied to the control electrode, the present invention should not be limited, but a counter bias voltage −Vb may be applied to the counter electrode and the signal voltage Va may be applied to the control electrode. The counter bias voltage −Vb can be applied by providing an electrode on the reverse surface of the recording paper, to which a voltage of −Vb is applied, or by providing an insulating body on the reverse surface of the recording paper which is charged to be −Vb.

While only ink has existed in the ink chamber 58, an auxiliary member, such as a fiber or porous body, may be filled in the ink chamber 58. In a case where only ink exists therein, it is required to provide a mechanism for always maintaining a constant ink level. However, the porous body or fiber is filled in the ink chamber, it is possible to always maintain a constant ink emission without the need of any liquid-level maintaining mechanism since the used amount of ink is supplied by capillary force.

THE SEVENTH PREFERRED EMBODIMENT (The First Example)

The first example of the seventh preferred embodiment of an ink jet recording device, according to the present invention, will be described below.

Figure 71:
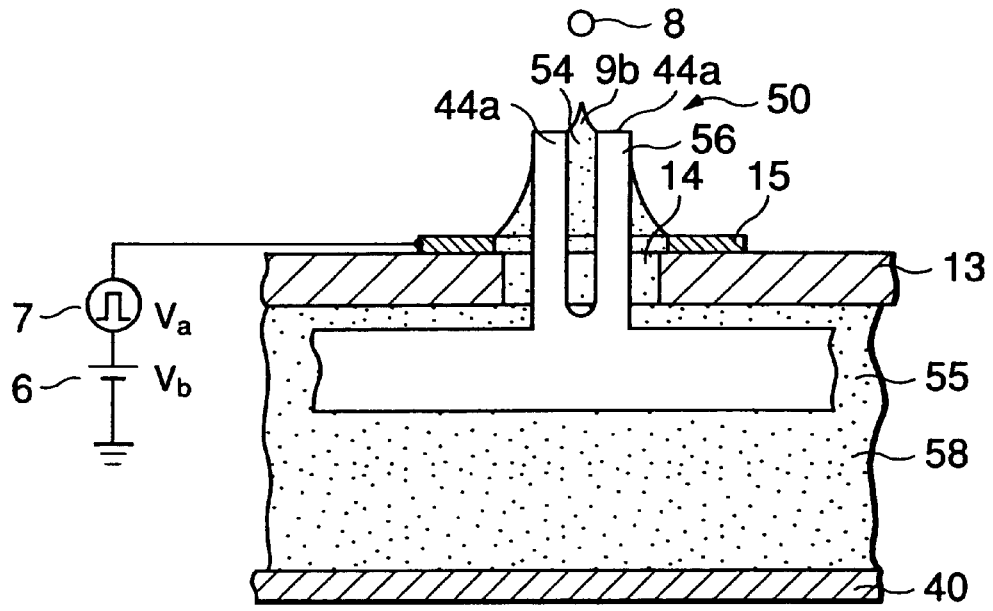
FIG. 71 is a sectional view of a principal part of the seventh preferred embodiment of an ink jet recording device according to the present invention.
Figure 72:
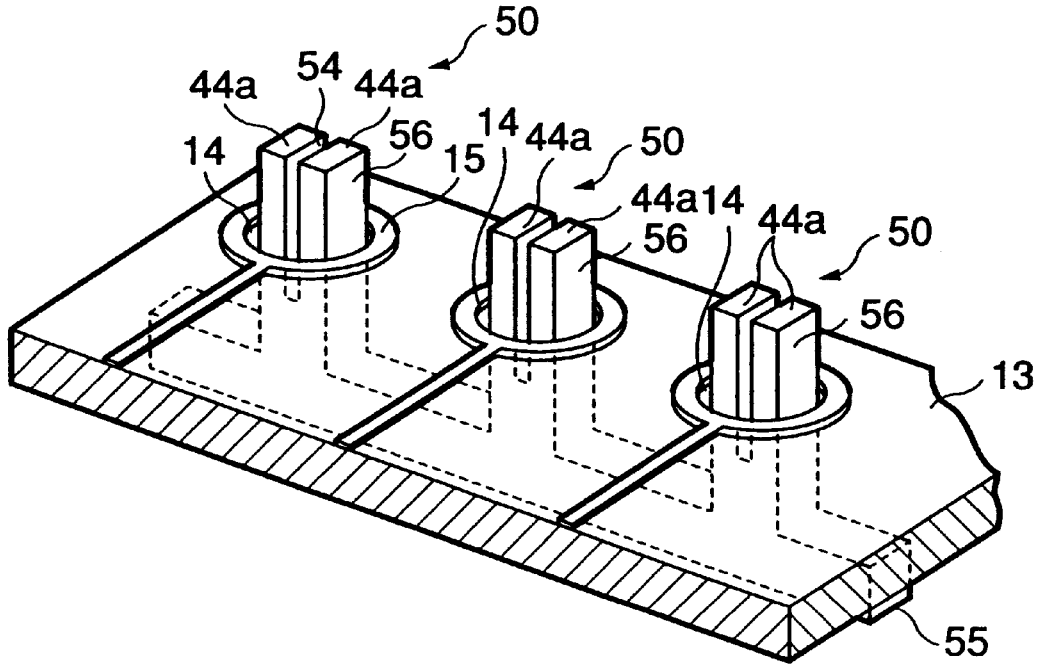
FIG. 72 is a schematic perspective view of an ink guide in the seventh preferred embodiment.

FIGS. 71 and 72 are sectional and perspective views of a principal part of the first example of the seventh embodiment of an ink jet recording device according to the present invention, respectively. In the drawings, the same reference numbers are used for the same elements as those of FIGS. 18D and 19, and the descriptions thereof are omitted.

As shown in FIGS. 71 and 72, the feature of this preferred embodiment is that the tip of the ink guide 50 is not tapered to a point unlike the tips shown in FIGS. 18D and 19. The tip portion of the projecting portion 56 of the ink guide 50 is formed with a flat surface 44*a*. Usually, the ink guide 50 is made of a resin. The length of the projecting portion is in the range of from 300 to 400 μm, the width thereof is about 20 μm, the width of the ink guide groove 54 is in the range of about 40 to 60 μm, and the thickness of the projecting portion is about 100 μm. The projecting portion is formed by accurately working a polyether sulphone or polyimide film by a laser. In this preferred embodiment, since the tip of the projection portion of the ink guide is flat, the strength of the projection portion is increased, so that it is possible to suppress the tip of the projecting portion from being deformed by force.

Moreover, in the first example of the seventh embodiment of an ink jet recording device shown in FIG. 71, since the tip of the projecting portion 56 of the ink guide 50 has the flat surface 44*a*, it is difficult to damage the projecting portion 56 of the ink guide 50, so that the physical methods for removing the clogging can be used. Specifically, the projecting portion 56 may be cleaned by directly rubbing the projecting portion 56 by means of a wiper of a soft fur such as a brush. Alternatively, when it is sucked by an aspirator such as a vacuum pump, a simple unit may be used without considering the deformation of the tip of the projecting portion. Moreover, even if the paper jam occurs and the tip of the projecting portion contacts the paper, the deformation of the tip of the projecting portion can be prevented unless the tip of the projecting portion is rubbed by a very great force.

Furthermore, if this preferred embodiment is combined with the invention disclosed in FIGS. 33A through 47 of the instant application, the advantageous effects can be improved. In the invention disclosed in this application, an ink guide is reciprocated from the through hole. When the recording is carried out, the ink guide is protruded from the through hole for recording, and when the recording is not carried out, the ink guide is housed in an ink chamber. Thus, the relative position of the ink guide 50 to the control electrode substrate 12 is changed so that the tip of the projecting portion 56 is protruded from the insulating electrode 13 toward the recording paper when the recording is carried out and the tip of the projecting portion 56 is moved downwards below the insulating substrate 13 when the recording is not carried out.

When the projecting portion is immersed in the ink, the ink coloring material adhered to the projecting portion is immersed in the solvent again, so that the coloring material is dissolved in the solvent to clean the tip of the ink guide. That is, the cleaning effects can be improved in comparison with each of the inventions. In this case, it is required to protrude and retract the ink guide 50 with respect to the through hole 14 formed in the insulating electrode 13. According to the first example seventh preferred embodiment, since the tip of the projecting portion 56 has a flat surface 44*a*, it is difficult to deform the tip of the projecting portion even if the tip of the projecting portion 56 contacts the edge of the through hole 14 when the ink guide 50 is moved upwards and downwards.

(The Second Example)

Figure 73:
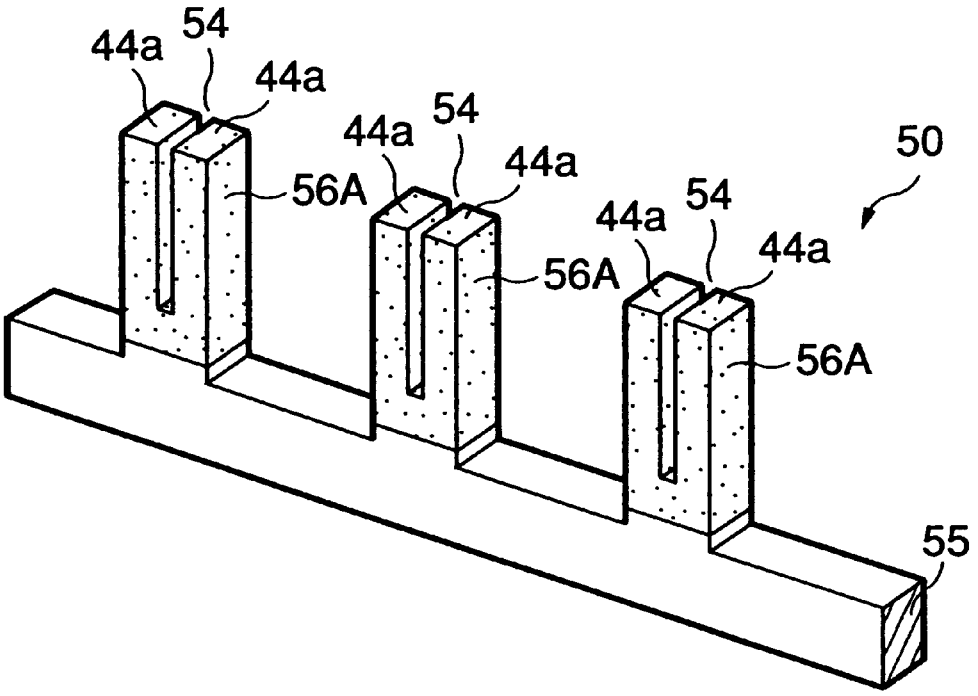
FIG. 73 is a perspective view of an ink guide of the seventh preferred embodiment of an ink jet recording device according to the present invention.
Figure 74:
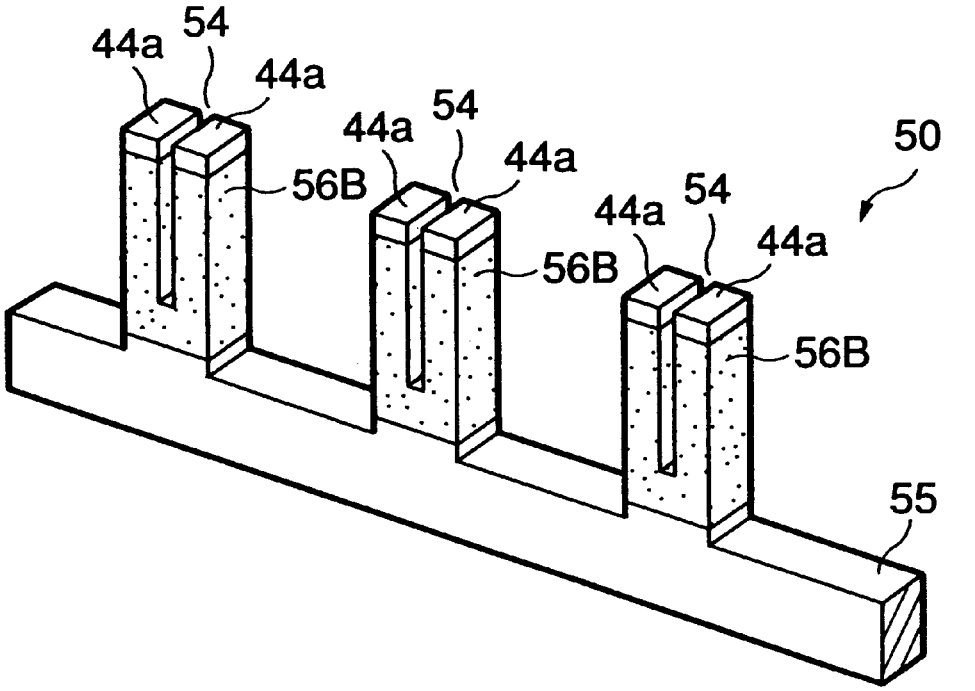
FIG. 74 is a perspective view of a modification of an ink guide of the seventh preferred embodiment of an ink jet recording device according to the present invention.

Referring to FIGS. 73 and 74, the second example of the seventh preferred embodiment of an ink jet recording device, according to the present invention, will be described below. FIG. 73 shows the second example of an ink guide 50 having a flat surface 44a on the tip portion of the projecting portion 56 shown in FIG. 72. As described above, the ink guide of FIGS. 71 and 72 is an insulating body of a resin such as polyether sulphone or polyimide. On the other hand, in the ink guide in the this example shown in FIGS. 73 and 74, the portions shown by the satin finished surfaces of the projecting portions 56A and 56B are conductive material such as a metal. This ink guide may be formed by forming an ink guide shown in FIGS. 71 and 72, and then applying a metal to only necessary portions by vapor deposition or plating. Furthermore, in FIGS. 73 and 74, the insulating substrate 13, the control electrode 15 and so forth are omitted.

The ink guide 50 shown in FIG. 73 may be produced by etching a metal foil to have the shape of a projecting portion, and then, forming the grounding resin portion.

If the projecting portions 56A and 56B of the ink guide 50 are of conductive materials, the electric field of the tip of the ink guide is increased. Therefore, there are advantages in that the ink is emitted easily, the recording gap is increased, the signal voltage is decreased and the recording frequency is increased. In FIG. 73, the whole projecting portion 56A is conducted, and the tip of the projecting portion 56B is insulated as shown in FIG.74.

A charged coloring material is used in the ink, and the ink is charged by applying a voltage having the same polarity as that of the charged coloring material to the control electrode. As shown in FIG. 74, if the tip is insulated, the stability of the ink emitting direction can be improved.

(The Third Example)

Figure 75:
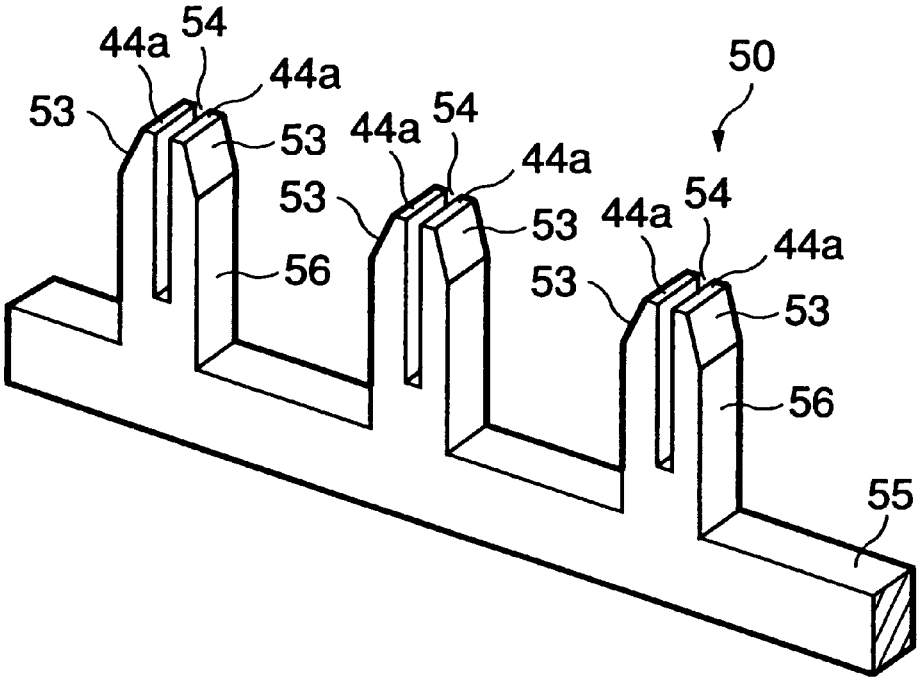
FIG. 75 is a perspective view of an ink guide of the seventh preferred embodiment of an ink jet recording device according to the present invention.
Figure 76:
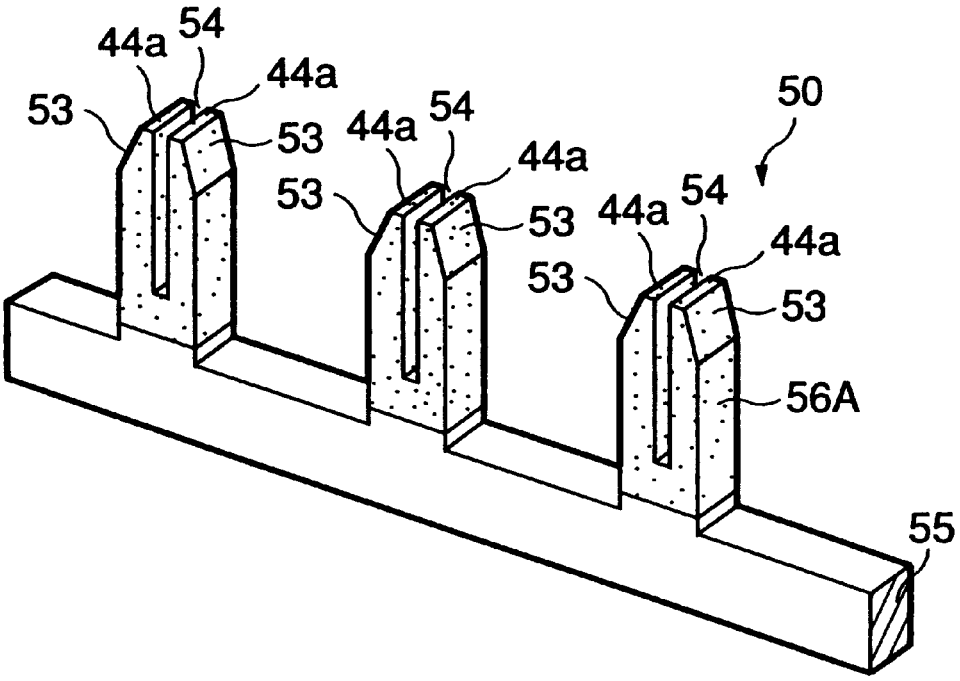
FIG. 76 is a perspective view of a modification of an ink guide of the seventh preferred embodiment of an ink jet recording device according to the present invention.

Referring to FIGS. 75 and 76, the third example of the seventh preferred embodiment of an ink jet recording device, according to the present invention, will be described below. In this example, similar to the projecting portion 56 of the ink guide 50 shown in FIG. 18D, the tip of the projecting portion has a tapered shape. However, each of the tips of the projecting portions 56 and 56A has a flat surface 44*a*. Although the width of the flat surface 44*a* is very small, i.e., about 5 to ten and several μm, the strength of the tip is greatly increased in comparison with the tip which is tapered to a point. FIG. 75 shows an example of an ink guide of a resin, which uses a control electrode 15 as shown in FIG. 72. FIG. 76 shows an example of an ink guide 50 wherein the tip portion of the projecting portion 56 is conducted. In this case, the tip of the conductive projecting portion 56 may be insulated as shown in FIG. 74. Furthermore, in FIGS. 75 and 76, the ink chamber 58, the insulating substrate 13, the control electrode 15 and so forth are omitted.

(The Fourth Example)

Figure 77:
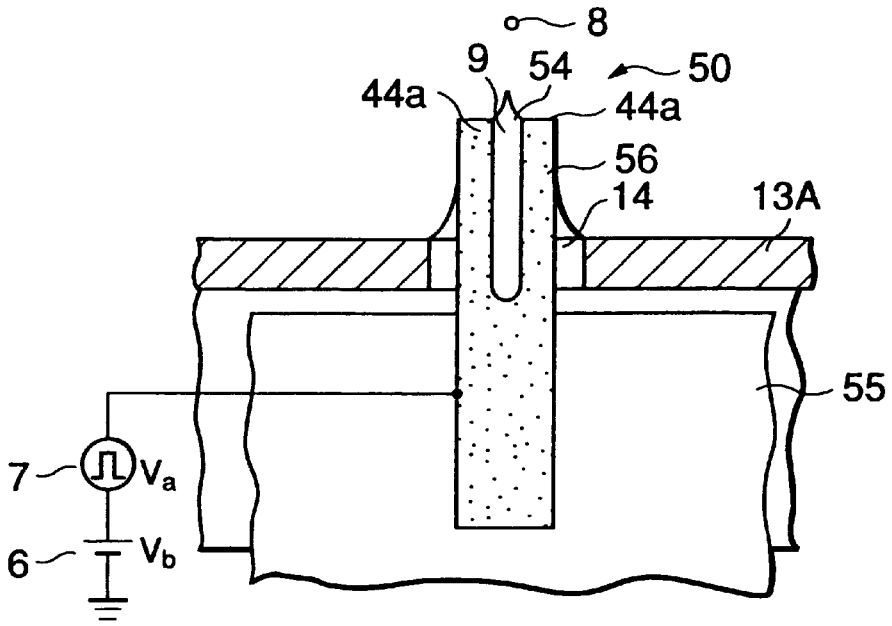
FIG. 77 is a sectional view of a principal part of the seventh preferred embodiment of an ink jet recording device according to the present invention.
Figure 78:
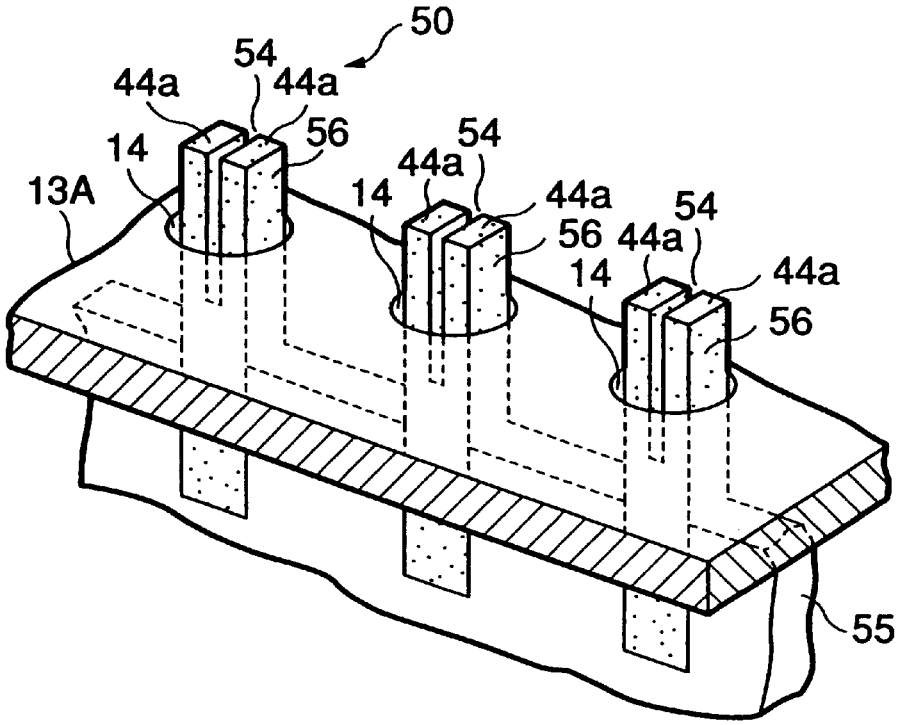
FIG. 78 is a perspective view of an ink guide of the seventh preferred embodiment of an ink jet recording device according to the present invention.

Referring to FIGS. 77 and 78, the fourth example of the seventh preferred embodiment of an ink jet recording device, according to the present invention, will be described below.

In the former examples, the ink guide 50 is basically insulated although a part is conducted in some examples, and the ink is emitted by applying voltage to the control electrode surrounding the ink guide. On the other hand, in the fourth example of the seventh preferred embodiment, the ink is emitted by directly applying voltage to a conductive ink guide without the control electrode. FIG. 77 is a sectional view of a principal part of the fourth example of the seventh embodiment of an ink jet recording device according to the present invention, and FIG. 78 is a perspective view thereof.

In FIG. 77, a projecting portion 56 of an ink guide 50 has substantially the same shape as that of the projecting portion 56 in the first example shown in FIG. 71. That is, the ink guide 50 comprises an insulating base portion 55, and the projecting portion 56 embedded in the base portion 55. The tip portion of the projecting portion 56 projects from a through hole 14 of an upper lid 13A toward a recording medium. In addition, the tip of the projecting portion 56 has an ink guide groove 54 and flat surfaces 44*a*. The whole projecting portion 56 is made of a conductive material. To the conductive projecting portion 56, a signal voltage source 7 and a bias voltage source 6 are connected.

In the first example shown in FIG. 71, the insulating substrate 13 having the control electrode 15 is used. On the other hand, in this fourth example shown in FIGS. 77 and 78, the upper lid 13A has only the through hole 14 and only serves to hold the ink. However, the projecting portion 56 of the ink guide 50 is conducted by vapor deposition or plating of a metal, and a bias voltage Vb and a recording signal voltage Va are superimposed to be applied to the conductive projecting portion 56.

The ink 9 rising trough the groove 54 by capillary force emits out, as an ink droplet, toward a recording paper by the bias voltage Vb and the signal voltage Va directly applied to the projecting portion 56 of the ink guide 50. In a case where the voltages are directly applied to the projecting portion 56 of the ink guide 50, a great voltage is exerted on the ink, in comparison with the case that the voltages are applied to the projecting portion 12 via the control electrode. Therefore, it is possible to increase the recording frequency, to decrease the recording voltage, and to increase the distance between the recording medium and the tip of the ink guide.

(The Fifth Example)

Figure 79:
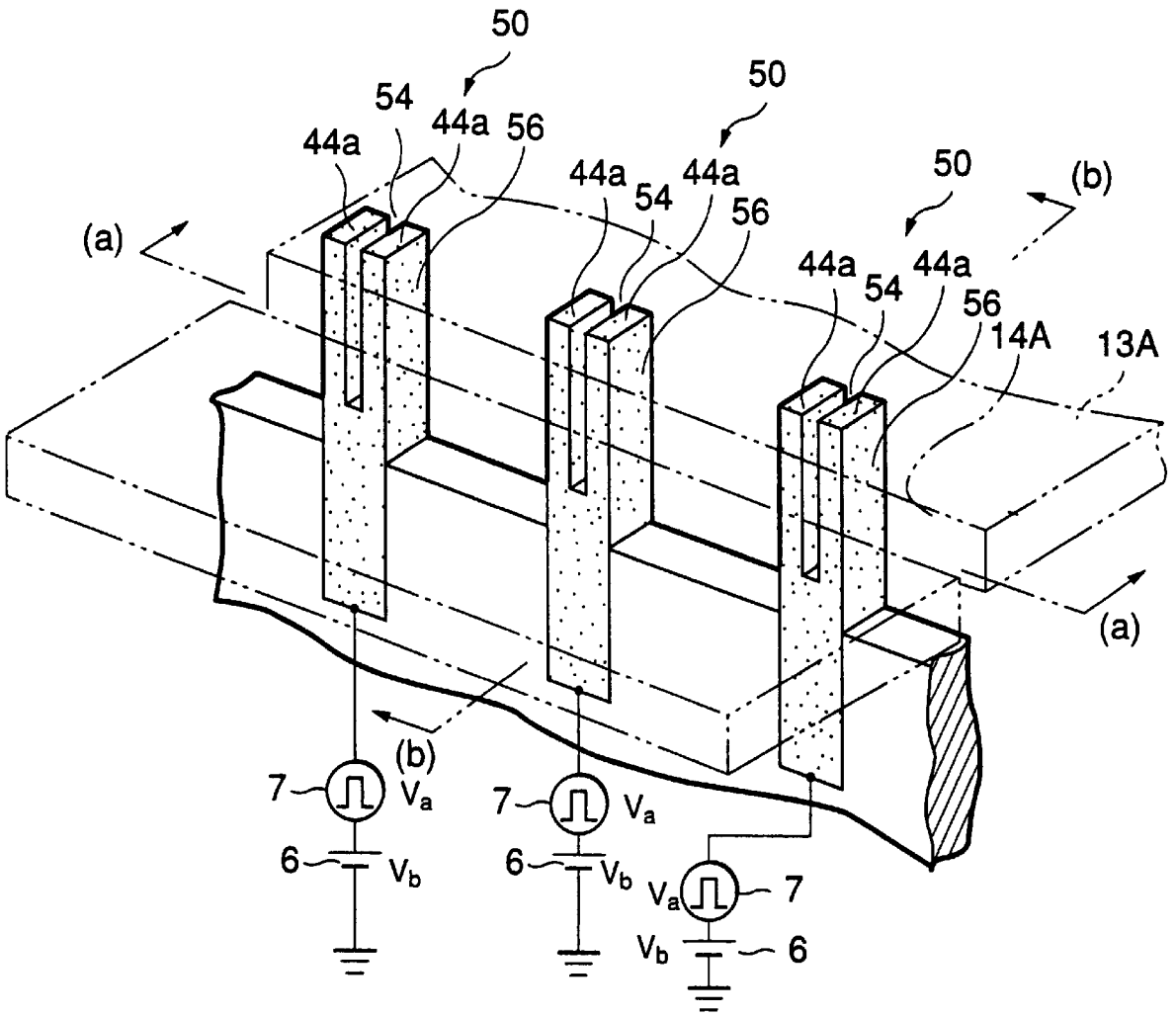
FIG. 79 is a perspective view of a modification of an ink guide of the seventh preferred embodiment of an ink jet recording device according to the present invention.
Figure 80A:
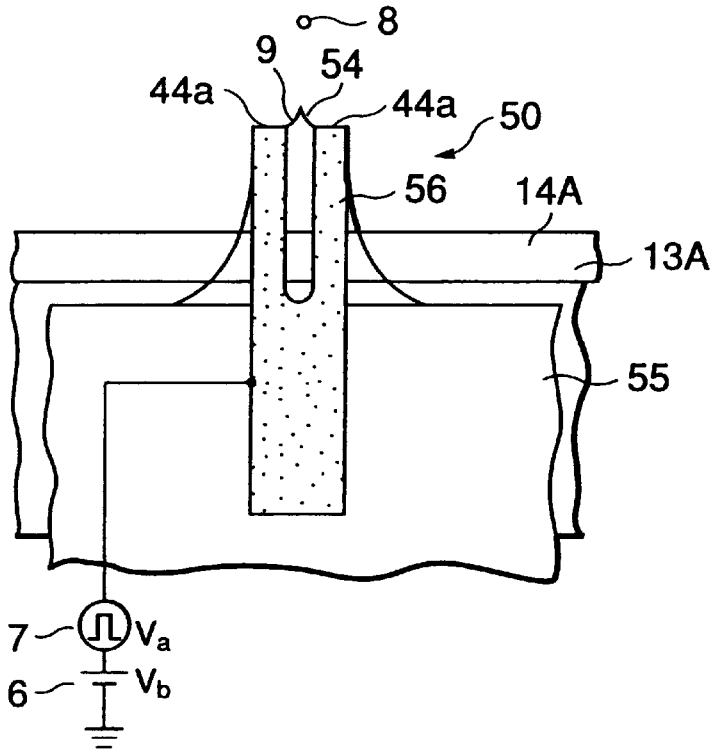
FIG. 80A is a sectional view taken along line (a)—(a) of FIG. 79.
Figure 80B:
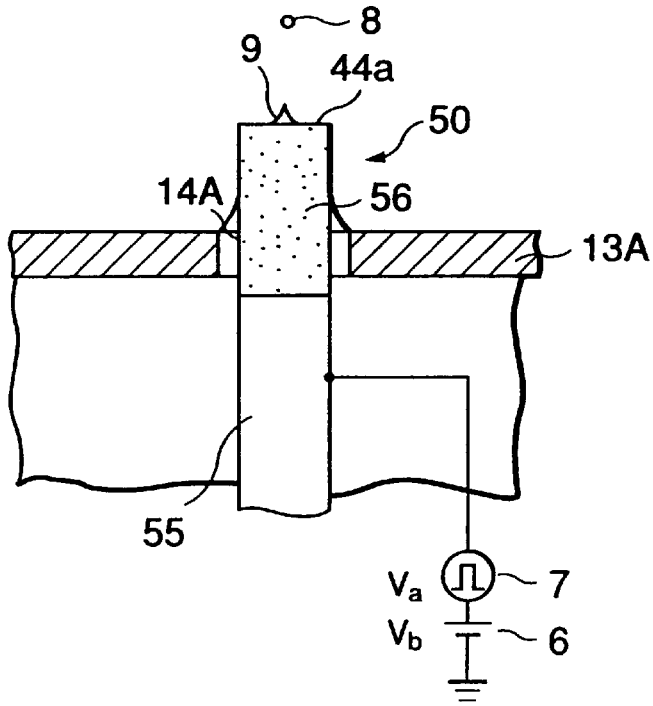
FIG. 80B is a sectional view taken along line (b)—(b) of FIG. 79.

Referring to FIGS. 79, 80A and 80B, the fifth example of the seventh embodiment of an ink jet recording device, according to the present invention, will be described below.

FIGS. 79, 80A and 80B show the fifth example of the seventh preferred embodiment of an ink jet recording device according to the present invention, in which a voltage is directly applied to an ink guide 50. When the voltage is directly applied to the ink guide 50, the upper lid 13A only serves as a lid of an ink chamber 58 for retaining an ink therein, and it is not always required to the upper lid 13A. In the fourth example, the upper lid 13A has the through hole 14. On the other hand, in this fifth example,the upper lid 13A has a slit-like opening 14A, not a through hole, as shown in FIG. 79.

FIG. 80A is a cross section taken along line A—A of FIG. 79, and FIG. 80B is a cross section taken along line B—B of FIG. 79. As can be seen from FIGS. 80A and 80B, the upper lid 13A has the slit-like opening 14A, not the through hole. In spite of the shape of the opening, since the ink rises through the ink guide groove 54 formed in the ink guide by capillary force, it is possible to emit the ink from the tip of the projecting portion 56 when the recording signal voltage supplied from the signal voltage source 7 is applied.

Comparing the hole-like opening with the slit-like opening, the latter is difficult to be clogged with ink, so that the latter is advantageous. On the other hand, the hole-like opening having a small is easy to hold the ink in comparison with the slit-like. At this point, the slit-like is advantageous, so that it is desired in view of the degree of freedom of the installed direction of the recording head and so forth. Furthermore, while FIGS. 79, 80A and 80B show that only ink is filled in the ink chamber, a porous ink retaining member may be provided in the ink chamber. Thus, it is possible to eliminate the problem with respect to the retaining of ink in a case where the slit-like opening is used.

(The Sixth Example)

Figure 81:
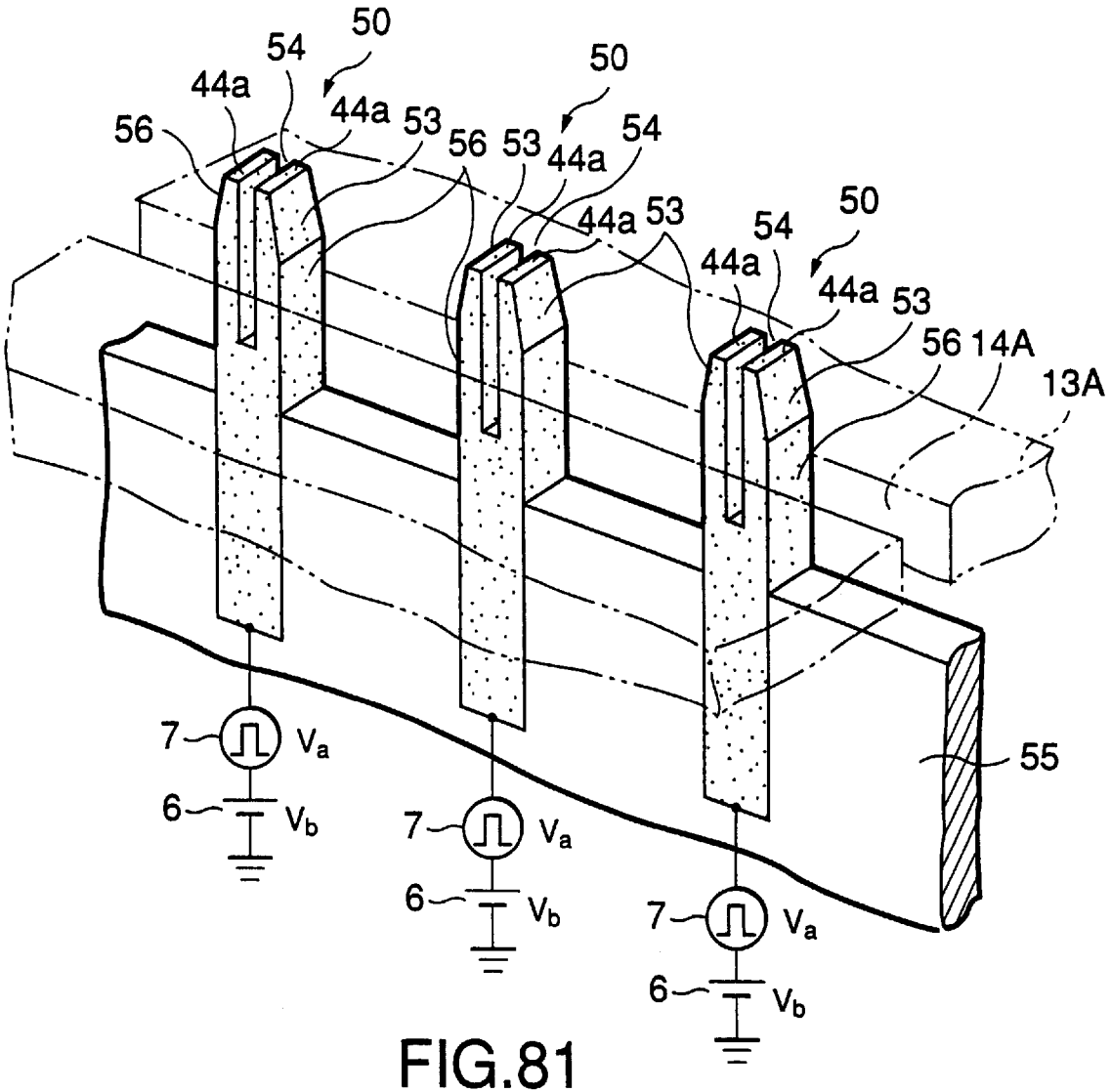
FIG. 81 is a perspective view of the seventh preferred embodiment of a recording head according to the present invention.

Referring to FIG. 81, as a modification of a recording head wherein a voltage is directly applied to a projecting portion of an ink guide, the six example of the seventh preferred embodiment of an ink jet recording device, according to the present invention, will be described below.

FIG. 81 is a perspective view of the sixth example of the seventh preferred embodiment of an ink jet recording device according to the present invention. Also in the sixth example of an ink jet recording device shown in FIG. 81, an upper lid 13A has a slit-like opening 14A. The tip portion of a projecting portion 56 of an ink guide 50 is tapered. On both sides of an ink guide groove 54, inclined surface 53 extend from flat surfaces 44*a* to the side walls.

The projecting portion 56 is made of a conductive material. To each of the projecting portions 56, a signal voltage source 7 and a bias voltage source 6 are connected. The recording voltage Va applied for causing an ink droplet to emit out of a meniscus extending from the ink guide groove of the tip portion of the projecting portion 56 to the flat surface 44*a* is supplied from the signal voltage source 7. Thus, even if the inclined surfaces 53 are formed, since the flat surfaces 44*a* are provided, the meniscus can be suitably formed, so that it is possible to surely form the ink droplet to increase the resolution.

(The Seventh through Eleventh Examples)

In the first through sixth examples in the seventh preferred embodiment, while the ink guide 50 has had the projecting portion 56, the present invention should not be limited thereto. If flat surfaces are provided on both sides of an ink guide groove of an ink guide, in which a meniscus is formed for emitting an ink droplet, a sufficient advantage can be obtained. Referring to FIGS. 82 through 86, the seventh through eleventh examples of an ink jet recording device, which has an ink guide having no projecting portion, according to the present invention, will be described below. In the example, slit-like ink supply holes are used.

First, referring to FIG. 82, the seventh example of the seventh preferred embodiment of an ink jet recording device, according to the present invention, will be described. In this example, an ink guide groove 54 is formed in a plate-like resin substrate 56 by the laser working or the like, and a metal is plated or deposited near the ink guide groove 54, so that an electrode 15 is formed. The substrate 56 is inserted into a slit-like opening 14A of an upper lid 13A. It is possible to emit an ink from the tip of the ink guide groove 54 by applying signals to the respective electrodes. Since the ink rises through the groove 54 to the tip portion of the head by capillary force, the ink droplet emits out of the tip portion when voltage is applied to the electrode 15.

Figure 82:
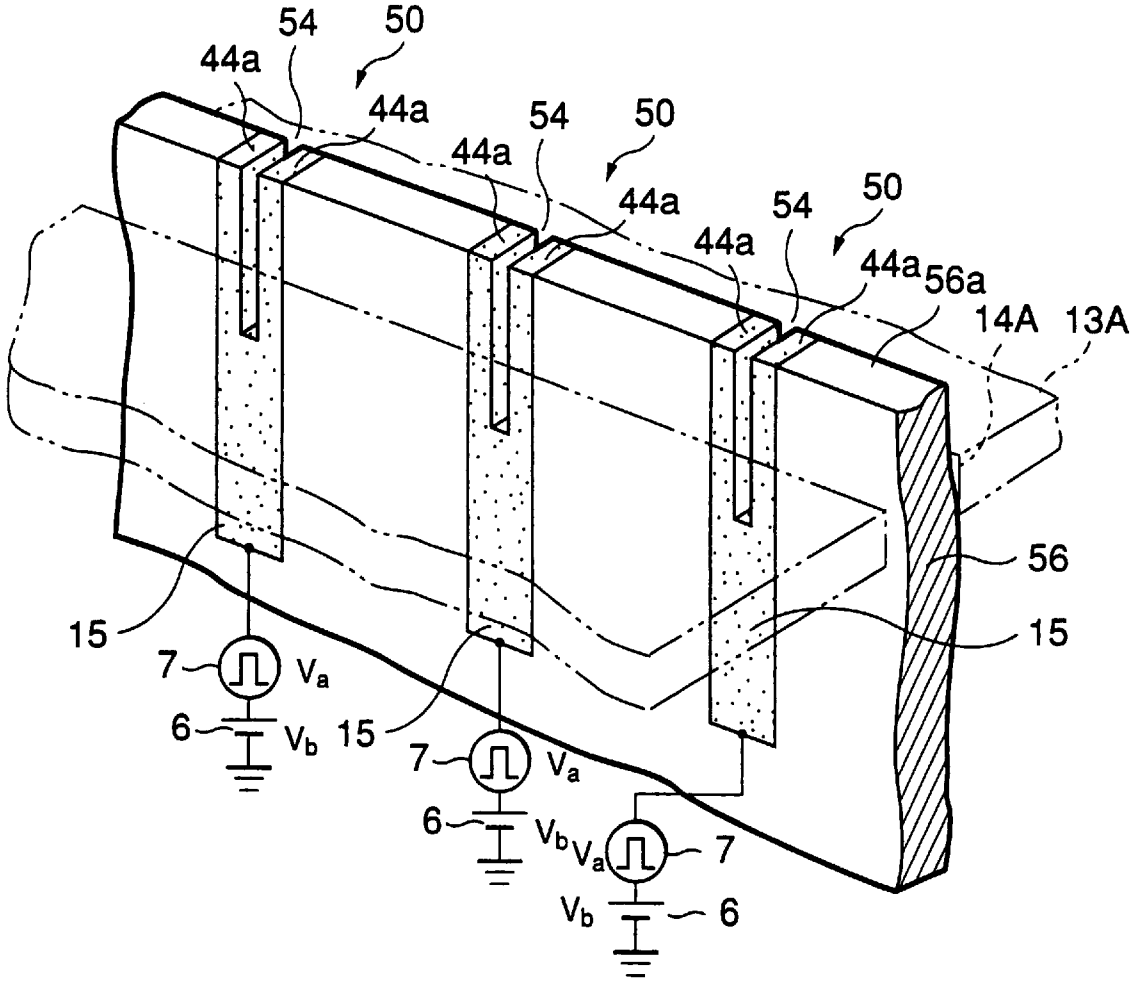
FIG. 82 is a perspective view of the seventh preferred embodiment of a recording head according to the present invention.

In the seventh example shown in FIG. 82, the tip surface of the resin substrate 56 containing the electrode 15 is flat and has no projecting portion, so that there is no problem even if a great physical force is applied to the head. For that reason, if the ink is adhered to the tip portion, it is possible to clean the head by rubbing the tip portion by means of a blade or the like. Even if the paper jam occurs, the tip of the head is not damaged.

Figure 83:
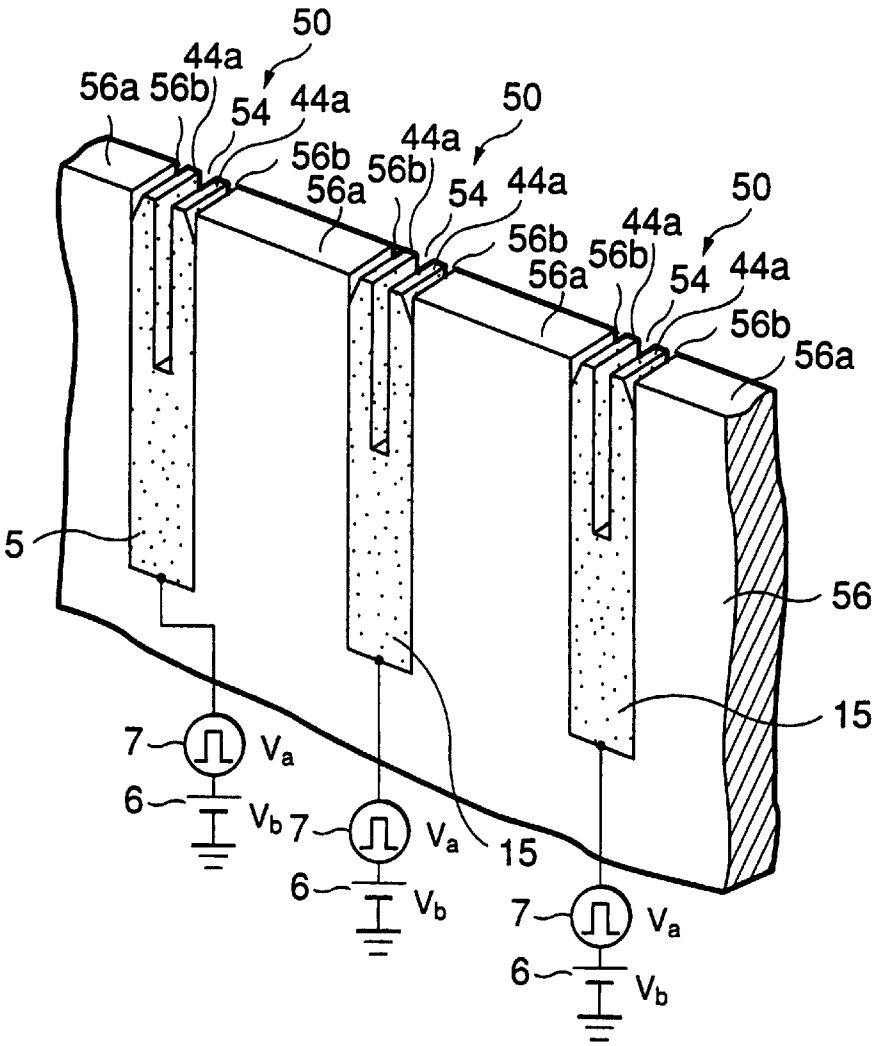
FIG. 83 is a perspective view of the seventh preferred embodiment of a recording head according to the present invention.

Furthermore, while the tip surface of the resin substrate 56 projecting from the opening has been a flat surface other than the ink guide groove 54 in the seventh example, a V-shaped cut-out portion 56*b* may be formed between a tip surface 56*a* of a resin substrate 56 and a flat surface 44*a* of an electrode 15 as in the eighth example of an ink jet recording device shown in FIG. 83. Although the tip is not protruded from the end face 56*a* of the substrate as by the cut-out portion 56*b*, the tip of the electrode 15 is a tapered similar to the tip of the projecting portion 56 in the sixth example shown in FIG. 81.

In the eighth example, after the ink guide groove 54 and the cut-out portion 56*b* are formed in the tip surface 56*a* of the resin substrate 56 to form a projecting portion by the laser working or the like, a recording head 20 is formed by plating or depositing a metal near the groove. Also in this example, the tip of the projecting portion has the flat surface 44*a*, and has the same level as the surrounding portion. Therefore, since the projecting portion is not protruded from the surrounding portions, the tip of the projecting portion is very strong. With this construction, the electric field can be easily focused on the tip of the projecting portion in comparison with the seventh example of the seventh preferred embodiment shown in FIG. 82, so that there is a particular advantage in that the ink can be easily emitted. Furthermore, in a case where the tip portion of the projecting portion is tapered to a point, it is possible to prevent the tip of the projecting portion from being damaged by lowering the tip of the projecting portion than the surrounding portion.

Then, referring to FIG. 84, the ninth example of the seventh preferred example of an ink jet recording device, according to the present invention, will be described. In this preferred embodiment, a head has basically the same structure as that in the seventh example of the seven preferred embodiment shown in FIG. 82. That is, the ink emitting portion does not protrude from the surrounding portion. Although the head is formed by working the resin substrate 56 in the seventh example of the seventh preferred embodiment, a substrate 56 having metal foils on both surfaces of a resin, such as a flexible substrate, is used in this example.

Figure 84:
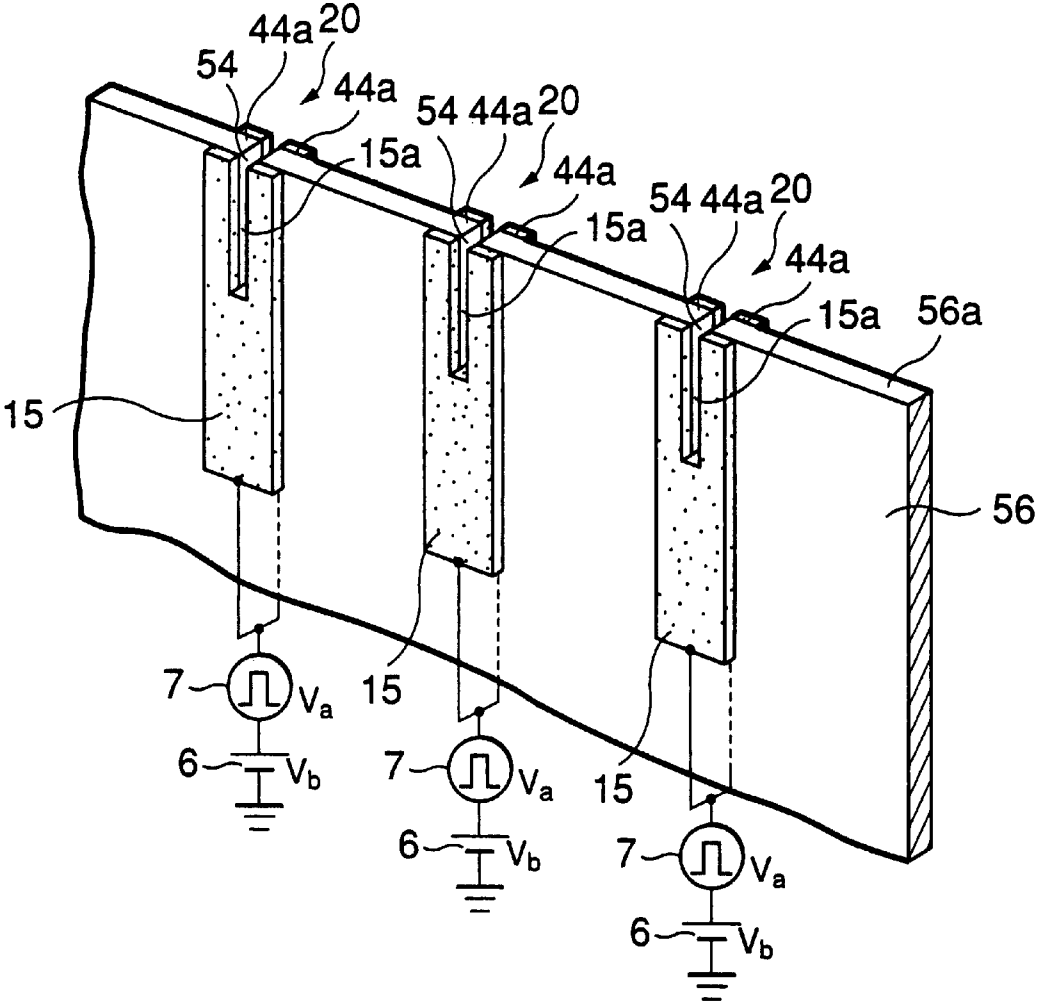
FIG. 84 is a perspective view of the seventh preferred embodiment of a recording head according to the present invention.

In FIG. 84, a recording head 20 has an ink guide groove 44*a* formed in a tip face 56*a* of a substrate 56, flat surfaces 45 arranged on both sides of the ink guide grove 54, and electrodes 15, which are formed on both sides of the substrate 56 and each of which has a slit 15*a* corresponding to the ink guide groove 54. The electrodes 15 are connected to a signal voltage source 7 for supplying a recording signal voltage, and a bias voltage source 6 for supplying a bias voltage.

The recording head 20 if formed by a method comprising the steps of: preparing a substrate 56 of a polyimide resin having a thickness of 50 to 100 $\mu$m, on both surfaces of which copper having a thickness of about 18 $\mu$m is applied; etching both surfaces of the substrate 56 so as to form a desired shape of electrode 15; and laser-working or etching the portion of polyimide to form a portion serving as a slit 15*a*. Thus, the recording head 20 shown in FIG. 84 can be formed. When the recording head 20 is formed by this method, it is possible to simply form the head in comparison with the seventh example shown in FIG. 82. Since the tip portion has the flat surfaces 44*a* similar to FIG. 82, it is strong against the physical force such as the paper jam and cleaning. Furthermore, in the ninth example, since the electrodes 15 are formed on both surface of the substrate 56, the emission of ink can be not only controlled by applying the same voltages to both electrodes, but it can be also controlled by applying different voltages thereto.

Figure 85:
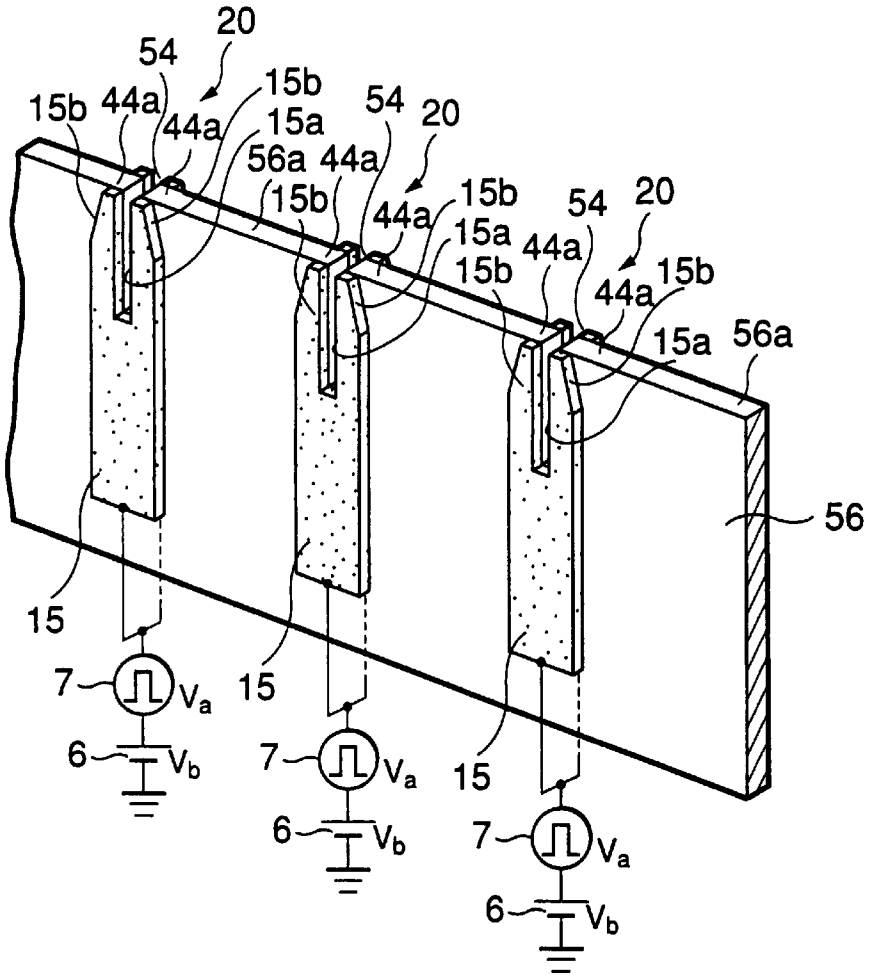
FIG. 85 is a perspective view of the seventh preferred embodiment of a recording head according to the present invention.

FIG. 85 shows the tenth example of an ink jet recording device according to the present invention. In this example, flat surfaces 44*a* are formed on both sides of an ink guide groove 54 at the tip of a recording head 20, and inclined portions 15*b* are formed at the tip of an electrode 15 to be tapered by etching. According to this example, since the tip of the separate electrode 15 is tapered, the electric field is easily focused on the tip to emit the ink. In FIG. 85, while the tip of the electrode 15 has the flat portion, the tip of the electrode 15 may be tapered to a point. However, if the tip of the electrode 15 is tapered to a point, ununiform etching is easily carried out. Therefore, as shown in FIG. 85, small flat portions are preferably formed on the tip portion of the electrode 15.

Figure 86:
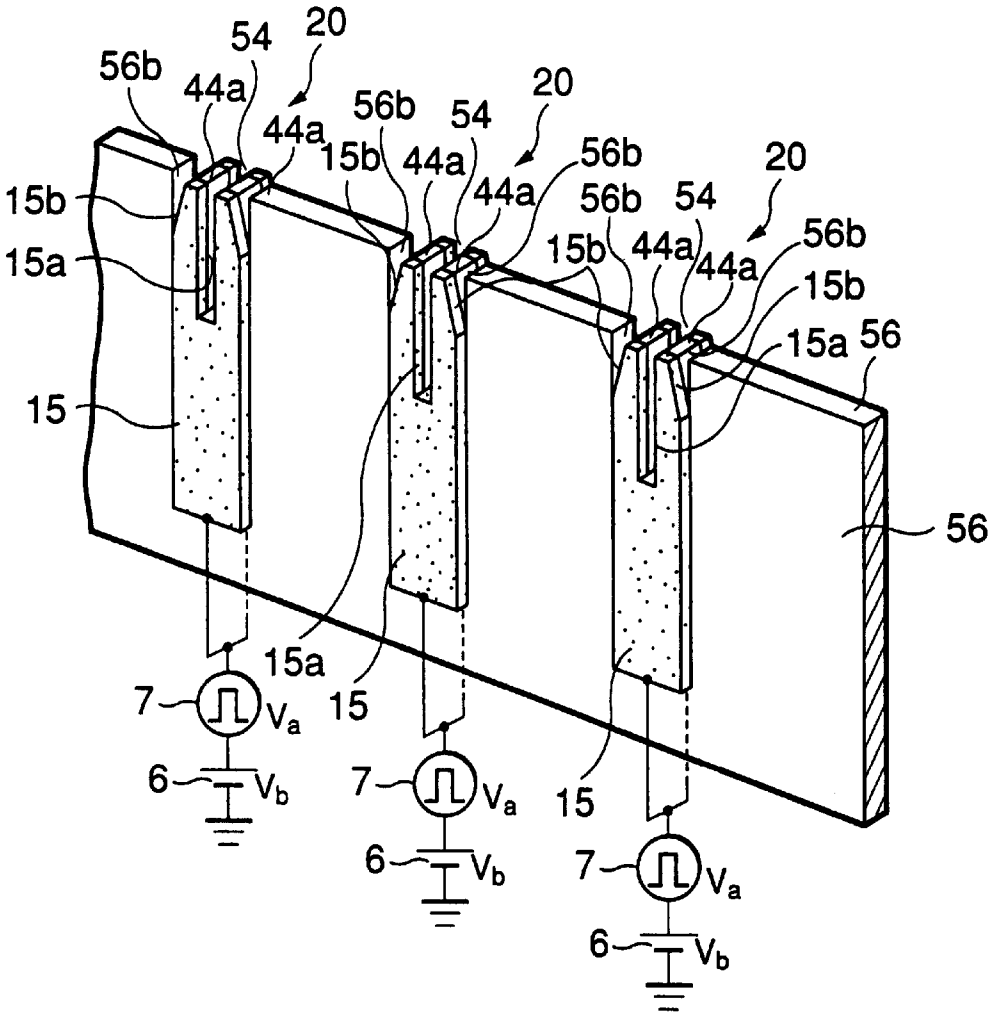
FIG. 86 is a perspective view of the seventh preferred embodiment of a recording head according to the present invention.

FIG. 86 shows the eleventh example of an ink jet recording device, which uses a recording head 20 formed by working both surfaces of a substrate 56, according to the present invention. In this example, the head 20 is the same as the head 20 in the eighth example shown in FIG. 83, except that a plate-like separate electrode 15 is used. That is, only the ink emitting portion is protruded by a cut-out portion 56*b*, and the levels of flat surfaces 44*a* at the tip of the projecting portion are the same as the level of a tip surface 56*a* of a substrate 56.

Thus, the flat surfaces are isolated from the tip surface 44*a* by the cut-out portion 56*b*, so that it is possible to suitably control the amount of ink when a meniscus if formed at the tip of the head 20.

(The Twelfth Example)

Figure 87:
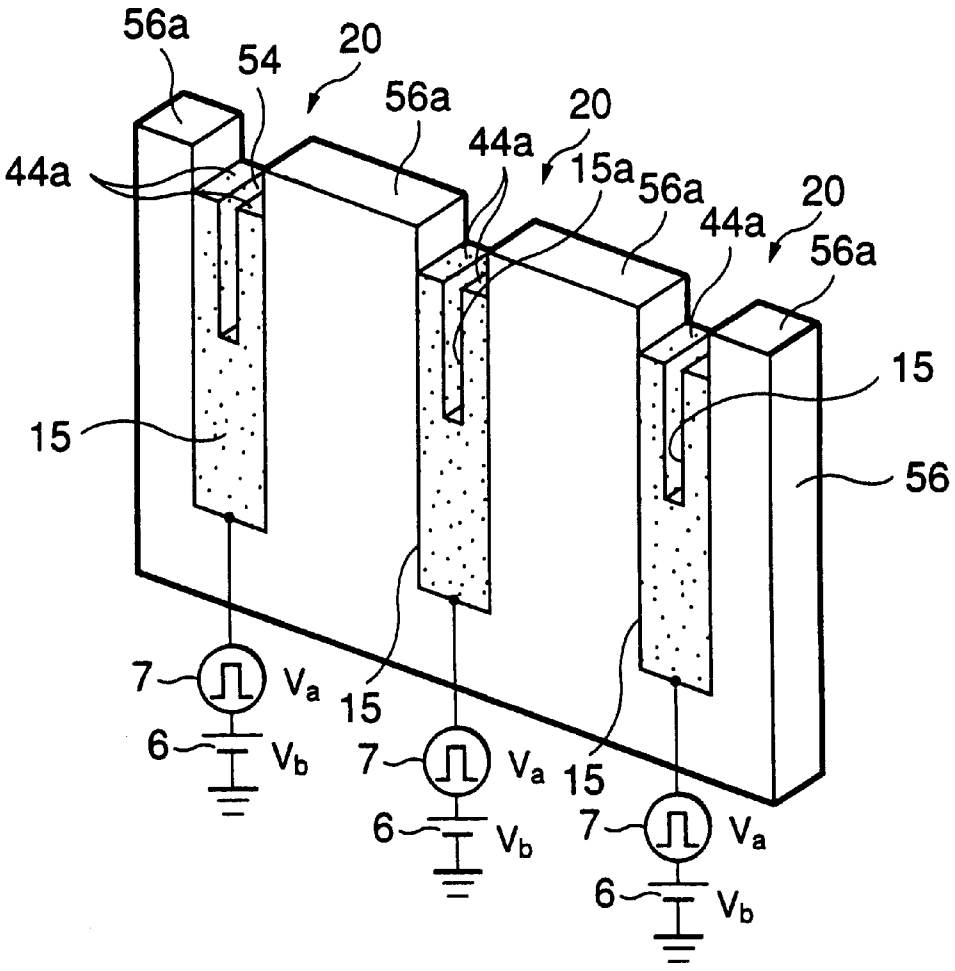
FIG. 87 is a perspective view of the seventh preferred embodiment of a recording head according to the present invention.

While the tip surface 44*a* at the ink droplet emitting position 44 has the same level as that of the flat surface 56*a* of the substrate 56 in the first through tenth example, the present invention should not be limited thereto, but the level of the flat surface may be lower than the level of the substrate. FIG. 87 shows a twelfth example of the seventh preferred embodiment of an ink jet recording device according to the present invention.

In the twelfth example shown in FIG. 87, a recording head 20 has separate electrodes 15, each of which has flat surfaces 44*a* recessed from the tip surface of a substrate 56. The separate electrode 15 has an ink guide groove 54 for sucking ink by capillary phenomenon, and is made of a conductive material. Similar to the electrodes 15, the aforementioned preferred embodiments, a signal voltage source 7 for supplying a recording signal voltage Va and a bias voltage source 6 for always supplying a bias voltage Vb are connected to each of the separated electrodes 15. Thus, even if the flat surface 44*a* of the electrode is arranged so as to be lower than the tip surface 56*a* of the substrate 56 via the stepped portion, it is possible to optimally adjust the amount of ink on the meniscus formed at the tip of the head 20, so that it is possible to suitably form an ink droplet and to improve the resolution when the recording is carried out.

(Thirteenth Example)

Figure 88:
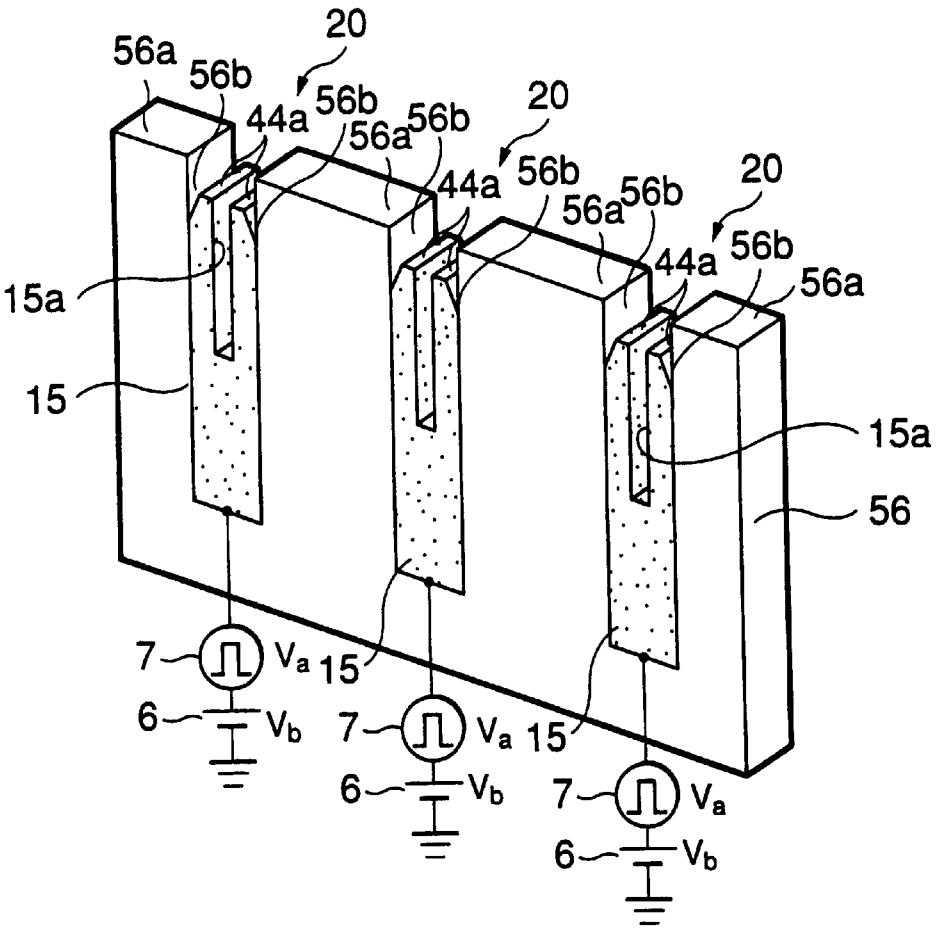
FIG. 88 is a perspective view of the eighth preferred embodiment of a recording head according to the present invention.

In a case where the tip portion of the electrode is arranged so as to be lower than the surrounding portion as shown in FIG. 87, the tip portion 44*a* of the electrode 15 having the low level flat surface 56*a* of the substrate 56 may be tapered. FIG. 88 shows the thirteenth example of an ink jet recording device according to the present invention. In the thirteenth example, a recording head 20 has a tapered electrode 15 formed by a cut-out portion 56*b*. In FIG. 88, flat surfaces 44*a* at the tip of the electrode 15 are lower than a tip surface 56*a* of a substrate 56 with respect to a recording medium. In addition, an ink guide groove 54 is formed in the flat surface 44*a*, and cut-out portions 56*b* are formed outside of the electrode 15.

With this construction, according to the head 20 of the ink jet recording device in the twelfth example, it is possible to protect the tip of the head by the tip surface 56*a* of the substrate 56, and it is possible to form a meniscus near the ink guide groove 54 of the electrode 15 by an appropriate amount of ink. Although it is possible to suitably adjust the amount of ink forming the meniscus by only retracting the flat surface 44*a* of the electrode 15 as shown in FIG. 87, it is possible to further improve the adjustment of the amount of ink by providing the cut-out portion 56*b* as shown in FIG. 88, so that it is possible to improve the recording resolution.

Furthermore, in the twelfth and thirteenth example shown in FIGS. 87 and 88, the head 20 is arranged so as to be retracted from the tip surface 56*a* of the substrate 56 with respect to the recording medium. This may be applied to the ninth through eleventh example shown in FIGS. 84–86 wherein the electrodes are formed on only both surfaces of the substrate. Although this is not illustrated, even if the construction, wherein both surfaces of the ink guide groove is arranged so as to be retracted from the tip portion, is applied to the example wherein the electrodes are formed on both surfaces of the substrate, it is possible to obtain the same advantages as those of the recording head of the seventh preferred embodiment of an ink jet recording device according to the present invention.

THE EIGHTH PREFERRED EMBODIMENT

Figure 89:
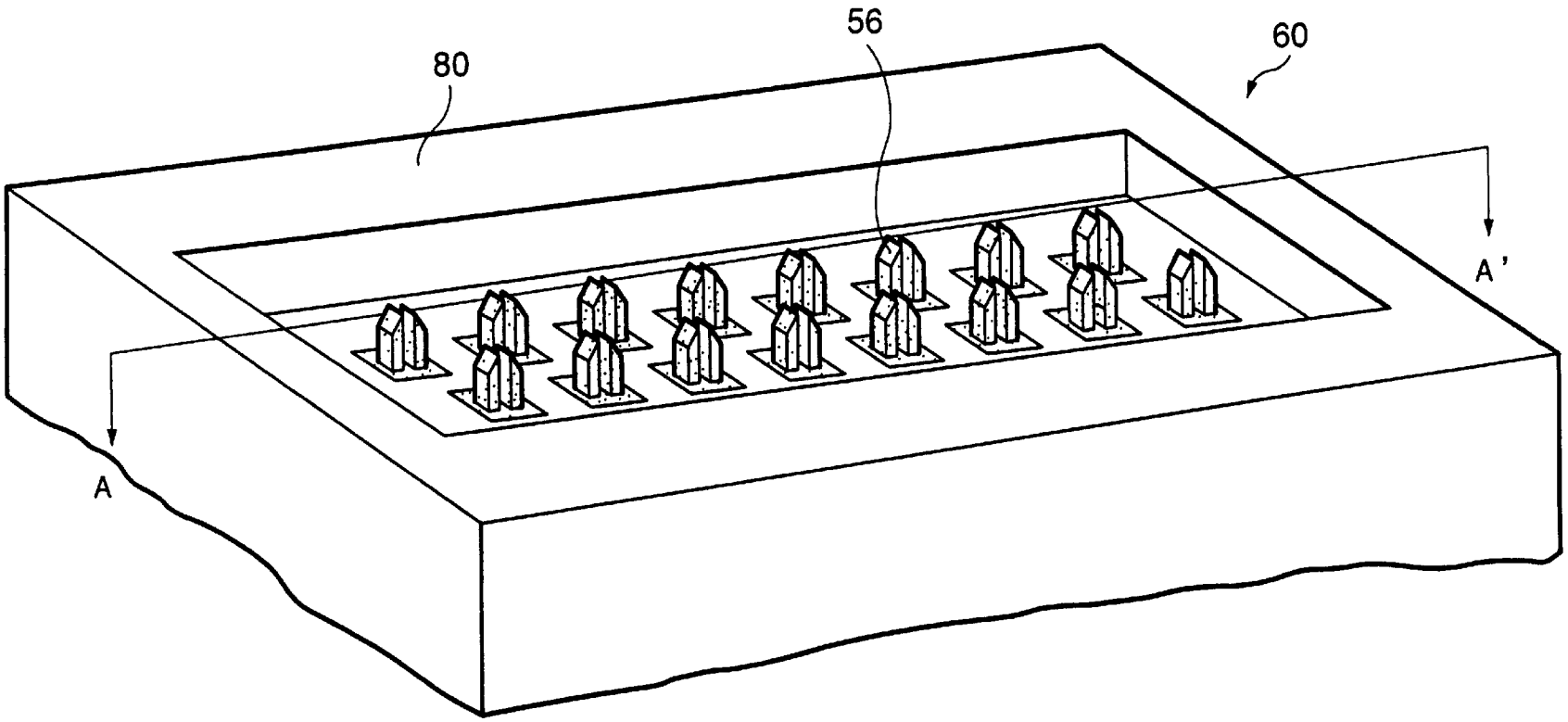
FIG. 89 is a perspective view of the eighth preferred embodiment of a recording head according to the present invention.
Figure 90:
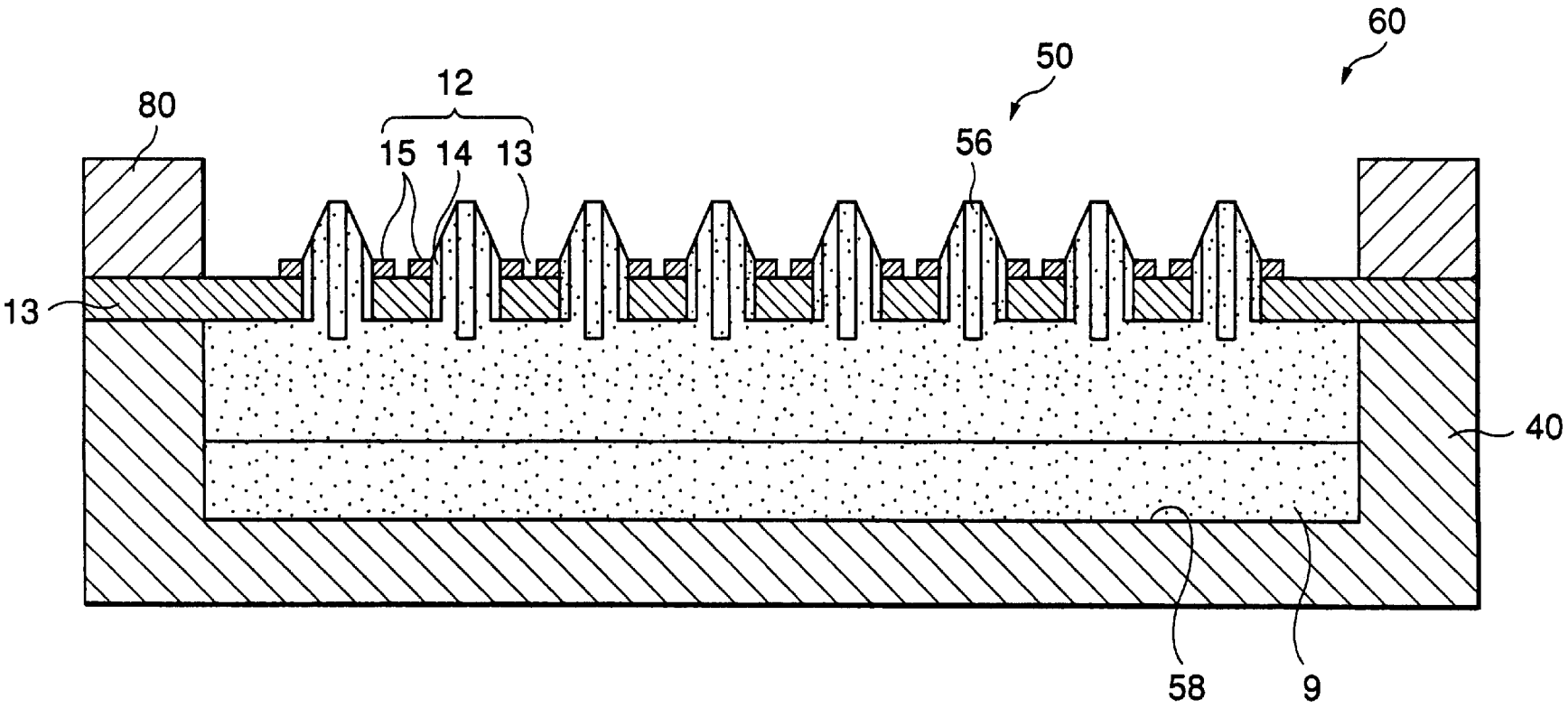
FIG. 90 is a sectional view taken along line A—A of FIG. 89.

FIG. 89 is a perspective view of the eighth embodiment of a line scanning ink jet head according to the present invention, and FIG. 90 is a sectional view taken along line A'—A' of FIG. 89. A separate electrode 60 comprises a control electrode substrate 12, and an ink guide 50 having a projecting portion 56. The control electrode substrate 12 and the ink guide 50 are supported on a head block 40 in a predetermined manner. A protecting member 80 is formed around the ink guide 50, so that the tip portion of the ink guide 50 is arranged between the protecting member 80 and the control electrode substrate 12. An ink 9 comprises: a coloring material component having a positive charge, a charge control agent, a binder and so forth, which are colloidally dispersed in an insulating solvent having a resistibility of not less than 108 Ωcm. The ink 9 is supplied from an ink supply system (not shown) to an ink chamber 58 defined by the control electrode substrate 12 and the head block 40, to be filled therein. Furthermore, while the head has two rows of ink guides, each row containing eight (8) ink guides, the present invention should not be limited thereto.

Figure 91:
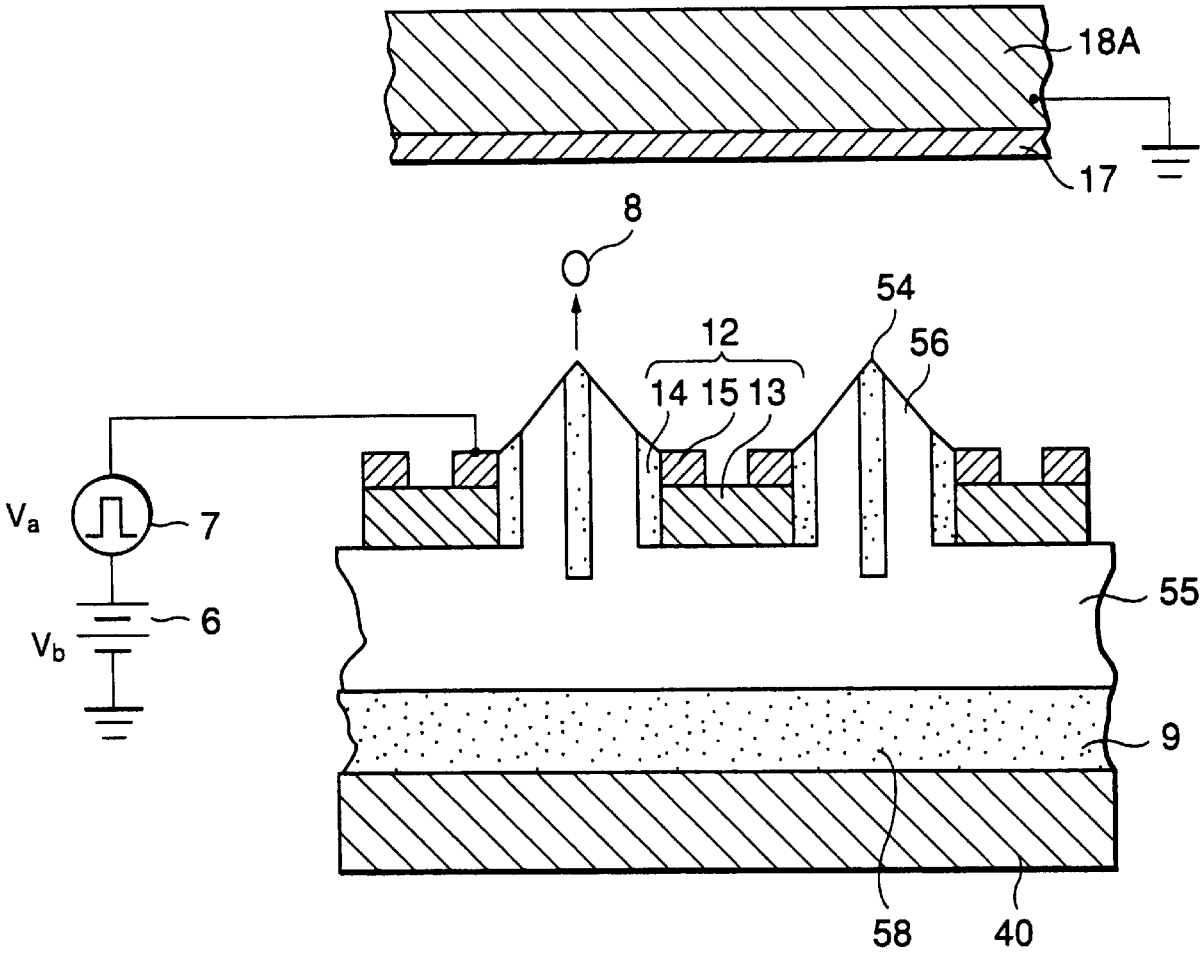
FIG. 91 is a sectional view showing an ink jet head portion and a principal part of the eighth preferred embodiment of an ink jet recording device according to the present invention.

FIG. 91 is an elongated view of the surrounding portion of the separate electrode 60 corresponding to each of the recording dots shown in FIG. 90, which shows the construction of an ink jet recording device using the ink jet head. FIG. 91, since the same numerals shown in FIG. 20 denotes the same components in the second example of the second embodiments, the duplicated description is omitted.

Figure 92:
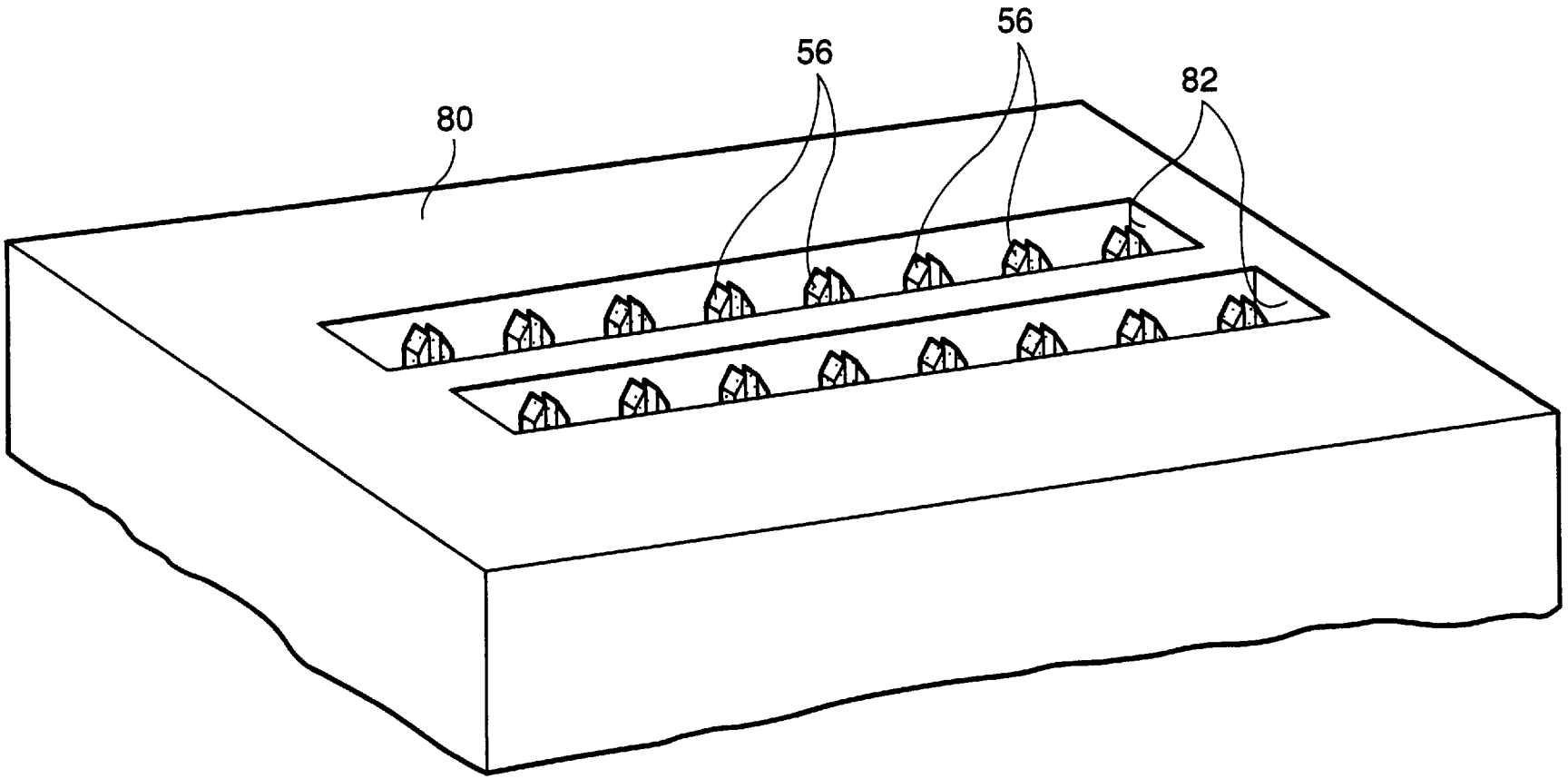
FIG. 92 is a perspective view illustrating a second shape of a protecting member in the eighth preferred embodiment.
Figure 93:
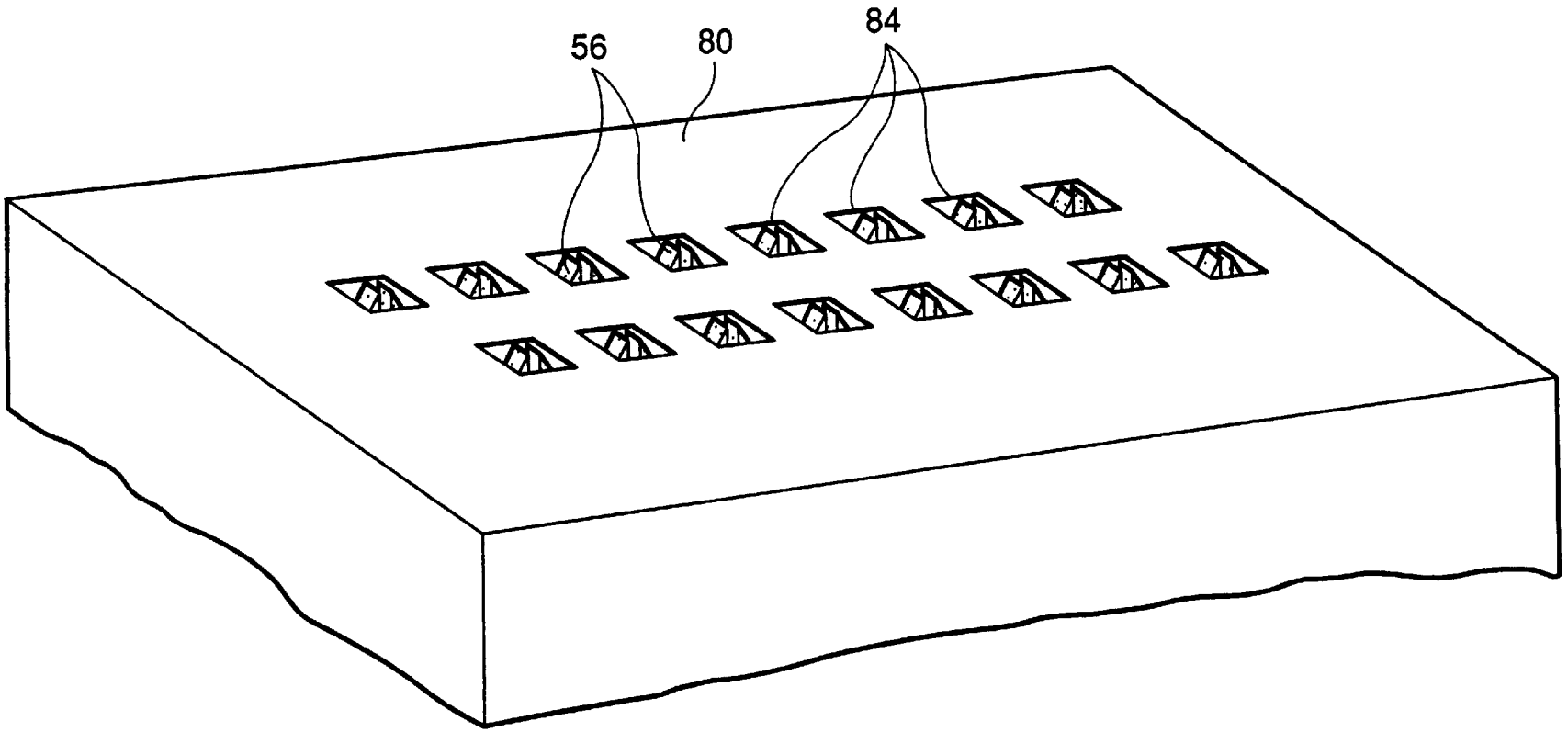
FIG. 93 is a perspective view illustrating a third shape of a protecting member in the eighth preferred embodiment.

While the shape of the protecting member 80 shown in FIG. 89 is formed so as to surround the whole two rows of ink guide, each row containing eight ink guides, it may be formed so that each row of eight ink guides is surrounded by a slit as shown in FIG. 92. Moreover, the protecting member 80 may be formed so that each of ink guides is surrounded as shown in FIG. 93.

What is claimed is:

1. An ink jet recording device for applying a static electric force in an ink to cause an ink particle to fly onto a recording medium for recording, the ink jet recording device comprising:

a control electrode substrate including an insulating substrate arranged to face the recording medium, a through hole which is passed through said insulating substrate for ejecting and flying said ink particle toward said recording medium, and a control electrode provided near said through hole to apply the static electric force to the ink;

ink supply means for supplying ink into said through hole of said control electrode substrate;

voltage applying means for applying a voltage to said control electrode;

an ink guide, which is arranged substantially at a center of said through hole of said insulating substrate and said control electrode and which has a tip portion serving as an ink-droplet flying position, said tip portion projecting from an upper surface of said control electrode or said insulating substrate toward said recording medium; wherein said ink guide comprises a flat base portion facing said control electrode substrate and a plurality of projecting portions, each of which projects in an ink flying direction from said base portion at a position facing a corresponding through hole for allowing the ink to fly out of the tip of the projecting portion; wherein said projecting portion of said ink guide projects in an ink flying direction from the through hole of said insulating substrate and said control electrode, and said projecting portion has a tip portion having inclined planes toward both sides; wherein said projecting portion of said ink guide has a flat plane which is arranged to join said included planes to one another.

2. An ink jet recording device for applying a static electric force in an ink to cause an ink particle to fly onto a recording medium for recording, the ink jet recording device comprising:

a control electrode substrate including an insulating substrate arranged to face the recording medium, a through hole which is passed through said insulating substrate for ejecting and flying said ink article toward said recording medium, and a control electrode provided near said through hole to apply the static electric force to the ink;

ink supply means for supplying ink into said through hole of said control electrode substrate;

voltage applying means for applying a voltage to said control electrode;

an ink guide, which is arranged substantially at a center of said through hole of said insulating substrate and said control electrode and which has a tip portion serving as an ink-droplet flying position, said tip portion projecting from an upper surface of said control electrode or said insulating substrate toward said recording medium, said ink guide includes a protecting member which projects closer toward said recording medium than a tip surface of said projecting portion of said ink guide.

3. An ink jet recording device for applying a static electric force in an ink to cause an ink particle to fly onto a recording medium for recording, the ink jet recording device comprising:

a control electrode substrate including an insulating substrate arranged to face the recording medium, a through hole which is passed through said insulating substrate for ejecting and flying said ink particle toward said recording medium, and a control electrode provided near said through hole to apply the static electric force to the ink;

ink supply means for supplying ink into said through hole of said control electrode substrate;

voltage applying means for applying a voltage to said control electrode; wherein said voltage applying means comprises signal voltage apply means for applying a signal voltage corresponding to an image signal for flying said ink droplet from said through holes toward said recording medium, and bias voltage applying means for applying a bias voltage between said first and second control electrodes for accelerating the flying ink particle, wherein when the surface potential of said recording medium is Vm, a voltage of said signal voltage for causing an ion particle to fly is V1on, a voltage of said signal voltage for causing the ion particle not to fly is V1off, and said bias voltage is V2, restrictions on V2 include $$Vm<V2<V1off \text{ and } Vm<V1on<V2.$$

4. An ink jet recording device for applying a static electric force in an ink to cause an ink particle to fly onto a recording medium for recording, the ink jet recording device comprising:

a control electrode substrate including an insulating substrate arranged to face the recording medium, a through hole which is passed through said insulating substrate for ejecting and flying said ink particle toward said recording medium, and a control electrode provided near said through hole to apply the static electric force to the ink;

ink supply means for supplying ink into said through hole of said control electrode substrate;

voltage applying means for applying a voltage to said control electrode; wherein said voltage applying means comprises signal voltage apply means for applying a signal voltage corresponding to an image signal for flying said ink droplet from said through holes toward said recording medium, and bias voltage applying means for applying a bias voltage between said first and second control electrodes for accelerating the flying ink particle, wherein when a surface potential of said recording medium is Vm, a voltage of said signal voltage for causing an ion particle to fly is V1on, a voltage of said signal voltage for causing the ion particle not to fly is V1off, and said bias voltage is V2, restrictions on V2 include $$Vm<V1off<V2 \text{ and } Vm<V2<V1on.$$

5. The ink jet recording system for applying a electrostatic force to an ink containing a coloring material dispersed in a solvent to cause an ink droplet to fly onto a recording medium for recording, the ink jet recording system comprising:

a control electrode substrate including an insulating substrate having a common surface arranged to face the recording medium, a plurality of through holes arranged in a row and passing at a right angle through said common surface of the insulating substrate for emitting said ink droplet toward said recording medium, and a first control electrode and a second control electrode which are provided on both surfaces around each of said plurality of through holes of said insulating substrate, respectively;

ink supply means for supplying an ink into each of said plurality through holes of said control electrode substrate; and voltage applying means for applying a voltage to said first and second control electrodes to have the electrostatic force, wherein said voltage applying means comprises signal voltage applying means for applying a signal voltage corresponding to a recording signal for emitting said ink droplet from said through holes toward said recording medium, and bias voltage applying means for applying a predetermined bias voltage for flying said ink droplet from said through holes toward said recording medium, wherein when a surface potential of said recording medium is Vm, a voltage of said signal voltage for causing the ink droplet to fly is V1on, a voltage of said signal voltage for causing the ink droplet not to fly is V1off, and said bias voltage is V2, restrictions on V2 include $$Vm<V2<V1off, \text{ and } Vm<V1on<V2.$$

6. The ink jet recording system for applying a electrostatic force to an ink containing a coloring material dispersed in a solvent to cause an ink droplet to fly onto a recording medium for recording, the ink jet recording system comprising:

a control electrode substrate including an insulating substrate having a common surface arranged to face the recording medium, a plurality of through holes arranged in a row and passing at a right angle through said common surface of the insulating substrate for emitting said ink droplet toward said recording medium, and a first control electrode and a second control electrode which are provided on both surfaces around each of said plurality of through holes of said insulating substrate, respectively;

ink supply means for supplying an ink into each of said plurality through holes of said control electrode substrate; and voltage applying means for applying a voltage to said first and second control electrodes to have the electrostatic force, wherein said voltage applying means comprises signal voltage applying means for applying a signal voltage corresponding to a recording signal for emitting said ink droplet from said through holes toward said recording medium, and bias voltage applying means for applying a predetermined bias voltage for flying said ink droplet from said through holes toward said recording medium, wherein when a surface potential of said recording medium is Vm, a voltage of said signal voltage for causing the ink droplet to fly is V1on, a voltage of said signal voltage for causing the ink droplet not to fly is V1off, and said bias voltage is V2, restrictions on V2 include $$Vm<V1offs\leqq V2, \text{ and } Vm<V2<V1on.$$

7. An ink jet recording system for applying an electrostatic force to an ink containing a coloring material dispersed in a solvent to cause an ink droplet to fly onto a recording medium for recording, the ink jet recording system comprising:

a control electrode substrate including an insulating substrate having a common surface arranged to face the recording medium, a plurality of through holes arranged in a row and passing at a right angle through said common surface of the insulating substrate for emitting said ink droplet toward said recording medium, and a control electrode provided near each of said through holes for causing said electrostatic force to act on said ink;

an ink guide arranged at said through hole of said control electrode substrate, and having a tip portion serving as an ink-droplet emitting position, said tip portion projecting from an upper surface of said control electrode substrate toward said recording medium at least when emitting the ink;

ink supply means for supplying an ink into said through holes of said control electrode substrate; and voltage applying means for applying a voltage to said control electrode to generate the electrostatic force.

8. The ink jet recording system according to claim 7, wherein guide is fixed in the manner that said tip portion is projecting from said upper surface of said control electrode substrate toward said recording medium.

9. The ink jet recording system according to claim 7, wherein said control electrode is formed on one side of a surface of said insulating substrate.

10. The ink jet recording system according to claim 7, wherein said control electrode comprises first and second control electrodes formed on said common surface and another surface of said insulating substrate, respectively.

11. The ink jet recording system according to claim 10, wherein said first control electrode is common with said plurality of through holes formed on said insulating substrate, and said second control electrode is separately formed so as to correspond to said plurality of through holes.

12. The ink jet recording system according to claim 7, further comprising:

an ink guide moving mechanism for providing said ink guide so as to approach said recording medium and for retracting said ink guide so as to be apart from said recording medium.

13. The ink jet recording system according to claim 12, wherein said ink guide moving mechanism sets a moving distance of said ink guide in a manner that, a distance between the tip of the ink guide and the recording medium is less than a distance between a surface of the ink and the recording medium at least when a picture is recorded, and the distance between the tip of the ink guide and the recording medium is greater than the distance between the surface of the ink and the recording medium when a picture is not recorded.

14. The ink jet recording system according to claim 13, wherein said ink guide moving mechanism retracts said ink guide in such a way that said tip portion is dipped into ink when a picture is not recorded.

15. The ink jet recording system according to claim 14, wherein said ink is soaked in one of a fiber and porous body, and said ink guide moving mechanism retracts said ink guide in such a manner that said tip portion is immersed in ink soaked in one of fiber and porous body when a picture is recorded.

16. The ink jet recording system according to claim 12, wherein said ink guide comprises a plurality of tip portions corresponding to a plurality of rows of said through holes, and said ink guide moving mechanism causes all of said tip portions to move in synchronism with each other.

17. The ink jet recording system according to claim 12, wherein said ink guide comprises a base portion formed from a plate member having an area corresponding to a region in which a plurality of rows and columns of said through holes are provided, and a plurality of projecting portions which project from a surface on one side of said base portion corresponding to said through holes; and said ink guide moving mechanism is provided on said base portion.

18. The ink jet recording system according to claim 12, wherein said ink guide moving mechanism comprises a piezoelectric element.

19. The inkjet recording system according to claim 12, wherein said ink guide moving mechanism comprises an electromagnetic coil.

20. The ink jet recording system according to claim 12, wherein said control electrode substrate comprises:

a first control electrode which is arranged around one of two adjacent through holes of the plurality of through holes formed on said insulating substrate for emitting an ink droplet, and which is provided on said insulating substrate on the common surface; and a second control electrode which is arranged around the other of said two adjacent through holes, and which is provided on said insulating substrate on the opposite side of said common surface.

21. The ink jet recording system according to claim 20, wherein adjacent through holes of said plurality of through holes are mutually shifted from each other, and said first and second through holes are formed on a same row of through holes, respectively.

22. The ink jet recording system according to claim 20, wherein said through holes are arranged in a plurality of rows, one of two adjacent through holes in a same row being provided with said first control electrode, and the other of two adjacent through holes in the same row being provided with said second control electrode.

23. The ink jet recording system according to claim 20, wherein said voltage apply means applies voltage to said first and second control electrodes, and the voltage applied to said second control electrode is higher than the voltage applied to said first control electrode.

24. The ink jet recording system according to claim 7, further comprising:

a protecting member which projects toward said recording medium more than said tip portion of said ink guide.

25. The ink jet recording system according to claim 24, wherein said protecting member is arranged on said control electrode substrate toward said recording medium, and said ink guide is arranged such that said tip portion serving as an ink-droplet emitting position projects from a level of a surface of said control electrode substrate, and said tip portion is positioned under a level of a top portion of said protecting member.

26. The ink jet recording system according to claim 7, wherein said ink guide comprises a tip portion which is inclined toward a tip.

27. The ink jet recording system according to claim 26, wherein said ink guide comprises said tip portion shaped as a truncated pyramid having tapered surfaces.

28. The ink jet recording system according to claim 27, wherein said ink guide comprises at least one recessed groove formed on any of said tapered surfaces of said truncated pyramid.

29. The ink jet recording system according to claim 27, wherein said ink guide comprises a recessed groove formed on a top surface of said truncated pyramid.

30. The ink jet recording system according to claim 26, wherein said ink guide comprises said tip portion having a substantially constant thickness.

31. The ink jet recording system according to claim 30, wherein said ink guide comprises an ink guide groove which is formed at said tip portion.

32. The ink jet recording system according to claim 31, wherein said ink guide comprises a flat surface which is formed on said tip portion.

33. The ink jet recording system according to claim 7, wherein said ink guide comprises said tip portion having a constant thickness, and at which a slit is formed along an ink-droplet emitting direction.

34. The ink jet recording system according to claim 7, wherein said ink guide comprises an insulating member.

35. The ink jet recording system according to claim 7, wherein said ink guide comprises a base portion having a plate-shape and facing said control electrode substrate, and a projecting portion which projects in an ink flying direction from said base portion at a position facing a corresponding through hole for allowing the ink to emit out of a tip of the projecting portion.

36. The ink jet recording system according to claim 35, wherein said ink guide comprises:

a base portion having a plate shape extending along one row of said through holes, and a plurality of projecting portions which are formed so as to project from one side of said base portion at regular intervals corresponding to said through holes.

37. The ink jet recording system according to claim 35, wherein said ink guide comprises:

a base portion having a plate shape corresponding to an area of a plurality of rows and columns of said through holes, and a plurality of projecting portions which are formed so as to project from said base portion at regular intervals corresponding to said rows and columns of said through holes.

38. The ink jet recording system according to claim 35, wherein at least a surface of said plurality of projecting portions of said ink guide has conductivity, and said projecting portions adjacent to each other are insulated.

39. The ink jet recording system according to claim 35, wherein said plurality of projecting portions of said ink guide are entirely formed from a conductive member, and said base portion is formed from an insulating member.

40. The ink jet recording system according to claim 7, wherein said control electrode is equipped on said tip portion of said ink guide.

41. The ink jet recording system according to claim 7, wherein said ink supply means comprises an ink chamber which is arranged on the opposite side of said recording medium of said control electrode substrate, and an ink circulating mechanism for supplying ink to said ink chamber and returning said ink from said ink chamber.

42. The ink jet recording system according to claim 41, wherein said ink supply means comprises a porous body arranged in said ink chamber for storing said ink.

43. The ink jet recording system according to claim 7, wherein said ink is a liquid ink containing a charging coloring material dispersed in an insulating solvent.

44. The inkjet recording system according to claim 7, wherein said voltage apply means comprises signal voltage apply means for applying a signal voltage corresponding to a recording signal for emitting said ink droplet from said through holes toward said recording medium, and bias voltage applying means for applying a predetermined bias voltage for flying said ink droplet from said through holes toward said recording medium.

45. The ink jet recording system according to claim 44, wherein said bias voltage apply means is a charger for charging the surface of said recording medium to apply a predetermined potential thereto.

* * * * *